US005310635A

United States Patent [19]

Szajewski

[11] Patent Number: 5,310,635

[45] Date of Patent: May 10, 1994

[54] PHOTOGRAPHIC CAMERA FILM CONTAINING A HIGH CHLORIDE TABULAR GRAIN EMULSION WITH TABULAR GRAIN {100} MAJOR FACES

[75] Inventor: Richard P. Szajewski, Rochester, N.Y.

[73] Assignee: Eastman Kodak Company, Rochester, N.Y.

[21] Appl. No.: 34,061

[22] Filed: Mar. 22, 1993

[51] Int. Cl.[5] ..... G03C 1/00

[52] U.S. Cl. ..... 430/496; 430/501; 430/567; 354/275; 354/341

[58] Field of Search ..... 430/501, 567, 496; 354/275, 341

[56] References Cited

U.S. PATENT DOCUMENTS

| | | | |
|---|---|---|---|
| 4,063,951 | 12/1977 | Bogg | 96/94 R |
| 4,386,156 | 5/1983 | Mignot | 430/567 |
| 4,399,215 | 8/1983 | Wey | 430/567 |
| 4,400,463 | 8/1983 | Maskasky | 430/569 |
| 4,414,306 | 11/1983 | Wey et al. | 430/567 |
| 4,713,323 | 12/1987 | Maskasky | 430/567 |
| 4,783,398 | 11/1988 | Takada et al. | 430/567 |
| 4,804,621 | 2/1989 | Tufano et al. | 430/567 |
| 4,942,120 | 7/1990 | King et al. | 430/567 |
| 4,952,491 | 8/1990 | Nishikawa et al. | 430/567 |
| 4,983,508 | 1/1991 | Ishiguro et al. | 430/569 |
| 5,215,874 | 6/1993 | Sakakibara | 430/501 |

FOREIGN PATENT DOCUMENTS

| | | | |
|---|---|---|---|
| 0466417 | 1/1992 | European Pat. Off. . | |
| 466417A1 | 1/1992 | European Pat. Off. | G03C 3/00 |
| 2024643 | 1/1990 | Japan | G03C 1/06 |

OTHER PUBLICATIONS

Endo & Okaji, "An Empirical Rule to Modify the Crystal Habit of Silver Chloride to Form Tabular Grains in an Emulsion", The Journal of Photographic Science, vol. 36, pp. 182–188, 1988.

Mumaw & Haugh, "Silver Halide Precipitation Coalescence Processes", Journal of Imaging Science, vol. 30, No. 5, Sep./Oct. 1986, pp. 198–209.

Symposium: Torino 1963, Photographic Science, Edited by C. Semerano & U. Mazzucato, Focal Press, pp. 52–55.

*Primary Examiner*—Charles L. Bowers, Jr.
*Assistant Examiner*—Thomas R. Neville
*Attorney, Agent, or Firm*—Carl O. Thomas

[57] ABSTRACT

A photographic camera film comprised of at least one radiation sensitive silver halide emulsion layer unit and a film base in a roll satisfying the formula $$\frac{L - SD}{TU \times 2} - FBT = 10 \text{ to } 60\ \mu m$$

in which

FBT is the thickness of the film base in micrometers (μm).

L is the diameter in μm of the film roll;

SD is the spool diameter in μm of the film roll; and

TU is the number of film turns in the film roll; wherein at least one emulsion layer unit is comprised of a radiation sensitive emulsion is disclosed containing a silver halide grain population comprised of at least 50 mole percent chloride, based on silver, wherein at least 50 percent of the grain population projected area is accounted for by tabular grains bounded by {100} major faces having adjacent edge ratios of less than 10 and each having an aspect ratio of at least 2.

19 Claims, 4 Drawing Sheets

2 μm

2 μm

PHOTOGRAPHIC CAMERA FILM CONTAINING A HIGH CHLORIDE TABULAR GRAIN EMULSION WITH TABULAR GRAIN {100} MAJOR FACES

FIELD OF THE INVENTION

The invention relates to roll films for cameras and to cartridges and cameras containing the films.

BACKGROUND

While many different techniques for imaging are known, for candid photography using hand-held cameras the overwhelming choice is to employ a film that records images in one or more silver halide emulsion layer units coated on a film base. The film is most frequently purchased in a single or double roll cartridge that contains a film strip of sufficient length to provide 12, 24 or 36 exposure frames. More recently interest has revived in single use cameras containing preloaded film, first introduced before the turn of the century by George Eastman. By feeding the film from a tightly spooled roll for exposure and then again spooling the exposed film, the film and camera together can form a compact imaging unit.

Silver halide emulsions contain radiation sensitive microcrystals (grains) dispersed in a vehicle. The highest attainable photographic speeds and the best balances of photographic speed and image quality (hereinafter also referred to as speed-granularity relationships) have been traditionally realized with silver iodobromide emulsions. Silver bromide emulsions have been sparingly used for hand held camera photography while silver chloride containing emulsions and particularly high chloride emulsions, though clearly functional, have not found manufacturing acceptance, because of the superior performances of the other available halides. The term "high chloride" refers to grains that contain at least 50 mole percent chloride based on silver. In referring to grains of mixed halide content, the halides are named in order of increasing molar concentrations—e.g., silver iodochloride and silver iodobromide each contain a higher molar concentration of chloride or bromide, respectively, than iodide.

During the 1980's a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds, and improved image sharpness in both mono- and multiemulsion layer formats, can be achieved by employing tabular grain emulsions.

One of the very few areas in which the performance of tabular grain emulsions has not exceeded that obtainable with nontabular grain emulsions as been in the area of pressure induced alteration of photographic sensitivity. These pressure induced alterations have been observed in some instances as pressure desensitization and in other instances as pressure sensitization. Unwanted pressure effects can be induced in roll films by spooling the film strips and/or by advancing the film strip over abrading surfaces.

The shape of tabular grains renders them more vulnerable to the physical strains within the crystal structure that alter photographic response. An emulsion is generally understood to be a "tabular grain emulsion" when tabular grains account for at least 50 percent of total grain projected area. A grain is generally considered to be a tabular grain when the ratio of its equivalent circular diameter (ECD) to its thickness (t) is at least 2. The equivalent circular diameter of a grain is the diameter of a circle having an area equal to the projected area of the grain. The term "intermediate aspect ratio tabular grain emulsion" refers to an emulsion which has an average tabular grain aspect ratio in the range of from 5 to 8. The term "high aspect ratio tabular grain emulsion" refers to an emulsion which has an average tabular grain apsect ratio of greater than 8. The term "thin tabular grain" is generally understood to be a tabular grain having a thickness of less than 0.2 μm. The term "ultrathin tabular grain" is generally understood to be a tabular grain having a thickness of 0.06 μm or less.

The overwhelming majority of tabular grain emulsions contain tabular grains that are irregular octahedral grains. Regular octahedral grains contain eight identical crystal faces, each lying in a different {111} crystallographic plane. Tabular irregular octahedra contain two or more parallel twin planes that separate two major grain faces lying in {111} crystallographic planes. The {111} major faces of the tabular grains exhibit a threefold symmetry, appearing triangular or hexagonal. It is generally accepted that the tabular shape of the grains is the result of the twin planes producing favored edge sites for silver halide deposition, with the result that the grains grow laterally while increasing little, if any, in thickness after parallel twin plane incorporation.

While tabular grain emulsions have been advantageously employed in a wide variety of photographic and radiographic applications, the requirement of parallel twin plane formation and {111} crystal faces pose limitations both in emulsion preparation and use. These disadvantages are most in evidence in considering tabular grains containing significant chloride concentrations. It is generally recognized that silver chloride grains prefer to form regular cubic grains—that is, grains bounded by six identical {100} crystal faces. Tabular grains bounded by {111} faces in silver chloride emulsions revert to nontabular forms unless morphologically stabilized.

While tabular grain silver bromide emulsions were known to the art long before the 1980's, Wey U.S. Pat. No. 4,399,215 produced the first tabular grain silver chloride emulsion. The tabular grains were of the twinned type, exhibiting major faces of threefold symmetry lying in {111} crystallographic planes. An ammoniacal double-jet precipitation technique was employed. The thicknesses of the tabular grains were high compared to contemporaneous silver bromide and bromoiodide tabular grain emulsions because the ammonia ripening agent thickened the tabular grains. To achieve ammonia ripening it was also necessary to precipitate the emulsions at a relatively high pH, which is known to produce elevated minimum densities (fog) in high chloride emulsions. Further, to avoid degrading the tabular grain geometries sought both bromide and iodide ions were excluded from the tabular grains early in their formation.

Wey et al U.S. Pat. No. 4,414,306 developed a twinning process for preparing silver chlorobromide emulsions containing up to 40 mole percent chloride based on total silver. This process of preparation has not been successfully extended to high chloride emulsions. The highest average aspect ratio reported in the Examples was 11.

Maskasky U.S. Pat. No. 4,400,463 (hereinafter designated Maskasky I) developed a strategy for preparing a high chloride emulsion containing tabular grains with parallel twin planes and {111} major crystal faces with the significant advantage of tolerating significant internal inclusions of the other halides. The strategy was to use a particularly selected synthetic polymeric peptizer in combination with a grain growth modifier having as its function to promote the formation of {111} crystal faces Adsorbed aminoazaindenes, preferably adenine, and iodide ions were disclosed to be useful grain growth modifiers.

Maskasky U.S. Pat. No. 4,713,323 (hereinafter designated Maskasky II), significantly advanced the state of the art by preparing high chloride emulsions containing tabular grains with parallel twin planes and {111} major crystal faces using an aminoazaindene growth modifier and a gelatino-peptizer containing up to 30 micromoles per gram of methionine Since the methionine content of a gelatino-peptizer, if objectionably high, can be readily reduced by treatment with a strong oxidizing agent (or alkylating agent, King et al U.S Pat. No. 4,942,120), Maskasky II placed within reach of the art high chloride tabular grain emulsions with significant bromide and iodide ion inclusions prepared starting with conventional and universally available peptizers.

Maskasky I and II have stimulated further investigations of grain growth modifiers capable of preparing high chloride emulsions of similar tabular grain content. Tufano et al U.S. Pat. No. 4,804,621 employed di(hydroamino)azines as grain growth modifiers; Takada et al U.S. Pat. No. 4,783,398 employed heterocycles containing a divalent sulfur ring atom; Nishikawa et al U.S. Pat. No. 4,952,491 employed spectral sensitizing dyes and divalent sulfur atom containing heterocycles and acyclic compounds; and Ishiguro et al U.S. Pat. No. 4,983,508 employed organic bis-quaternary amine salts.

Bogg U.S. Pat. No. 4,063,951 reported the first tabular grain emulsions in which the tabular grains had parallel {100} major crystal faces. The tabular grains of Bogg exhibited square or rectangular major faces, thus lacking the threefold symmetry of conventional tabular grain {111} major crystal faces. In the sole example Bogg employed an ammoniacal ripening process for preparing silver bromoiodide tabular grains having aspect ratios ranging from 4:1 to 1:1. The average aspect ratio of the emulsion was reported to be 2, with the highest aspect ratio grain (grain A in FIG. 3) being only 4. Bogg states that the emulsions can contain no more than 1 percent iodide and demonstrates only a 99.5% bromide 0.5% iodide emulsion. Attempts to prepare tabular grain emulsions by the procedures of Bogg have been unsuccessful.

Mignot U.S. Pat. No. 4,386,156 represents an improvement over Bogg in that the disadvantages of ammoniacal ripening were avoided in preparing a silver bromide emulsion containing tabular grains with square and rectangular major faces. Mignot specifically requires ripening in the absence of silver halide ripening agents other than bromide ion (e.g., thiocyanate, thioether or ammonia).

Endo and Okaji, "An Empirical Rule to Modify the Habit of Silver Chloride to form Tabular Grains in an Emulsion", *The Journal of Photographic Science*, Vol. 36, pp. 182–188, 1988, discloses silver chloride emulsions prepared in the presence of a thiocyanate ripening agent. Emulsion preparations by the procedures disclosed has produced emulsions containing a few tabular grains within a general grain population exhibiting mixed {111} and {100} faces.

Mumaw and Haugh, "Silver Halide Precipitation Coalescence Processes", *Journal of Imaging Science*, Vol. 30, No. 5, Sep./Oct. 1986, pp. 198–299, is essentially cumulative with Endo and Okaji, with section IV-B being particularly pertinent.

Symposium: Torino 1963, *Photographic Science*, Edited by C. Semerano and U. Mazzucato, Focal Press, pp. 52–55, discloses the ripening of a cubic grain silver chloride emulsion for several hours at 77° C. During ripening tabular grains emerged and the original cubic grains were depleted by Ostwald ripening. As demonstrated by the comparative Example below, after 3 hours of ripening tabular grains account for only a small fraction of the total grain projected area, and only a small fraction of the tabular grains were less than 0.3 μm in thickness. In further investigations going beyond the actual teachings provided extended ripening eliminated many of the smaller cubic grains, but also degraded many of the tabular grains to thicker forms.

Japanese published patent application (Kokai) 02/024,643, laid open Jan. 26, 1990, was cited in a Patent Cooperation Treaty search report as being pertinent to the tabular grain structures claimed, but is in Applicant's view unrelated. The claim is directed to a negative working emulsion containing a hydrazide derivative and tabular grains with with an equivalent circular diameter of 0.6 to 0.2 μm. Only conventional tabular grain preparations are disclosed and only silver bromide and bromoiodide emulsions are exemplified.

Yagi, Ito and Heki in published European patent application 466,417 Al disclose that reductions in roll film pressure desensitization can be realized when the silver halide emulsion employed contains at least 50 mole percent chloride. Although varied grain forms, including tabular grains are mentioned, it is stated that preferred grains are regular grains, which by definition excludes tabular grains. To obtain octahedral grains (that is, grains with {111} faces) it is suggested to form the grains in the presence of a spectral sensitizing dye or an inhibitor. Emulsion preparation techniques are cited only for silver chloroiodobromide emulsions and octahedral grain emulsions.

SUMMARY OF THE INVENTION

In one aspect the invention is directed to a photographic camera film comprised of at least one radiation sensitive silver halide emulsion layer unit and a film base in a roll satisfying the formula $$\frac{L - SD}{TU \times 2} - FBT = 10 \text{ to } 60\ \mu m$$

in which

FBT is the thickness of the film base in micrometers (μm);

L is the diameter in μm of the film roll;

SD is the spool diameter in μm of the film roll; and

TU is the number of film turns in the film roll;

wherein at least one emulsion layer unit is comprised of a radiation sensitive emulsion containing a silver halide grain population comprised of at least 50 mole percent chloride, based on silver, at least 50 percent of the grain population projected area being accounted for by tabular grains (1) bounded by {100} major faces having adjacent edge ratios of less than 10 and (2) each having an aspect ratio of at least 2.

In another aspect this invention is directed to film cartridge comprised of a film according to the invention in roll form and a housing surrounding the film for protecting the film from exposure and forming an opening for withdrawing the film from the cartridge receptacle.

In another apsect this invention is directed to a film cartridge comprised of a first receptacle portion containing in roll form a film according to the invention, a guide portion forming a planar extension of the first receptacle portion for receiving the film from the first receptacle portion and providing a focal plane for imagewise exposure of the film, and a second receptacle portion forming an extension of the guide portion for receiving and storing in roll form exposed portions of the film.

In yet another form this invention is directed to a camera comprised of a lens, a shutter, a film in roll form according the invention, means for holding the film in roll form prior to exposure, means for mounting a portion of the film for exposure through the lens, means for receiving portions of the film from the mounting means, and a housing for mounting the lens and shutter and for restricting light access to the film to that entering the camera through the lens.

The present invention elevates photographic camera roll films and the imaging combinations and systems in which they are employed to new levels performance not heretofore thought possible. For the first time the known more rapid processing capabilities of each of tabular grain shapes and high chloride grain compositions have been combined in a high chloride tabular grain population that is inherently morphologically stable—that is, shows no tendency to revert to nontabular grain shapes. In addition, the high chloride tabular grain emulsions exhibit surprisingly high speed-granularity relationships in relation to silver iodobromide emulsions, which have been the almost universal commercial choice for photographic camera roll film constructions. For color photographic applications the reduced native blue sensitivity of the high chloride tabular grain emulsions provides a distinct advantage over iodobromide emulsions for minus-blue (i.e., red or green) imaging. Specifically, it allows arrangements of blue, green and red recording emulsion layer units that permit superior image definitions to be realized in minus-blue recording layer units and particularly the green recording layer unit, the exposure record from which the human eye derives the majority of its image information. In both black-and-white and color applications the roll films of the invention and the imaging combinations and systems in which they are employed allow higher levels of image definition to be realized than can be achieved employing comparable tabular grain emulsions that are not high chloride emulsions. This allows the image resolution of the roll films of the invention to compensate for the imaging limitations of low-cost, mass produced cameras, such as single use cameras and cameras with molded plastic lenses. When the films of the invention are employed in combination with cameras of limited image resolution capabilities, the result is an imaging system with an improved performance beyond that which could be reasonably expected based on the construction of the camera alone.

Beyond the surprising capabilities noted above, the present invention offers further surprising advantages in terms of the stabilities of the high chloride tabular grain emulsions in the roll films and imaging combinations of the invention. Most notably, pressure desensitization has not been observed and pressure sensitization has been surprisingly reduced, as demonstrated in the Examples. Thus, the invention has overcome a significant deterrent to the use of tabular grain emulsions and high chloride emulsions for roll film applications. Further, unacceptable keeping instabilities reported in the art for high aspect ratio high chloride tabular grain emulsions have not been observed.

In short, the invention has significantly advanced the capabilities of the art in roll film imaging and has surprisingly avoided performance limitations and penalties heretofore taught in the art and suggested by the most nearly analogous conventional roll film imaging constructions.

The present invention has been facilitated by the discovery of a novel approach to forming tabular grains. Instead of introducing parallel twin planes in grains as they are being formed to induce tabularity and thereby produce tabular grains with {111} major faces, it has been discovered that the presence of iodide in the dispersing medium during a high chloride nucleation step coupled with maintaining the chloride ion in solution within a selected pCl range results in the formation of a tabular grain emulsion in which the tabular grains are bounded by {100} crystal faces.

The present invention places within the reach of the art tabular grains bounded by {100} crystal faces with grain compositions and grain thicknesses that have not been heretofore realized. The present invention provides the first ultrathin tabular grain emulsion in which the grains are bounded by {100} crystal faces. The invention in a preferred form provides intermediate and high aspect ratio tabular grain high chloride emulsions exhibiting high levels of grain stability. Unlike high chloride tabular grain emulsions in which the tabular grains have {111} major faces, the emulsions satisfying the requirements of the invention do not require a morphological stabilizer adsorbed to the major faces of the grains to maintain their tabular form. Finally, while clearly applicable to high chloride emulsions containing iodide, the present invention also extends to silver chloride and silver bromochloride emulsions, each of which can be prepared by variant precipitation procedures that do not require the presence iodide ion during grain nucleation.

DESCRIPTION OF PREFERRED EMBODIMENTS

Figure 1:
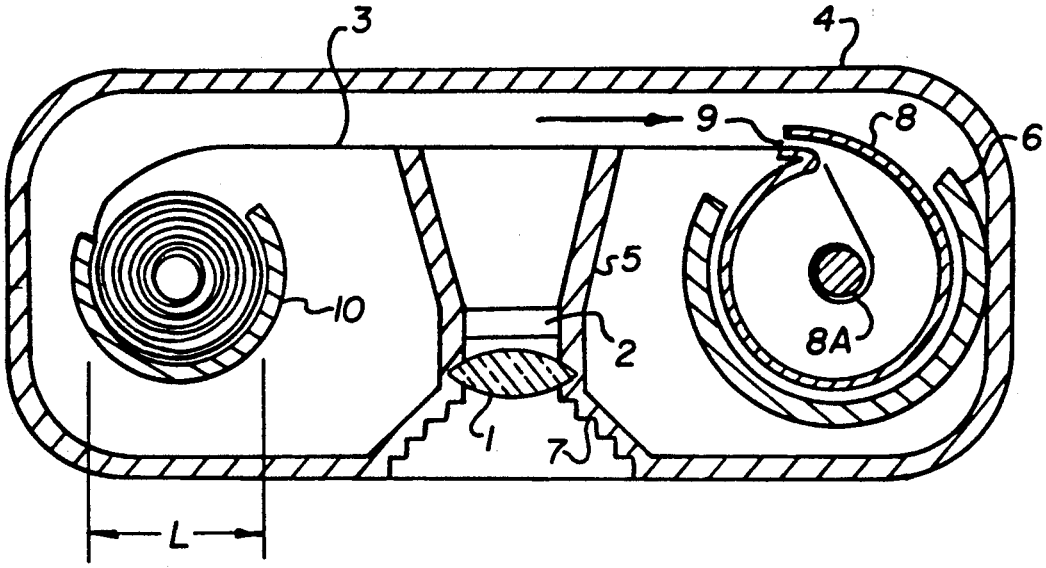
FIG. 1 is a partly sectional view of a single use camera containing a roll film.

In FIG. 1 a simple single use camera construction is shown. A lens 1 and shutter 2 (schematically shown) are mounted by a housing 4 internally forming an exposure plane locator 5 and externally, surrounding the lens, forming a lens protecting concavity 7. A cartridge holder 6 is located within the housing and contains a single spool cartridge 8 provided with a take up spindle 8A and an opening 9 for film transport. Separated from the cartridge holder by the exposure plane locator is roll film holder 10. Roll film 3 is located in the film holder and exhibits a roll diameter L. The roll film extends across the exposure plane locator and through the cartridge opening onto the take up spindle within the cartridge.

As purchased, the roll film 3 is mounted in the camera as shown in FIG. 1 when the camera is assembled at the factory. It is important to notice that the roll film is rolled on itself to provide a compact unit having a roll diameter L that fits in the film holder 10. Hence all of the roll film undergoes some degree of bending stress. The user simply aims the camera at the object to be photographed and opens the shutter 2. A portion of the film lying on the exposure plane locator 5 is exposed by light entering the housing 4 through the lens 1 when the shutter is opened. After closing the shutter, the user turns take up spindle 8A, which is attached to a knob, not shown, external of the housing, to bring another portion of the film into alignment for exposure. As shown film tension is relied upon to hold the film flat against the exposure plane locator. Another element, not shown, such as a spring loaded plate or flexible pad, is typically interposed between the film and the housing 4 adjacent the exposure plane locator to hold the film in the optimum focal plane for the lens.

It should be noted that when the film is wound onto the take up spindle 8A in the cartridge 8 it is again subjected to bending stress. When all of the film has been exposed and transported to the cartridge 8, the camera is turned in for photographic processing of the film. To gain access to the film the housing 4 must be destroyed, although the materials from which the housing are constructed are at least in part reclaimed for further use, thereby avoiding unnecessary waste. The cartridge 8 containing the film 3 is removed from the camera cartridge holder 6 for photographic processing of the film in a conventional manner.

Figure 2:
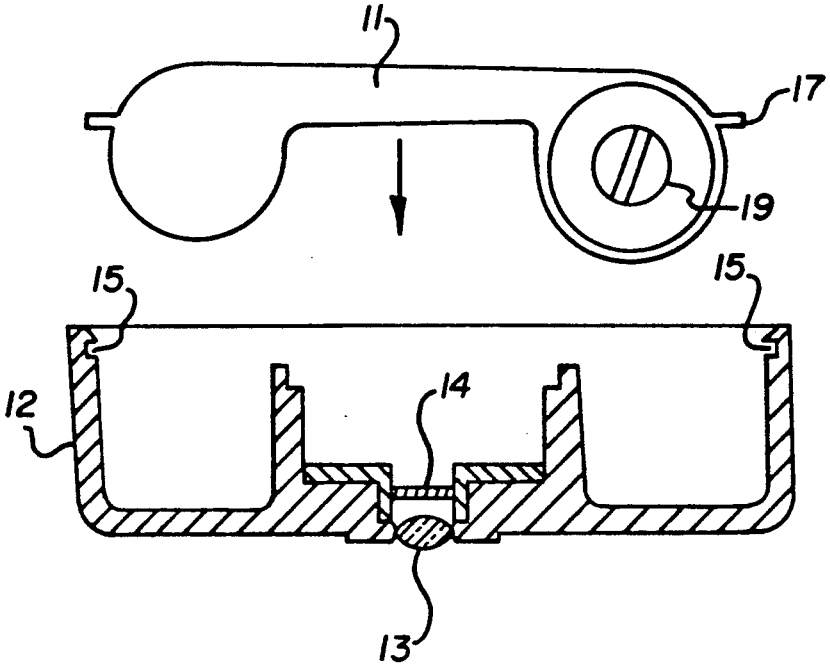
FIG. 2 depicts a double spool cartridge positioned to be mounted in a camera housing front, shown in section.
Figure 3:
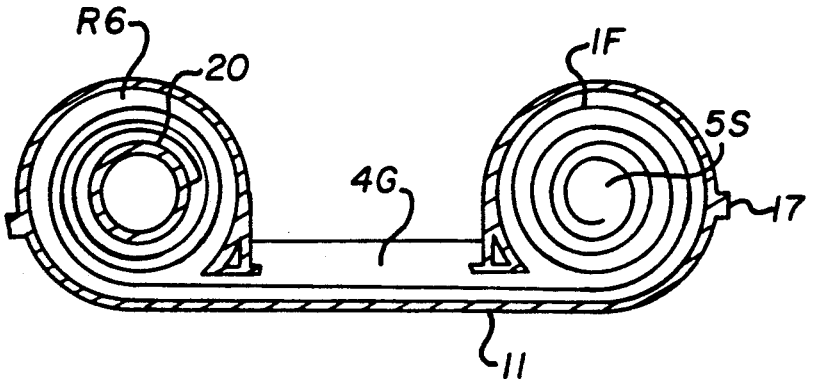
FIG. 3 is a sectional view of the double spool cartridge.
Figure 4:
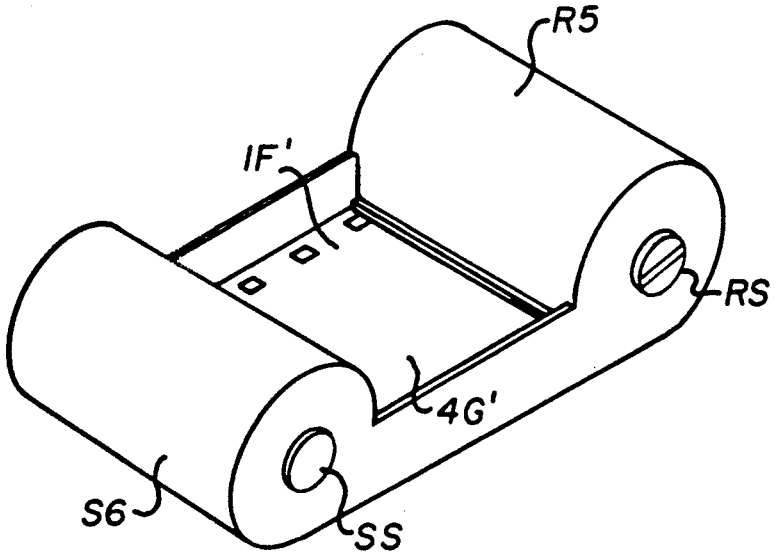
FIG. 4 is a perspective view of a third double spool cartridge.

In FIG. 2 a variant cartridge and camera construction is shown. Referring to FIGS. 2 and 3 a double spooled cartridge 11 contains roll film 1F that is initially stored in roll form in a portion of the cartridge forming storage receptacle 5S. A guide portion 4G of the cartridge extending from the portion of the cartridge forming the storage receptacle provides a planar surface for holding the film in the optimum focal plane for the lens of the camera in which it is mounted. A third portion of the cartridge forms a take up receptacle for the exposed film. The take up receptacle contains a take up spindle 20 that is attached to an external connector 19 capable of cooperating with a winding knob, not shown, on the camera that allows the film to be advanced after each frame exposure.

The cartridge 11 contains mounting ears 17 that allow it to be fastened in the camera housing front 12 shown in FIG. 2 by inserting the mounting ears in recesses 15. The camera housing front mounts lens 13 and shutter 14. The camera housing front additionally includes exposure plane locator 16. In the simplest form shown the cartridge performs the function of a back housing for the camera. In this form the camera is capable of being used with successively inserted cartridges. If desired, the camera can be provided with a housing back to provide additional protection against stray light exposure of the film.

The roll film cartridges and camera constructions in FIGS. 1 to 4 inclusive are, of course, only simple illustrations of numerous varied imaging unit constructions within the contemplation of the invention. The common feature of all constructions is the presence of a film rolled on itself or onto a spindle. The films most highly benefitted by the features of the invention are those in which the film is in a roll form that satisfies the formula:

$$\frac{L - SD}{TU \times 2} - FBT = 10 \text{ to } 60\ \mu m \qquad \text{(I)}$$

in which

FBT is the thickness of the film base in micrometers ($\mu$m);

L is the diameter in $\mu$m of the film roll;

SD is the spool diameter in $\mu$m of the film roll; and

TU is the number of film turns in the film roll.

The film roll preferably exhibits formula values in the range of from 20 to 50. If the formula values are excessively low, the advantages of the roll films of the invention as compared to conventional roll films remain in evidence, but objectionable photographic effects attributable to excessive bending will to some degree remain in evidence. On the other hand, with formula values above 60, film bending is sufficiently relaxed that there is a less compelling need for the stabilizing features of the invention, assuming film kinking and bending have been elsewhere adequately minimized in photographic manufacture and post exposure processing.

The significant factors of formula I are the diameter L of the film roll (noted in FIG. 1). Subtracted from the diameter of the film roll is the spool diameter SD of the rolled film. The spool diameter is generally the diameter of the spindle on which the film roll is wound or, when the film is wound without using a spindle, that is when the film is wound back on itself, SD is the inside diameter of the roll. As the number of turns TU in the film roll increases, assuming a fixed roll diameter L, the bending stress placed on the film is increased. Similarly, as film base thickness FBT is increased, assuming a fixed roll diameter and number of turns, bending stress placed on the film is increased.

While a wide range of parameters L, SD, FBT and TU can be accomodated within the 10 to 60 range of formula I by optimally selecting the remaining parameters, the important point to recognize is that the combinations of these parameters that are most commonly found in roll film usage can be accomodated. For example, the roll films of the invention satisfying the requirements of formula I can be accomodated in the same roll configurations (L and SD), number of turns (TU) and film base thicknesses (FBT) commonly found in commercially available 110 and 135 roll films.

The roll film support can take any convenient conventional form. Typical of useful polymeric film supports are films of cellulose nitrate and cellulose esters such as cellulose triacetate and diacetate, polystyrene, polyamides, homo- and copolymers of vinyl chloride, poly(vinyl acetal), polycarbonate, homo- and copolymers of olefins such as polyethylene and polypropylene and polyesters of dibasic aromatic carboxylic acids with dihydroxy alcohols such as poly(ethylene terephthalate). While a wide range of conventional roll film support thicknesses, typically from 50 to 200 μm, are useful in the roll films of the invention, the thickness of a support for obtaining optimum pressure stability in the roll films of the invention is also a function of the composition of the support.

One widely used and particularly preferred class of film supports employ cellulose esters, such as cellulose diacetate and cellulose triacetate. For cellulose ester film supports preferred thicknesses are in the range of from 100 to 200 μm, with thicknesses of from 125 to 175 μm generally being optimum.

Striking and unexpected advantages in pressure stability, demonstrated in the Examples below, have been observed when the film supports are selected from among polyesters of dibasic aromatic carboxylic acids with dihydroxy alcohols. A widely used support of this type is poly(ethylene terephthalate), also commonly referred to as PET. This film support offers the advantages of exceptional dimensional stability and strength. This allows PET to serve the same roll film applications as cellulose ester supports, but with reduced support thicknesses. It is specifically contemplated to employ polyester film supports of thicknesses (FBT) of less than 100 μm. When film support thicknesses of less than 100 μm are employed, it has been observe that pressure induced sensitization of the roll films of the invention can be entirely eliminated. There is, of course, the further advantage that by minimizing thickness of the film support the dimensions of the film roll can be significantly reduced and more compact camera dimensions can be realized, adding significantly to convenience.

In formula I only the thickness of the film base or support is considered, since the combined thicknesses of all the layers coated on the support seldom account for much more than about 10 percent of film base thickness, even in color films than employ multiple emulsion layers in each of separate blue, green and red recording layer units. In most instances all the layers coated on the film support account for less than 10 percent of film support thickness. In black-and-white films typically only one or two emulsion layers are present, and the total thickness of all layers is often less than 5 percent of film support thickness.

The selection of layers coated on a roll film support will vary, depending on the photographic application. To realize the advantages of the invention each roll film must include at least one emulsion layer containing a radiation sensitive emulsion comprised of a dispersing medium and a high chloride silver halide grain population. At least 50 percent of total grain projected area of the high chloride grain population is accounted for by tabular grains which (1) are bounded by {100} major faces having adjacent edge ratios of less than 10 and (2) each have an aspect ratio of at least 2.

Figure 5:
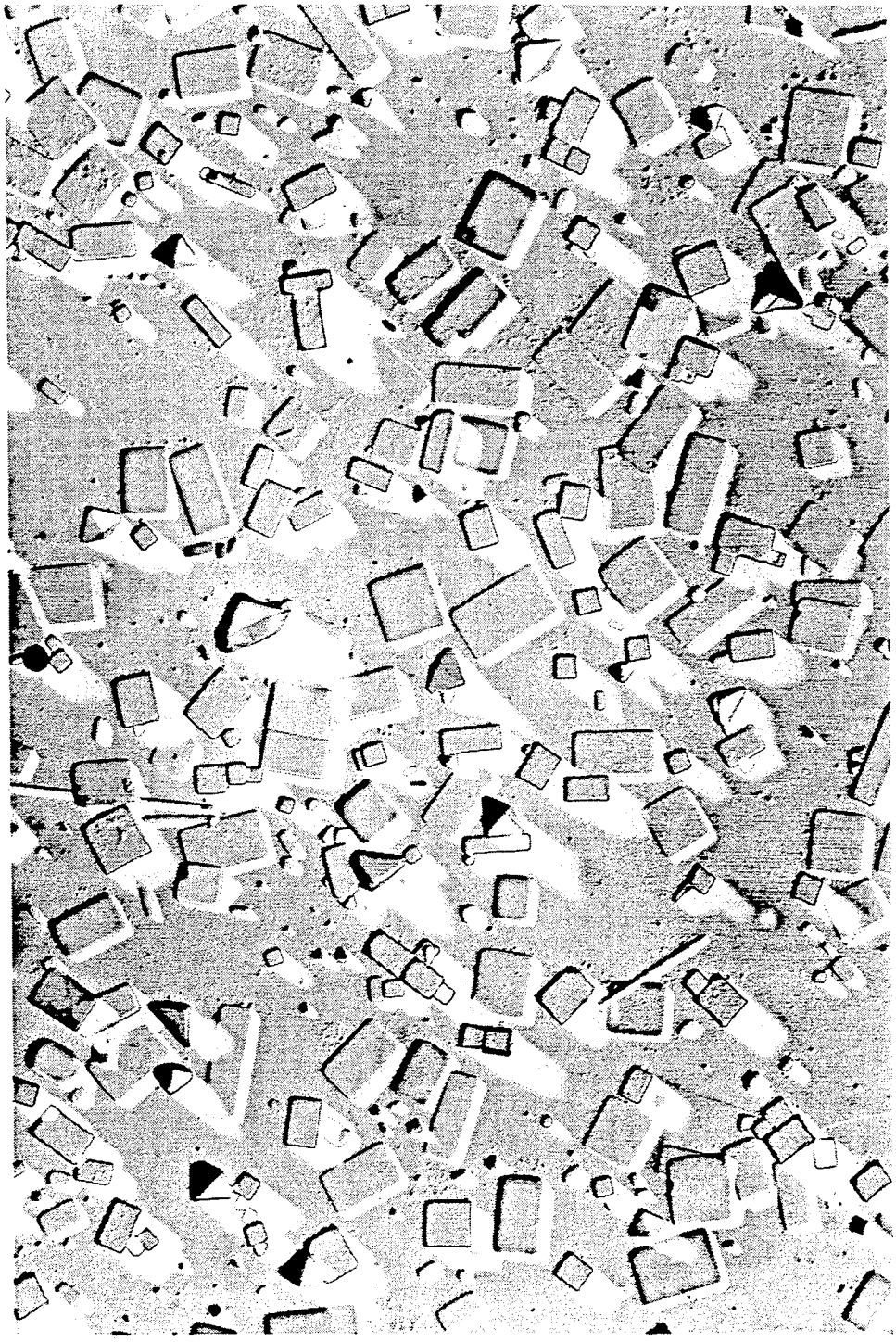
FIG. 5 is a shadowed photomicrograph of carbon grain replicas of an emulsion of the invention.

The identification of emulsions satisfying the requirements of the invention and the significance of the selection parameters can be better appreciated by considering a typical emulsion. FIG. 5 is a shadowed photomicrograph of carbon grain replicas of a representative emulsion of the invention, described in detail in Example 1 below. It is immediately apparent that most of the grains have orthogonal tetragonal (square or rectangular) faces. The orthogonal tetragonal shape of the grain faces indicates that they are {100} crystal faces.

The projected areas of the few grains in the sample that do not have square or rectangular faces are noted for inclusion in the calculation of the total grain projected area, but these grains clearly are not part of the tabular grain population having {100} major faces.

A few grains may be observed that are acicular or rod-like grains (hereinafter referred as rods). These grains are more than 10 times longer in one dimension than in any other dimension and can be excluded from the desired tabular grain population based on their high ratio of edge lengths. The projected area accounted for by the rods is low, but, when rods are present, their projected area is noted for determining total grain projected area.

The grains remaining all have square or rectangular major faces, indicative of {100} crystal faces. To identify the tabular grains it is necessary to determine for each grain its ratio of ECD to thickness (t)—i.e., ECD/t. ECD is determined by measuring the projected area (the product of edge lengths) of the upper surface of each grain. From the grain projected area the ECD of the grain is calculated. Grain thickness is commonly determined by oblique illumination of the grain population resulting in the individual grains casting shadows. From a knowledge of the angle of illumination (the shadow angle) it is possible to calculate the thickness of a grain from a measurement of its shadow length. The grains having square or rectangular faces and each having a ratio of ECD/t of at least 2 are tabular grains having {100} major faces. When the projected areas of the {100} tabular grains account for at least 50 percent of total grain projected area, the emulsion is a tabular grain emulsion.

In the emulsion of FIG. 5 tabular grains account for more than 50 percent of total grain projected area. From the definition of a tabular grain above, it is apparent that the average aspect ratio of the tabular grains can only approach 2 as a minimum limit. In fact, tabular grain emulsions satisfying the requirements of the invention typically exhibit average aspect ratios of 5 or more, with high average aspect ratios (>8) being preferred. That is, preferred emulsions according to the invention are high aspect ratio tabular grain emulsions. In specifically preferred emulsions according to the invention average aspect ratios of the tabular grain population are at least 12 and optimally at least 20. Typically the average aspect ratio of the tabular grain population ranges up to 50, but higher aspect ratios of 100, 200 or more can be realized. Emulsions within the contemplation of the invention in which the average aspect ratio approaches the minimum average aspect ratio limit of 2 still provide a surface to volume ratio that is 200 percent that of cubic grains.

The tabular grain population can exhibit any grain thickness that is compatible with the average aspect ratios noted above. However, particularly when the selected tabular grain population exhibits a high average aspect ratio, it is preferred to additionally limit the grains included in the selected tabular grain population to those that exhibit a thickness of less than 0.3 μm and, optimally, less than 0.2 μm. It is appreciated that the aspect ratio of a tabular grain can be limited either by limiting its equivalent circular diameter or increasing its thickness. Thus, when the average aspect ratio of the tabular grain population is in the range of from 2 to 8, the tabular grains accounting for at least 50 percent of total grain projected area can also each exhibit a grain thickness of less than 0.3 μm or less than 0.2 μm. Nevertheless, in the aspect ratio range of from 2 to 8 particularly, there are specific photographic applications that can benefit by greater tabular grain thicknesses. For example, in constructing a blue recording emulsion layer of maximum achievable speed it is specifically contemplated that tabular grain thicknesses that are on average 1 μm or or even larger can be tolerated. This is because the eye is least sensitive to the blue record and hence higher levels of image granularity (noise) can be tolerated without objection. There is an additional incentive for employing larger grains in the blue record in that it is sometimes difficult to match in the blue record the highest speeds attainable in the green and red record. A source of this difficulty resides in the blue photon deficiency of sunlight. While sunlight on an energy basis exhibits equal parts of blue, green and red light, at shorter wavelengths the photons have higher energy. Hence on a photon distribution basis daylight is slightly blue deficient. Artificial light sources, such as tungsten filament lamps, are blue deficient to an even greater extent. Further, obtaining high blue speeds is often adversely affected by lower extinction coefficients (i.e., light absorption efficiencies) of available blue spectral sensitizing dyes as compared to those of lower wavelength absorbing spectral sensitizing dyes.

The tabular grain population preferably exhibits major face edge length ratios of less than 5 and optimally less than 2. The nearer the major face edge length ratios approach 1 (i.e., equal edge lengths) the lower is the probability of a significant rod population being present in the emulsion. Further, it is believed that tabular grains with lower edge ratios are less susceptible to pressure desensitization.

In one specifically preferred form of the invention the tabular grain population accounting for at least 50 percent of total grain projected area is provided by tabular grains also exhibiting 0.2 μm. In other words, the emulsions are in this instance thin tabular grain emulsions.

Surprisingly, ultrathin tabular grain emulsions have been prepared satisfying the requirements of the invention. Ultrathin tabular grain emulsions are those in which the selected tabular grain population is made up of tabular grains having an average thickness of less than 0.06 μm. Prior to the present invention the only ultrathin tabular grain emulsions of a halide content exhibiting a cubic crystal lattice structure known in the art contained tabular grains bounded by {111} major faces. In other words, it was thought essential to form tabular grains by the mechanism of parallel twin plane incorporation to achieve ultrathin dimensions. Emulsions according to the invention can be prepared in which the tabular grain population has a mean thickness down to 0.02 μm and even 0.01 μm. Ultrathin tabular grains have extremely high surface to volume ratios. This permits ultrathin grains to be photographically processed at accelerated rates. Further, when spectrally sensitized, ultrathin tabular grains exhibit very high ratios of speed in the spectral region of sensitization as compared to the spectral region of native sensitivity. For example, ultrathin tabular grain emulsions according to the invention can have entirely negligible levels of blue sensitivity, and are therefore capable of providing a green or red record in a photographic product that exhibits minimal blue contamination even when located to receive blue light.

The characteristic of tabular grain emulsions that sets them apart from other emulsions is the ratio of grain ECD to thickness (t). This relationship has been expressed quantitatively in terms of aspect ratio. Another quantification that is believed to assess more accurately the importance of tabular grain thickness is tabularity:

$$T=ECD/t^2=AR/t$$

where

T is tabularity;

AR is aspect ratio;

ECD is equivalent circular diameter in micrometers (μm); and t is grain thickness in micrometers. The high chloride tabular grain population accounting for 50 percent of total grain projected area preferably exhibits a tabularity of greater than 25 and most preferably greater than 100. Since the tabular grain population can be ultrathin, it is apparent that extremely high tabularities, ranging to 1000 and above are within the contemplation of the invention.

The tabular grain population can exhibit an average ECD of any photographically useful magnitude. For photographic utility average ECD's of less than 10 μm are contemplated, although average ECD's in most photographic applications rarely exceed 6 μm. Within ultrathin tabular grain emulsions satisfying the requirements of the invention it is possible to provide intermediate aspect ratios with ECD's of the tabular grain population of 0.10 μm and less. As is generally understood by those skilled in the art, emulsions with selected tabular grain populations having higher ECD's are advantageous for achieving relatively high levels of photographic sensitivity while selected tabular grain populations with lower ECD's are advantageous in achieving low levels of granularity.

So long as the population of tabular grains satisfying the parameters noted above accounts for at least 50 percent of total grain projected area a photographically desirable grain population is available. It is recognized that the advantageous properties of the emulsions satisfying the requirements of the invention are increased as the proportion of tabular grains having {100} major faces is increased. The preferred emulsions according to the invention are those in which at least 70 percent and optimally at least 90 percent of total grain projected area is accounted for by tabular grains having {100} major faces. It is specifically contemplated to provide emulsions satisfying the grain descriptions above in which the selection of the rank ordered tabular grains extends to sufficient tabular grains to account for 70 percent or even 90 percent of total grain projected area.

So long as tabular grains having the desired characteristics described above account for the requisite proportion of the total grain projected area, the remainder of the total grain projected area can be accounted for by any combination of coprecipitated grains. It is, of course, common practice in the art to blend emulsions to achieve specific photographic objectives. Blended emulsions in which at least one component emulsion satisfies the tabular grain descriptions above are specifically contemplated.

If tabular grains failing to satisfy the tabular grain population requirements do not account for 50 percent of the total grain projected area, the emulsion does not satisfy the requirements of the invention and is, in general, a photographically inferior emulsion. For most applications (particularly applications that require spectral sensitization, require rapid processing and/or seek to minimize silver coverages) emulsions are photographically inferior in which many or all of the tabular grains are relatively thick—e.g., emulsions containing high proportions of tabular grains with thicknesses in excess of 0.3 μm.

Figure 6:
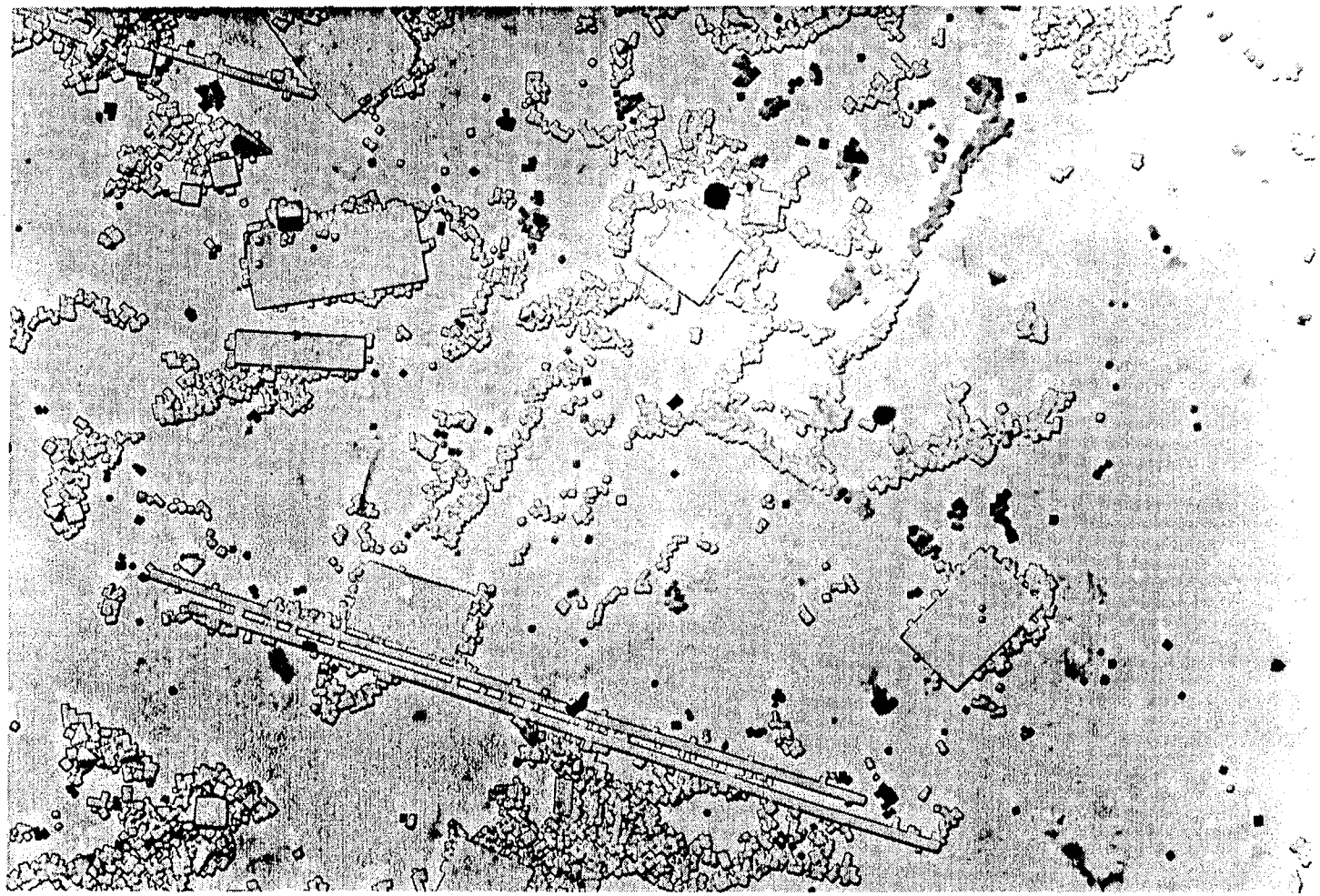
FIG. 6 is a shadowed photomicrograph of carbon grain replicas of a control emulsion.

More commonly, inferior emulsions failing to satisfy the requirements of the invention have an excessive proportion of total grain projected area accounted for by cubes, twinned nontabular grains, and rods. Such an emulsion is shown in FIG. 6. Most of the grain projected area is accounted for by cubic grains. Also the rod population is much more pronounced than in FIG. 5. A few tabular grains are present, but they account for only a minor portion of total grain projected area.

The tabular grain emulsion of FIG. 5 satisfying the requirements of the invention and the predominantly cubic grain emulsion of FIG. 6 were prepared under conditions that were identical, except for iodide management during nucleation. The FIG. 6 emulsion is a silver chloride emulsion while the emulsion of FIG. 5 additionally includes a small amount of iodide.

Obtaining emulsions satisfying the requirements of the invention has been achieved by the discovery of a novel precipitation process. In this process grain nucleation occurs in a high chloride environment in the presence of iodide ion under conditions that favor the emergence of {100} crystal faces. As grain formation occurs the inclusion of iodide into the cubic crystal lattice being formed by silver ions and the remaining halide ions is disruptive because of the much larger diameter of iodide ion as compared to chloride ion. The incorporated iodide ions introduce crystal irregularities that in the course of further grain growth result in tabular grains rather than regular (cubic) grains.

It is believed that at the outset of nucleation the incorporation of iodide ion into the crystal structure results in cubic grain nuclei being formed having one or more irregularities in one or more of the cubic crystal faces. The cubic crystal faces that contain at least one screw dislocation thereafter accept silver halide at an accelerated rate as compared to the regular cubic crystal faces (i.e., those lacking an irregularity). When only one of the cubic crystal faces contains an irregularity, grain growth on only one face is accelerated, and the resulting grain structure on continued growth is a rod. The same result occurs when only two opposite parallel faces of the cubic crystal structure contain the growth accelerating irregularities. However, when any two contiguous cubic crystal faces contain the irregularity, continued growth accelerates growth on both faces and produces a tabular grain structure. It is believed that the tabular grains of the emulsions of this invention are produced by those grain nuclei having two, three or four faces containing the growth accelerating irregularities.

At the outset of precipitation a reaction vessel is provided containing a dispersing medium and conventional silver and reference electrodes for monitoring halide ion concentrations within the dispersing medium. Halide ion is introduced into the dispersing medium that is at least 50 mole percent chloride—i.e., at least half by number of the halide ions in the dispersing medium are chloride ions. The pCl of the dispersing medium is adjusted to favor the formation of {100} grain faces on nucleation—that is, within the range of from 0.5 to 3.5, preferably within the range of from 1.0 to 3.0 and, optimally, within the range of from 1.5 to 2.5.

The grain nucleation step is initiated when a silver jet is opened to introduce silver ion into the dispersing medium. Iodide ion is preferably introduced into the dispersing medium concurrently with or, optimally, before opening the silver jet. Effective tabular grain formation can occur over a wide range of iodide ion concentrations ranging up to the saturation limit of iodide in silver chloride. The saturation limit of iodide in silver chloride is reported by H. Hirsch, "Photographic Emulsion Grains with Cores: Part I. Evidence for the Presence of Cores", J. of Photog. Science, Vol. 10 (1962), pp. 129–134, to be 13 mole percent. In silver halide grains in which equal molar proportions of chloride and bromide ion are present up to 27 mole percent iodide, based on silver, can be incorporated in the grains. It is preferred to undertake grain nucleation and growth below the iodide saturation limit to avoid the precipitation of a separate silver iodide phase and thereby avoid creating an additional category of unwanted grains. It is generally preferred to maintain the iodide ion concentration in the dispersing medium at the outset of nucleation at less than 10 mole percent. In fact, only minute amounts of iodide at nucleation are required to achieve the desired tabular grain population. Initial iodide ion concentrations of down to 0.001 mole percent are contemplated. However, for convenience in replication of results, it is preferred to maintain initial iodide concentrations of at least 0.01 mole percent and, optimally, at least 0.05 mole percent.

In the preferred form of the invention silver iodochloride grain nuclei are formed during the nucleation step. Minor amounts of bromide ion can be present in the dispersing medium during nucleation. Any amount of bromide ion can be present in the dispersing medium during nucleation that is compatible with at least 50 mole percent of the halide in the grain nuclei being chloride ions. The grain nuclei preferably contain at least 70 mole percent and optimally at least 90 mole percent chloride ion, based on silver.

Grain nuclei formation occurs instantaneously upon introducing silver ion into the dispersing medium. For manipulative convenience and reproducibility, silver ion introduction during the nucleation step is preferably extended for a convenient period, typically from 5 seconds to less than a minute. So long as the pCl remains within the ranges set forth above no additional chloride ion need be added to the dispersing medium during the nucleation step. It is, however, preferred to introduce both silver and halide salts concurrently during the nucleation step. The advantage of adding halide salts concurrently with silver salt throughout the nucleation step is that this permits assurance that any grain nuclei formed after the outset of silver ion addition are of essentially similar halide content as those grain nuclei initially formed. Iodide ion addition during the nucleation step is particularly preferred. Since the deposition rate of iodide ion far exceeds that of the other halides, iodide will be depleted from the dispersing medium unless replenished.

Any convenient conventional source of silver and halide ions can be employed during the nucleation step. Silver ion is preferably introduced as an aqueous silver salt solution, such as a silver nitrate solution. Halide ion is preferably introduced as alkali or alkaline earth halide, such as lithium, sodium and/or potassium chloride, bromide and/or iodide.

It is possible, but not preferred, to introduce silver chloride or silver iodochloride Lippmann grains into the dispersing medium during the nucleation step. In this instance grain nucleation has already occurred and what is referred to above as the nucleation step is in reality a step for introduction of grain facet irregularities. The disadvantage of delaying the introduction of grain facet irregularities is that this produces thicker tabular grains than would otherwise be obtained.

The dispersing medium contained in the reaction vessel prior to the nucleation step is comprised of water, the dissolved halide ions discussed above and a peptizer. The dispersing medium can exhibit a pH within any convenient conventional range for silver halide precipitation, typically from to 8. It is preferred, but not required, to maintain the pH of the dispersing medium on the acid side of neutrality (i.e., <7.0). To minimize fog a preferred pH range for precipitation is from 2.0 to 5.0. Mineral acids, such as nitric acid or hydrochloride acid, and bases, such as alkali hydroxides, can be used to adjust the pH of the dispersing medium. It is also possible to incorporate pH buffers.

The peptizer can take any convenient conventional form known to be useful in the precipitation of photographic silver halide emulsions and particularly tabular grain silver halide emulsions. A summary of conventional peptizers is provided in *Research Disclosure*, Vol. 308, December 1989, Item 308119, Section IX. *Research Disclosure* is published by Kenneth Mason Publications, Ltd., Emsworth, Hampshire P010 7DD, Englan. While synthetic polymeric peptizers of the type disclosed by Maskasky I, cited above and here incorporated by reference, can be employed, it is preferred to employ gelatino peptizers (e.g., gelatin and gelatin derivatives). As manufactured and employed in photography gelatino peptizers typically contain significant concentrations of calcium ion, although the use of deionized gelatino peptizers is a known practice. In the latter instance it is preferred to compensate for calcium ion removal by adding divalent or trivalent metal ions, such alkaline earth or earth metal ions, preferably magnesium, calcium, barium or aluminum ions. Specifically preferred peptizers are low methionine gelatino peptizers (i.e., those containing less than 30 micromoles of methionine per gram of peptizer), optimally less than 12 micromoles of methionine per gram of peptizer, these peptizers and their preparation are described by Maskasky II and King et al, cited above, the disclosures of which are here incorporated by reference. However, it should be noted that the grain growth modifiers of the type taught for inclusion in the emulsions of Maskasky I and II (e.g., adenine) are not appropriate for inclusion in the dispersing media of this invention, since these grain growth modifiers promote twinning and the formation of tabular grains having {111} major faces. Generally at least about 10 percent and typically from 20 to 80 percent of the dispersing medium forming the completed emulsion is present in the reaction vessel at the outset of the nucleation step. It is conventional practice to maintain relatively low levels of peptizer, typically from 10 to 20 percent of the peptizer present in the completed emulsion, in the reaction vessel at the start of precipitation. To increase the proportion of thin tabular grains having {100} faces formed during nucleation it is preferred that the concentration of the peptizer in the dispersing medium be in the range of from 0.5 to 6 percent by weight of the total weight of the dispersing medium at the outset of the nucleation step. It is conventional practice to add gelatin, gelatin derivatives and other vehicles and vehicle extenders to prepare emulsions for coating after precipitation. Any naturally occurring level of methionine can be present in gelatin and gelatin derivatives added after precipitation is complete.

The nucleation step can be performed at any convenient conventional temperature for the precipitation of silver halide emulsions. Temperatures ranging from near ambient—e.g., 30° C. up to about 90° C. are contemplated, with nucleation temperatures in the range of from 35° to 70° C. being preferred.

Since grain nuclei formation occurs almost instantaneously, only a very small proportion of the total silver need be introduced into the reaction vessel during the nucleation step. Typically from about 0.1 to 10 mole percent of total silver is introduced during the nucleation step.

A grain growth step follows the nucleation step in which the grain nuclei are grown until tabular grains having {100} major faces of a desired average ECD are obtained. Whereas the objective of the nucleation step is to form a grain population having the desired incorporated crystal structure irregularities, the objective of the growth step is to deposit additional silver halide onto (grow) the existing grain population while avoiding or minimizing the formation of additional grains. If additional grains are formed during the growth step, the polydispersity of the emulsion is increased and, unless conditions in the reaction vessel are maintained as described above for the nucleation step, the additional grain population formed in the growth step will not have the desired tabular grain properties described above.

In its simplest form the process of preparing emulsions according to the invention can be performed as a single jet precipitation without interrupting silver ion introduction from start to finish. As is generally recognized by those skilled in the art a spontaneous transition from grain formation to grain growth occurs even with an invariant rate of silver ion introduction, since the increasing size of the grain nuclei increases the rate at which they can accept silver and halide ion from the dispersing medium until a point is reached at which they are accepting silver and halide ions at a sufficiently rapid rate that no new grains can form. Although manipulatively simple, single jet precipitation limits halide content and profiles and generally results in more polydisperse grain populations.

It is usually preferred to prepare photographic emulsions with the most geometrically uniform grain populations attainable, since this allows a higher percentage of the total grain population to be optimally sensitized and otherwise optimally prepared for photographic use. Further, it is usually more convenient to blend relatively monodisperse emulsions to obtain aim sensitometric profiles than to precipitate a single polydisperse emulsion that conforms to an aim profile.

In the preparation of emulsions according to the invention it is preferred to interrupt silver and halide salt introductions at the conclusion of the nucleation step and before proceeding to the growth step that brings the emulsions to their desired final size and shape. The emulsions are held within the temperature ranges described above for nucleation for a period sufficient to allow reduction in grain dispersity. A holding period can range from a minute to several hours, with typical holding periods ranging from 5 minutes to an hour. During the holding period relatively smaller grain nuclei are Ostwald ripened onto surviving, relatively larger grain nuclei, and the overall result is a reduction in grain dispersity.

If desired, the rate of ripening can be increased by the presence of a ripening agent in the emulsion during the holding period. A conventional simple approach to accelerating ripening is to increase the halide ion concentration in the dispersing medium. This creates complexes of silver ions with plural halide ions that accelerate ripening. When this approach is employed, it is preferred to increase the chloride ion concentration in the dispersing medium. That is, it is preferred to lower the pCl of the dispersing medium into a range in which increased silver chloride solubility is observed. Alternatively, ripening can be accelerated and the percentage of total grain projected area accounted for by {100} tabular grains can be increased by employing conventional ripening agents. Preferred ripening agents are sulfur containing ripening agents, such as thioethers and thiocyanates. Typical thiocyanate ripening agents are disclosed by Nietz et al U.S. Pat. No. 2,222,264, Lowe et al U.S. Pat. No. 2,448,534 and Illingsworth U.S. Pat. No. 3,320,069, the disclosures of which are here incorporated by reference. Typical thioether ripening agents are disclosed by McBride U.S. Pat. No. 3,271,157, Jones U.S. Pat. No. 3,574,628 and Rosencrantz et al U.S. Pat. No. 3,737,313, the disclosures of which are here incorporated by reference. More recently crown thioethers have been suggested for use as ripening agents. Ripening agents containing a primary or secondary amino moiety, such as imidazole, glycine or a substituted derivative, are also effective. Sodium sulfite has also been demonstrated to be effective in increasing the percentage of total grain projected accounted by the {100} tabular grains.

Once the desired population of grain nuclei have been formed, grain growth to obtain the emulsions satisfying the requirements of the invention can proceed according to any convenient conventional precipitation technique for the precipitation of silver halide grains bounded by {100} grain faces. Whereas iodide and chloride ions are required to be incorporated into the grains during nucleation and are therefore present in the completed grains at the internal nucleation site, any halide or combination of halides known to form a cubic crystal lattice structure can be employed during the growth step. Neither iodide nor chloride ions need be incorporated in the grains during the growth step, since the irregular grain nuclei faces that result in tabular grain growth, once introduced, persist during subsequent grain growth independently of the halide being precipitated, provided the halide or halide combination is one that forms a cubic crystal lattice. This excludes only iodide levels above 13 mole percent (preferably 6 mole percent) in precipitating silver iodochloride, levels of iodide above 40 mole percent (preferably 30 mole percent) in precipitating silver iodobromide, and proportionally intermediate levels of iodide in precipitating silver iodohalides containing bromide and chloride. When silver bromide or silver iodobromide is being deposited during the growth step, it is preferred to maintain a pBr within the dispersing medium in the range of from 1.0 to 4.2, preferably 1.6 to 3.4. When silver chloride, silver iodochloride, silver bromochloride or silver iodobromochloride is being deposited during the growth step, it is preferred to maintain the pCl within the dispersing medium within the ranges noted above in describing the nucleation step.

It has been discovered quite unexpectedly that up to 20 percent reductions in tabular grain thicknesses can be realized by specific halide introductions during grain growth. Surprisingly, it has been observed that bromide additions during the growth step in the range of from 0.05 to 15 mole percent, preferably from 1 to 10 mole percent , based on silver, produce relatively thinner {100} tabular grains than can be realized under the same conditions of precipitation in the absence of bromide ion. Similarly, it has been observed that iodide additions during the growth step in the range of from 0.001 to $<1$ mole percent, based on silver, produce relatively thinner {100} tabular grains than can be realized under the same conditions of precipitation in the absence of iodide ion.

During the growth step both silver and halide salts are preferably introduced into the dispersing medium. In other words, double jet precipitation is contemplated, with added iodide salt, if any, being introduced with the remaining halide salt or through an independent jet. The rate at which silver and halide salts are introduced is controlled to avoid renucleation—that is, the formation of a new grain population. Addition rate control to avoid renucleation is generally well known in the art, as illustrated by Wilgus German OLS No. 2,107,118, Irie U.S. Pat. No. 3,650,757, Kurz U.S. Pat. No. 3,672,900, Saito U.S. Pat. No. 4,242,445, Teitschied et al European Patent Application 80102242, and Wey "Growth Mechanism of AgBr Crystals in Gelatin Solution", *Photographic Science and Engineering*, Vol. 21, No. 1, Jan./Feb. 1977, p. 14, et seg.

In the simplest form of the invention the nucleation and growth stages of grain precipitation occur in the same reaction vessel. It is, however, recognized that grain precipitation can be interrupted, particularly after completion of the nucleation stage. Further, two separate reaction vessels can be substituted for the single reaction vessel described above. The nucleation stage of grain preparation can be performed in an upstream reaction vessel (herein also termed a nucleation reaction vessel) and the dispersed grain nuclei can be transferred to a downstream reaction vessel in which the growth stage of grain precipitation occurs (herein also termed a growth reaction vessel). In one arrangement of this type an enclosed nucleation vessel can be employed to receive and mix reactants upstream of the growth reaction vessel, as illustrated by Posse et al U.S. Pat. No. 3,790,386, Forster et al U.S. Pat. No. 3,897,935, Finnicum et al U.S. Pat. No. 4,147,551, and Verhille et al U.S. Pat. No. 4,171,224, here incorporated by reference. In these arrangements the contents of the growth reaction vessel are recirculated to the nucleation reaction vessel.

It is herein contemplated that various parameters important to the control of grain formation and growth, such as pH, pAg, ripening, temperature, and residence time, can be independently controlled in the separate nucleation and growth reaction vessels. To allow grain nucleation to be entirely independent of grain growth occurring in the growth reaction vessel down stream of the nucleation reaction vessel, no portion of the contents of the growth reaction vessel should be recirculated to the nucleation reaction vessel. Preferred arrangements that separate grain nucleation from the contents of the growth reaction vessel are disclosed by Mignot U.S. Pat. No. 4,334,012 (which also discloses the useful feature of ultrafiltration during grain growth), Urabe U.S. Pat. No. 4,879,208 and published European Patent Applications 326,852, 326,853, 355,535 and 370,116, Ichizo published European Patent Application 0 368 275, Urabe et al published European Patent Application 0 374 954, and Onishi et al published Japanese Patent Application (Kokai) 172,817-A (1990)

Although the process of grain nucleation has been described above in terms of utilizing iodide to produce the crystal irregularities required for tabular grain formation, alternative nucleation procedures have been devised, demonstrated in the Examples below, that eliminate ny requirement of iodide ion being present during nucleation in order to produce tabular grains. These alternative procedures are, further, compatible with the use of iodide during nucleation. Thus, these procedures can be relied upon entirely during nucleation for tabular grain formation or can be relied upon in combination with iodide ion during nucleation to product tabular grains.

It has been observed that rapid grain nucleations, including so-called dump nucleations, in which significant levels of dispersing medium supersaturation with halide and silver ions exist at nucleation accelerate introduction of the grain irregularities responsible for tabularity. Since nucleation can be achieved essentially instantaneously, immediate departures from initial supersaturation to the preferred pCl ranges noted above are entirely consistent with this approach.

It has also been observed that maintaining the level of peptizer in the dispersing medium during grain nucleation at a level of less than 1 percent by weight enhances of tabular grain formation. It is believed that coalescence of grain nuclei pairs can be at least in part responsible for introducing the crystal irregularities that induce tabular grain formation. Limited coalescence can be promoted by withholding peptizer from the dispersing medium or by initially limiting the concentration of peptizer. Mignot U.S. Pat. No. 4,334,012 illustrates grain nucleation in the absence of a peptizer with removal of soluble salt reaction products to avoid coalescence of nuclei. Since limited coalescence of grain nuclei is considered desirable, the active interventions of Mignot to eliminate grain nuclei coalescence can be either eliminated or moderated. It is also contemplated to enhance limited grain coalescence by employing one or more peptizers that exhibit reduced adhesion to grain surfaces. For example, it is generally recognized that low methionine gelatin of the type disclosed by Maskasky II is less tightly absorbed to grain surfaces than gelatin containing higher levels of methionine. Further moderated levels of grain adsorption can be achieved with so-called "synthetic peptizers"—that is, peptizers formed from synthetic polymers. The maximum quantity of peptizer compatible with limited coalescence of grain nuclei is, of course, related to the strength of adsorption to the grain surfaces. Once grain nucleation has been completed, immediately after silver salt introduction, peptizer levels can be increased to any convenient conventional level for the remainder of the precipitation process.

The emulsions satisfying the requirements of the invention include silver chloride, silver iodochloride emulsions, silver iodobromochloride emulsions and silver iodochlorobromide emulsions. Dopants, in concentrations of up to $10^{-2}$ mole per silver mole and typically less than $10^{-4}$ mole per silver mole, can be present in the grains. Compounds of metals such as copper, thallium, lead, mercury, bismuth, zinc, cadmium , rhenium, and Group VIII metals (e.g., iron, ruthenium, rhodium, palladium, osmium, iridium, and platinum) can be present during grain precipitation, preferably during the growth stage of precipitation. The modification of photographic properties is related to the level and location of the dopant within the grains. When the metal forms a part of a coordination complex, such as a hexacoordination complex or a tetracoordination complex, the ligands can also be included within the grains and the ligands can further influence photographic properties. Coordination ligands, such as halo, aquo, cyano cyanate, thiocyanate, nitrosyl, thionitrosyl, oxo and carbonyl ligands are contemplated and can be relied upon to modify photographic properties.

Dopants and their addition are illustrated by Arnold et al U.S. Pat. No. 1,195,432; Hochstetter U.S. Pat. No. 1,951,933; Trivelli et al U.S. Pat. No. 2,448,060; Overman U.S. Pat. No. 2,628,167; Mueller et al U.S. Pat. No. 2,950,972; McBride U.S. Pat. No. 3,287,136; Sidebotham U.S. Pat. No. 3,488,709; Rosecrants et al U.S. Pat. No. 3,737,313; Spence et al U.S. Pat. No. 3,687,676; Gilman et al U.S. Pat. No. 3,761,267; Shiba et al U.S. Pat. No. 3,790,390; Ohkubo et al U.S. Pat. No. 3,890,154; Iwaosa et al U.S. Pat. No. 3,901,711; Habu et al U.S. Pat. No. 4,173,483; Atwell U.S. Pat. No. 4,269,927; Janusonis et al U.S. Pat. No. 4,835,093; McDugle et al U.S. Pat. Nos. 4,933,272, 4,981,781, and 5,037,732; Keevert et al U.S. Pat. No. 4,945,035; and Evans et al U.S. Pat. No. 5,024,931, the disclosures of which are here incorporated by reference. For background as to alternatives known to the art attention is directed to B. H. Carroll, "Iridium Sensitization: A Literature Review", *Photographic Science and Engineering*, Vol. 24, NO. 6, Nov./Dec. 1980, pp. 265–257, and Grzeskowiak et al published European Patent Application 0 264 288.

The invention is particularly advantageous in providing high chloride (greater than 50 mole percent chloride) tabular grain emulsions, since conventional high chloride tabular grain emulsions having tabular grains bounded by {111} are inherently unstable and require the presence of a morphological stabilizer to prevent the grains from regressing to nontabular forms. Particularly preferred high chloride emulsions are according to the invention that are those that contain more than 70 mole percent (optimally more than 90 mole percent) chloride.

Although not essential to the practice of the invention, a further procedure that can be employed to maximize the population of tabular grains having {100} major faces is to incorporate an agent capable of restraining the emergence of non-{100} grain crystal faces in the emulsion during its preparation. The restraining agent, when employed, can be active during grain nucleation, during grain growth or throughout precipitation.

Useful restraining agents under the contemplated conditions of precipitation are organic compounds containing a nitrogen atom with a resonance stabilized $\pi$ electron pair. Resonance stabilization prevents protonation of the nitrogen atom under the relatively acid conditions of precipitation.

Aromatic resonance can be relied upon for stabilization of the $\pi$ electron pair of the nitrogen atom. The nitrogen atom can either be incorporated in an aromatic ring, such as an azole or azine ring, or the nitrogen atom can be a ring substituent of an aromatic ring.

In one preferred form the restraining agent can satisfy the following formula:

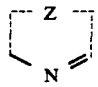

where

Z represents the atoms necessary to complete a five or six membered aromatic ring structure, preferably formed by carbon and nitrogen ring atoms. Preferred aromatic rings are those that contain one, two or three nitrogen atoms. Specifically contemplated ring structures include 2H-pyrrole, pyrrole, imidazole, pyrazole, 1,2,3-triazole, 1,2,4-triazole, 1,3,5-triazole, pyridine, pyrazine, pyrimidine, and pyridazine.

When the stabilized nitrogen atom is a ring substituent, preferred compounds satisfy the following formula:

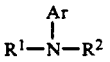

(II)

where

Ar is an aromatic ring structure containing from 5 to 14 carbon atoms and $R^1$ and $R^2$ are independently hydrogen, Ar, or any convenient aliphatic group or together complete a five or six membered ring. Ar is preferably a carbocyclic aromatic ring, such as phenyl or naphthyl. Alternatively any of the nitrogen and carbon containing aromatic rings noted above can be attached to the nitrogen atom of formula II through a ring carbon atom. In this instance, the resulting compound satisfies both formulae I and II. Any of a wide variety of aliphatic groups can be selected. The simplest contemplated aliphatic groups are alkyl groups, preferably those containing from 1 to 10 carbon atoms and most preferably from 1 to 6 carbon atoms. Any functional substituent of the alkyl group known to be compatible with silver halide precipitation can be present. It is also contemplated to employ cyclic aliphatic substituents exhibiting 5 or 6 membered rings, such as cycloalkane, cycloalkene and aliphatic heterocyclic rings, such as those containing oxygen and/or nitrogen hetero atoms. Cyclopentyl, cyclohexyl, pyrrolidinyl, piperidinyl, furanyl and similar heterocyclic rings are specifically contemplated.

The following are representative of compounds contemplated satisfying formulae I and/or II:

R-1

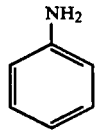

aniline

RA-2

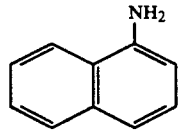

α-naphthylamine

-continued

RA-3

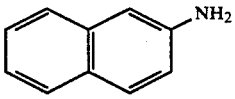

β-naphthylamine

RA-4

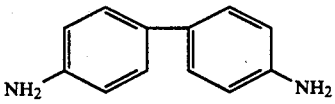

benzidine

RA-5

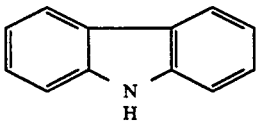

carbazole

RA-6

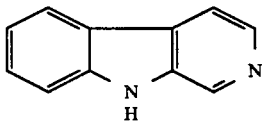

norharman

RA-7

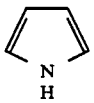

pyrrole

RA-8

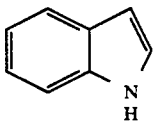

indole

RA-9

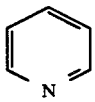

pyridine

RA-10

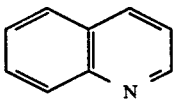

quinoline

RA-11

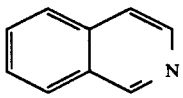

isoquinoline

-continued
RA-12
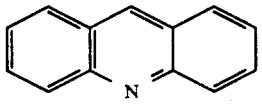
acridine
RA-13
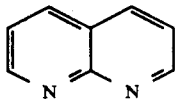
1,8-naphthyridine
RA-14
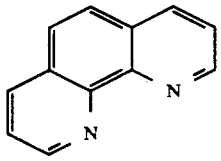
1,10-phenanthroline
RA-15
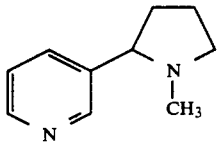
nicotine
RA-16
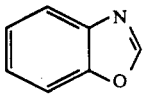
benzoxazole
RA-17
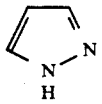
pyrazole
RA-18
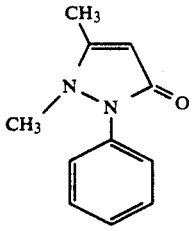
antipyrine
RA-19
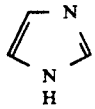
imidazole
-continued
RA-20
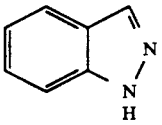
indazole
RA-21
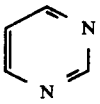
pyrimidine
RA-22
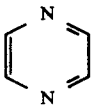
pyrazine
RA-23
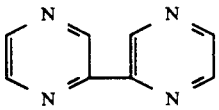
2,2'-bipyrazine
RA-24
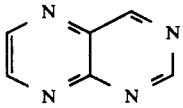
pteridine
RA-25
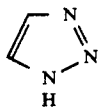
1,2,3-triazole
RA-26
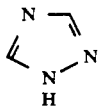
1,2,4-triazole
RA-27
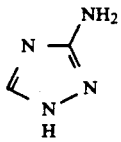
3-amino-1,2,4-triazole
RA-28
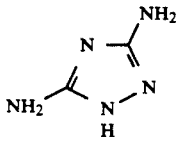
3,5-diamino-1,2,4-triazole -continued

RA-29

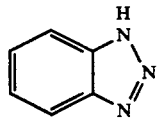

benzotriazole

RA-30

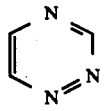

1,2,4-triazine

RA-31

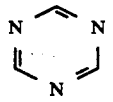

1,3,5-triazine

Selection of preferred restraining agents and their useful concentrations can be accomplished by the following selection procedure: The compound being considered for use as a restraining agent is added to a silver chloride emulsion consisting essentially of cubic grains with a mean grain edge length of 0.3 μm. The emulsion is 0.2M in sodium acetate, has a pCl of 2.1, and has a pH that is at least one unit greater than the pKa of the compound being considered. The emulsion is held at 75° C. with the restraining agent present for 24 hours. If, upon microscopic examination after 24 hours, the cubic grains have sharper edges of the {100} crystal faces than a control differing only in lacking the compound being considered, the compound introduced is performing the function of a restraining agent. The significance of sharper edges of intersection of the {100} crystal faces lies in the fact that grain edges are the most active sites on the grains in terms of ions reentering the dispersing medium. By maintaining sharp edges the restraining agent is acting to restrain the emergence of non-{100} crystal faces, such as are present, for example, at rounded edges and corners. In some instances instead of dissolved silver chloride depositing exclusively onto the edges of the cubic grains a new population of grains bounded by {100}crystal faces is formed. Optimum restraining agent activity occurs when the new grain population is a tabular grain population in which the tabular grains are bounded by {100} major crystal faces.

It is specifically contemplated to deposit epitaxially silver salt onto the tabular grains acting as hosts. Conventional epitaxial depositions onto high chloride silver halide grains are illustrated by Maskasky U.S. Pat. No. 4,435,501 (particularly Example 24B); Ogawa et al U.S. Pat. Nos. 4,786,588 and 4,791,053; Hasebe et al U.S. Pat. Nos. 4,820,624 and 4,865,962; Sugimoto and Miyake, "Mechanism of Halide Conversion Process of Colloidal AgCl Microcrystals by Br- Ions", Parts I and II, *Journal of Colloid and Interface Science*, Vol. 140, No. 2, Dec. 1990, pp. 335–361; Houle et al U.S. Pat. No. 5,035,992; and Japanese published applications (Kokai) 252649-A (priority 02.03.90-JP 051165 Japan) and 288143-A (priority 04.04.90-JP 089380 Japan). The disclosures of the above U.S. patents are here incorporated by reference.

Emulsion Preparations

Throughout the emulsion preparations the acronym APMT is employed to designate 1-(3-acetamidophenyl)-5-mercaptotetrazole. The term "low methionine gelatin" is employed, except as otherwise indicated, to designate gelatin that has been treated with an oxidizing agent to reduce its methionine content to less than 30 micromoles per gram. The acronym DW is employed to indicate distilled water. The acronym mppm is employed to indicate molar parts per million.

Emul. Prep. 1

This emulsion preparation demonstrates the preparation of an ultrathin tabular grain silver iodochloride emulsion satisfying the requirements of this invention.

A 2030 mL solution containing 1.75% by weight low methionine gelatin, 0.011M sodium chloride and $1.48\times10^{-4}$M potassium iodide was provided in a stirred reaction vessel. The contents of the reaction vessel were maintained at 40° C. and the pCl was 1.95.

While this solution was vigorously stirred, 30 mL of 1.0M silver nitrate solution and 30 mL of a 0.99M sodium chloride and 0.01M potassium iodide solution were added simultaneously at a rate of 30 mL/min each. This achieved grain nucleation to form crystals with an initial iodide concentration of 2 mole percent, based on total silver.

The mixture was then held 10 minutes with the temperature remaining at 40° C. Following the hold, a 1.0M silver nitrate solution and a 1.0M NaCl solution were then added simultaneously at 2 mL/min for 40 minutes with the pCl being maintained at 1.95.

The resulting emulsion was a tabular grain silver iodochloride emulsion containing 0.5 mole percent iodide, based on silver. Fifty percent of total grain projected area was provided by tabular grains having {100} major faces having an average ECD of 0.84 mm and an average thickness of 0.037 μm, selected on the basis of an aspect ratio rank ordering of all {100} tabular grains having a thickness of less than 0.3 μm and a major face edge length ratio of less than 10. The selected tabular grain population had an average aspect ratio (ECD/t) of 23 and an average tabularity ($ECD/t^2$) of 657. The ratio of major face edge lengths of the selected tabular grains was 1.4. Seventy two percent of total grain projected area was made up of tabular grains having {100} major faces and aspect ratios of at least 7.5. These tabular grains had a mean ECD of 0.75 μm, a mean thickness of 0.045 μm, a mean aspect ratio of 18.6 and a mean tabularity of 488.

A representative sample of the grains of the emulsion is shown in FIG. 5.

Emul. prep. 2 (Comparative)

This emulsion demonstrates the importance of iodide in the precipitation of the initial grain population (nucleation).

This emulsion was precipitated identically to that of Emulsion preparation 1, except no iodide was intentionally added.

The resulting emulsion consisted primarily of cubes and very low aspect ratio rectangular grains ranging in size from about 0.1 to 0.5 μm in edge length. A small number of large rods and high aspect ratio {100} tabular grains were present, but did not constitute a useful quantity of the grain population.

A representative sample of the grains of this emulsion is shown in FIG. 6.

Emul. prep. 3

This emulsion preparation demonstrates an emulsion according to the invention in which 90% of the total grain projected area is comprised of tabular grains with {100} major faces and aspect ratios of greater than 7.5.

A 2030 mL solution containing 3.52% by weight low methionine gelatin, 0.0056M sodium chloride and $1.48\times10^{-4}$M potassium iodide was provided in a stirred reaction vessel. The contents of the reaction vessel were maintained at 40° C. and the pCl was 2.25.

While this solution was vigorously stirred, 30 mL of 2.0M silver nitrate solution and 30 mL of a 1.99M sodium chloride and 0.01M potassium iodide solution were added simultaneously at a rate of 60 mL/min each. This achieved grain nucleation to form crystals with an initial iodide concentration of 1 mole percent, based on total silver.

The mixture was then held 10 minutes with the temperature remaining at 40° C. Following the hold, a 0.5M silver nitrate solution and a 0.5M NaCl solution were then added simultaneously at 8 mL/min for 40 minutes with the pCl being maintained at 2.25. The 0.5M $AgNO_3$ solution and the 0.5M NaCl solution were then added simultaneously with a ramped linearly increasing flow from 8 mL per minute to 16 mL per minute over 130 minutes with the pCl maintained at 2.25.

The resulting emulsion was a tabular grain silver iodochloride emulsion containing 0.06 mole percent iodide, based on silver. Fifty percent of total grain projected area was provided by tabular grains having {100} major faces having an average ECD of 1.86 μm and an average thickness of 0.082 μm, selected on the basis of an aspect ratio rank ordering of all {100} tabular grains having a thickness of less than 0.3 μm and a major face edge length ratio of less than 10. The selected tabular grain population had an average aspect ratio (ECD/t) of 24 and an average tabularity ($ECD/t^2$) of 314. The ratio of major face edge lengths of the selected tabular grains was 1.2. Ninety three percent of total grain projected area was made up of tabular grains having {100} major faces and aspect ratios of at least 7.5. These tabular grains had a mean ECD of 1.47 μm, a mean thickness of 0.086 μm, a mean aspect ratio of 17.5 and a mean tabularity of 222.

Emul. prep. 4

This emulsion preparation demonstrates an emulsion prepared similarly as the emulsion of Emulsion preparation 3, but an initial 0.08 mole percent iodide and a final 0.04% iodide.

A 2030 mL solution containing 3.52% by weight low methionine gelatin, 0.0056M sodium chloride and $3.00\times10^{-5}$M potassium iodide was provided in a stirred reaction vessel. The contents of the reaction vessel were maintained at 40° C and the pCl was 2.25.

While this solution was vigorously stirred, 30 mL of 5.0M silver nitrate solution and 30 mL of a 4.998M sodium chloride and 0.002M potassium iodide solution were added simultaneously at a rate of 60 mL/min each. This achieved grain nucleation to form crystals with an initial iodide concentration of 0.08 mole percent, based on total silver.

The mixture was then held 10 minutes with the temperature remaining at 40° C. Following the hold, a 0.5M silver nitrate solution and a 0.5M sodium chloride solution were then added simultaneously at 8 mL/min for 40 minutes with the pCl being maintained at 2.25.

The resulting emulsion was a tabular grain silver iodochloride emulsion containing 0.04 mole percent iodide, based on silver. Fifty percent of the total grain projected area was provided by tabular grains having {100} major faces having an average ECD of 0.67 μm and an average thickness of 0.035 μm, selected on the basis of an aspect ratio rank ordering of all {100} tabular grains having a thickness of less than 0.3 μm and a major face edge length ratio of less than 10. The selected tabular grain population had an average aspect ratio (ECD/t) of 20 and an average tabularity ($ECD/t^2$) of 651. The ratio of major face edge lengths of the selected tabular grains was 1.9. Fifty two percent of total grain projected area was made up of tabular grains having {100} major faces and aspect ratios of at least 7.5. These tabular grains had a mean ECD of 0.63 μm, a mean thickness of 0.036 μm, a mean aspect ratio of 18.5 and a mean tabularity of 595.

Emul. prep. 5

This emulsion preparation demonstrates an emulsion in which the initial grain population contained 6.0 mole percent iodide and the final emulsion contained 1.6% iodide.

A 2030 mL solution containing 3.52% by weight low methionine gelatin, 0.0056M sodium chloride and $3.00\times10^{-5}$M potassium iodide was provided in a stirred reaction vessel. The contents of the reaction vessel were maintained at 40° C and the pCl was 2.25.

While this solution was vigorously stirred, 30 mL of 1.0M silver nitrate solution and 30 mL of a 0.97M sodium chloride and 0.03M potassium iodide solution were added simultaneously at a rate of 60 mL/min each. This achieved grain nucleation to form crystals with an initial iodide concentration of 6.0 mole percent, based on total silver.

The mixture was then held 10 minutes with the temperature remaining at 40° C. Following the hold, a 1.00M silver nitrate solution and a 1.00M sodium chloride solution were then added simultaneously at 2 mL/min for 40 minutes with the pCl being maintained at 2.25.

The resulting emulsion was a tabular grain silver iodochloride emulsion containing 1.6 mole percent iodide, based on silver. Fifty percent of grains having {100} major faces having an average ECD of 0.57 μm and an average thickness of 0.036 μm, selected on the basis of an aspect ratio rank ordering of all {100} tabular grains having a thickness of less than 0.3 μm and a major face edge length ratio of less than 10. The selected tabular grain population had an average aspect ratio (ECD/t) of 16.2 and an average tabularity ($ECD/t^2$) of 494. The ratio of major face edge lengths of the selected tabular grains was 1.9. Sixty two percent of total grain projected area was made up of tabular grains having {100} major faces and aspect ratios of at least 7.5. These tabular grains had a mean ECD of 0.55 μm, a mean thickness of 0.041 μm, a mean aspect ratio of 14.5 and a mean tabularity of 421.

EMUL. PREP. 6

This emulsion preparation demonstrates an ultrathin high aspect ratio {100} tabular grain emulsion in which 2 mole percent iodide is present in the initial population and additional iodide is added during growth to make the final iodide level 5 mole percent.

A 2030 mL solution containing 1.75% by weight low methionine gelatin, 0.0056M sodium chloride and $1.48\times10^{-4}$M potassium iodide was provided in a stirred reaction vessel. The contents of the reaction vessel were maintained at 40° C. and the pCl was 2.3.

While this solution was vigorously stirred, 30 mL of 1.0M silver nitrate solution and 30 mL of a 0.99M sodium chloride and 0.01M potassium iodide solution were added simultaneously at a rate of 90 mL/min each. This achieved grain nucleation to form crystals with an initial iodide concentration of 2 mole percent, based on total silver.

The mixture was then held 10 minutes with the temperature remaining at 40° C. Following the hold, a 1.00M silver nitrate solution and a 1.00M sodium chloride solution were then added simultaneously at 8 mL/min while a $3.75\times10^{-3}$M potassium iodide was simultaneously added at 14.6 mL/min for 10 minutes with the pCl being maintained at 1.95.

The resulting emulsion was a tabular grain silver iodochloride emulsion containing 5 mole percent iodide, based on silver. Fifty percent of total grain projected area was provided by tabular grains having {100} major faces having an average ECD of 0.58 μm and an average thickness of 0.030 μm, selected on the basis of an aspect ratio rank ordering of all {100} tabular grains having a thickness of less than 0.3 μm and a major face edge length ratio less than 10. The selected tabular grain population had an average aspect ratio (ECD/t) of 20.6 and an average tabularity (ECD/$t^2$) of 803. The ratio of major face edge lengths of the selected tabular grains was 2. Eighty seven percent of total grain projected area was made up of tabular grains having {100} major faces and aspect ratios of at least 7.5. These tabular grains had a mean ECD of 0.54 μm, a mean thickness of 0.033 μm, a mean aspect ratio of 17.9 and a mean tabularity of 803.

Emul. prep. 7

This emulsion preparation demonstrates a high aspect ratio {100} tabular emulsion where 1 mole percent iodide is present in the initial grain population and 50 mole percent bromide is added during growth to make the final emulsion 0.3 mole percent iodide, 36 mole percent bromide and 63.7 mole percent chloride.

A 2030 mL solution containing 3.52% by weight low methionine gelatin, 0.0056M sodium chloride and $1.48\times10^{-4}$M potassium iodide was provided in a stirred reaction vessel. The contents of the reaction vessel were maintained at 40° C. and the pCl was 2.25.

While this solution was vigorously stirred, 30 mL of 1.0M silver nitrate solution and 30 mL of a 0.99M sodium chloride and 0.01M potassium iodide solution were added simultaneously at a rate of 60 mL/min each. This achieved grain nucleation.

The mixture was then held 10 minutes with the temperature remaining at 40° C. Following the hold, a 0.5M silver nitrate solution and a 0.25M sodium chloride and 0.25M sodium bromide solution were then added simultaneously at 8 mL/min for 40 minutes with the pCl being maintained at 2.25 to form crystals with an initial iodide concentration of 2 mole percent, based on total silver.

The resulting emulsion was a tabular grain silver iodobromochloride emulsion containing 0.27 mole percent iodide and 36 mole percent bromide, based on silver, the remaining halide being chloride. Fifty percent of total grain projected area was provided by tabular grains having {100} major faces having an average ECD of 0.4 μm and an average thickness of 0.032 μm, selected on the basis of an aspect ratio rank ordering of all {100} tabular grains having a thickness of less than 0.3 μm and a major face edge length ratio of less than 10. The selected tabular grain population had an average aspect ratio (ECD/t) of 12.8 and an average tabularity (ECD/$t^2$) of 432. The ratio of major face edge lengths of the selected tabular grains was 1.9. Seventy one percent of total grain projected area was made up of tabular grains having {100} major faces and aspect ratios of at least 7.5. These tabular grains had a mean ECD of 0.38 mm, a mean thickness of 0.034 μm, a mean aspect ratio of 11.3 and a mean tabularity of 363.

Emul. prep. 8

This emulsion preparation demonstrates the preparation of an emulsion satisfying the requirements of the invention employing phthalated gelatin as a peptizer.

To a stirred reaction vessel containing a 310 mL solution that is 1.0 percent by weight phthalated gelatin, 0.0063M sodium chloride and $3.1\times10^{-4}$M KI at 40° C., 6.0 mL of a 0.1M silver nitrate aqueous solution and 6.0 mL of a 0.11M sodium chloride solution were each added concurrently at a rate of 6 mL/min.

The mixture was then held 10 minutes with the temperature remaining at 40° C. Following the hold, the silver and salt solutions were added simultaneously with a linearly accelerated flow from 3.0 mL/min to 9.0 mL/min over 15 minutes with the pCl of the mixture being maintained at 2.7.

The resulting emulsion was a high aspect ratio tabular grain silver iodochloride emulsion. Fifty percent of total grain projected area was provided by tabular grains having {100} major faces having an average ECD of 0.37 μm and an average thickness of 0.037 μm, selected on the basis of an aspect ratio rank ordering of all {100} tabular grains having a thickness of less than 0.3 μm and a major face edge length ratio of less than 10. The selected tabular grain population had an average aspect ratio (ECD/t) of 10 and an average tabularity (ECD/$t^2$) of 330. Seventy percent of total grain projected area was made up of tabular grains having {100} major faces and aspect ratios of at least 7.5. These tabular grains had a mean ECD of 0.3 μm, a mean thickness of 0.04 μm, and a mean tabularity of 210.

Electron diffraction examination of the square and rectangular surfaces of the tabular grains confirmed major face {100} crystallographic orientation.

EMUL. PREP. 9

This emulsion preparation demonstrates the preparation of an emulsion satisfying the requirements of the invention employing an unmodified bone gelatin as a peptizer.

To a stirred reaction vessel containing a 2910 mL solution that is 0.69 percent by weight bone gelatin, 0.0056M sodium chloride, $1.86\times10^{-4}$M KI and at 55° C. and pH 6.5, 60 mL of a 4.0M silver nitrate solution and 60.0 mL of a 4.0M silver chloride solution were each added concurrently at a rate of 120 mL/min.

The mixture was then held for 5 minutes during which a 5000 mL solution that is 16.6 g/L of low methionine gelatin was added and the pH was adjusted to 6.5 and the pCl to 2.25. Following the hold, the silver and salt solutions were added simultaneously with a linearly accelerated flow from 10 mL/min to 25.8 mL/min over 63 minutes with the pCl of the mixture being maintained at 2.25.

The resulting emulsion was a high aspect ratio tabular grain silver iodochloride emulsion containing 0.01 mole % iodide. About 65% of the total projected grain area was provided by tabular grains having an average diameter of 1.5 μm and an average thickness of 0.18 μm.

Emul. prep. 10

High-Aspect-Ratio High-Chloride {100} Tabular Grain Emulsion

Emulsion preparation 10A

A stirred reaction vessel containing 400 mL of a solution which was 0.5% in bone gelatin, 6mM in 3-amino-1H-1,2,4-triazole, 0.040M in NaCl, and 0.20M in sodium acetate was adjusted to pH 6.1 at 55° C. To this solution at 55° C. were added simultaneously 5.0 mL of 4 M $AgNO_3$ and 5.0 mL of 4M NaCl at a rate of 5 mL/min each. The temperature of the mixture was then increased to 75° C. at a constant rate requiring 12 min and then held at this temperature for 5 min. The pH was adjusted to 6.2 and held to within ±0.1 of this value, and the flow of the $AgNO_3$ solution was resumed at 5 mL/min until 0.8 mole of Ag had been added. The flow of the NaCl solution was also resumed at a rate needed to maintain a constant pAg of 6.64.

The resulting AgCl emulsion consisted of tabular grains having {100} major faces which made up 65% of the projected area of the total grain population. This tabular grain population had a mean equivalent circular diameter of 1.95 μm and a mean thickness of 0.165 μm. The average aspect ratio and tabularity were 11.8 and 71.7, respectively.

Emul. prep. 10B

This emulsion was prepared similar to that of Emulsion preparation 10A except that the precipitation was stopped when 0.4 mole of Ag had been added.

The resulting emulsion consisted of tabular grain having {100} major faces which made up 65% of the projected area of the total grain population. This tabular grain population had a mean equivalent circular diameter of 1.28 μm and a mean thickness of 0.130 μm. The average aspect ratio and tabularity were 9.8 and 75.7, respectively.

Emul. prep. 11 pH=6.1 Nucleation, pH≈3.6 Growth

This emulsion preparation was prepared similar to that of Emulsion preparation 10B except that the pH of the reaction vessel was adjusted to 3.6 for the last 95% of the $AgNO_3$ addition.

The resulting emulsion consisted of {100} tabular grains making up 60% of the projected area of the total grain population. This tabular grain population had a mean equivalent circular diameter of 1.39 μm, and a mean thickness of 0.180 μm. The average aspect ratio and tabularity were 7.7 and 43.0, respectively.

Emul. prep. 12 High-Aspect-Ratio AgBrCl (10% Br) {100} Tabular-Grain Emulsion

This emulsion was prepared similar to that of Emulsion preparation 10B except that the salt solution was 3.6M in NaCl and 0.4M in NaBr.

The resulting AgBrCl (10% Br) emulsion consisted of {100} tabular grain making up 52% of the projected area of the total grain population. This tabular grain population had a mean equivalent circular diameter of 1.28 μm, and a mean thickness of 0.115. The average aspect ratio and tabularity were 11.1 and 96.7, respectively.

Emul. prep. 13 3,5-Diamino-1,2,4-Triazole as {100} Tabular Grain Nucleating Agent This emulsion was prepared similar to that of Emulsion preparation 10A, except that 3,5-diamino-1,2,4-triazole (2.4 mmole) was used as the {100} tabular grin nucleating agent.

The resulting AgCl emulsion consisted of tabular grains having {100} major faces which made up 45% of the projected area of the total grain population. This tabular grain population had a mean equivalent circular diameter of 1.54 μm and a mean thickness of 0.20 μm. The average aspect ratio and tabularity were 7.7 and 38.5, respectively.

Emul. prep. 14 Imidazole as {100} Tabular Grain Nucleating Agent

This emulsion was prepared similar to that of Emulsion preparation 10A except that imidazole (9.6 mmole) was used as the {100} tabular grain nucleating agent.

The resulting AgCl emulsion consisted of tabular grains having {100} major faces which made up 40% of the projected area of the total grain population. This tabular grain population had a mean equivalent circular diameter of 2.20 μm and a mean thickness of 0.23 μm. The average aspect ratio and tabularity were 9.6 an 41.6, respectively.

Emul. prep. 15 AgCl{100} Tabular Grain Emulsion Made Without Aromatic Amine Restraining Agent To a stirred reaction vessel containing 400 mL of a solution which was 0.25 wt. % in bone gelatin low in methionine content (<4 μmoles per gram gelatin), 0.008M in NaCl, and at pH 6.2 and 85° C. were added simultaneously a 4M $AgNO_3$ solution at 5.0 ml/min and a 4M NaCl solution at a rate needed to maintain a constant pCl of 2.09. When 0.20 mole of $AgNO_3$ had been added, the additions were stopped for 20 sec. during which time 15 mls of a 13.3% low methionine gelatin solution was added and the pH adjusted to 6.2. The additions were resumed until a total of 0.4 mole of $AgNO_3$ had been added. The pH was held constant at 6.2 ±0.1 during the precipitation.

The resulting AgCl emulsion consisted of tabular grains having {100} major faces which made up 40% of the projected area of the total gain population. This tabular grain population had a mean equivalent circular diameter of 2.18 μm and a mean thickness of 0.199 μm. The average aspect ratio and tabularity were 11.0 and 55.0, respectively.

The emulsions satisfying the requirements of the invention can be chemically sensitized with active gelatin as illustrated by T. H. James, *The Theory of the Photographic Process*, 4th Ed., Macmillan, 1977, pp. 67–76, or with sulfur, selenium, tellurium, gold, platinum, palladium, iridium, osmium, rhenium or phosphorus sensitizers or combinations of these sensitizers, such as at pAg levels of from 5 to 10, pH levels of from 5 to 8 and temperatures of from 30° to 80° C., as illustrated by *Research Disclosure*, Vol. 120, Apr., 1974, Item 12008, *Research Disclosure*, Vol. 134, Jun., 1975, Item 13452, Sheppard et al U.S. Pat. No. 1,623,499, Matthies et al U.S. Pat. No. 1,673,522, Waller et al U.S. Pat. No. 2,399,083, Damschroder et al U.S. Pat. No. 2,642,361,McVeigh U.S. Pat. No. 3,297,447, Dunn U.S.

Pat. No. 3,297,446, McBride U.K. Patent 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U.K. Patent 1,396,696; chemical sensitization being optionally conducted in the presence of thiocyanate derivatives as described in Damschroder U.S.Pat. No. 2,642,361; thioether compounds as disclosed in Lowe et al U.S. Pat. No. 2,521,926, Williams et al U.S. Pat. No. 3,021,215 and Bigelow U.S. Pat. No. 4,054,457; and azaindenes, azapyridazines and azapyrimidines as described in Dostes U.S. Pat. No. 3,411,914, Kuwabara et al U.S. Pat. No. 3,554,757, Oguchi et al U.S. Pat. No. 3,565,631 and Oftedahl U.S. Pat. No. 3,901,714; elemental sulfur as described by Miyoshi et al European Patent Application EP 294,149 and Tanaka et al European Patent Application EP 297,804; and thiosulfonates as described by Nishikawa et al European Patent Application EP 293,917. Additionally or alternatively, the emulsions can be reduction-sensitized—e.g., with hydrogen, as illustrated by Janusonis U.S. Pat. No. 3,891,446 and Babcock et al U.S. Pat. No. 3,984,249, by low pAg (e.g., less than 5), high pH (e.g., greater than 8) treatment, or through the use of reducing agents such as stannous chloride, thiourea dioxide, polyamines and amineboranes as illustrated by Allen et al U.S. Pat. No. 2,983,609, Oftedahl et al *Research Disclosure*, Vol. 136, Aug., 1975, Item 13654, Lowe et al U.S. Pat. Nos. 2,518,698 and 2,739,060, Roberts et al U.S. Pat. Nos. 2,743,182 and '183, Chambers et al U.S. Pat. No. 3,026,203 and Bigelow et al U.S. Pat. No. 3,361,564.

Chemical sensitization can take place in the presence of spectral sensitizing dyes as described by Philippaerts et al U.S. Pat. No. 3,628,960, Kofron et al U.S. Pat. No. 4,439,520, Dickerson U.S. Pat. No. 4,520,098, Maskasky U.S. Pat. No. 4,435,501, Ihama et al U.S. Pat. No. 4,693,965 and Ogawa U.S. Pat. No. 4,791,053. Chemical sensitization can be directed to specific sites or crystallographic faces on the silver halide grain as described by Haugh et al U.K. Patent Application 2,038,792A and Mifune et al published European Patent Application EP 302,528. The sensitivity centers resulting from chemical sensitization can be partially or totally occluded by the precipitation of additional layers of silver halide using such means as twin-jet additions or pAg cycling with alternate additions of silver and halide salts as described by Morgan U.S. Pat. No. 3,917,485, Becker U.S. Pat. No. 3,966,476 and *Research Disclosure*, Vol. 181, May, 1979, Item 18155. Also as described by Morgan, cited above, the chemical sensitizers can be added prior to or concurrently with the additional silver halide formation. Chemical sensitization can take place during or after halide conversion as described by Hasebe et al European Patent Application EP 273,404. In many instances epitaxial deposition onto selected tabular grain sites (e.g., edges or corners) can either be used to direct chemical sensitization or to itself perform the functions normally performed by chemical sensitization.

The emulsions satisfying the requirements of the invention can be spectrally sensitized with dyes from a variety of classes, including the polymethine dye class, which includes the cyanines, merocyanines, complex cyanines and merocyanines (i.e., tri-, tetra- and polynuclear cyanines and merocyanines), styryls, merostyryls, streptocyanines, hemicyanines, arylidenes, allopolar cyanines and enamine cyanines.

The cyanine spectral sensitizing dyes include, joined by a methine linkage, two basic heterocyclic nuclei, such as those derived from quinolinium, pyridinium, isoquinolinium, 3H-indolium, benzindolium, oxazolium, thiazolium, selenazolinium, imidazolium, benzoxazolium, benzothiazolium, benzoselenazolium, benzotellurazolium, benzimidazolium, naphthoxazolium, naphthothiazolium, naphthoselenazolium, naphtotellurazolium, thiazolinium, dihydronaphthothiazolium, pyrylium and imidazopyrazinium quaternary salts.

The merocyanine spectral sensitizing dyes include, joined by a methine linkage, a basic heterocyclic nucleus of the cyanine-dye type and an acidic nucleus such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexan-1,3-dione, 1,3-dioxane-4,6-dione, pyrazolin-3,5-dione, pentan-2,4-dione, alkylsulfonyl acetonitrile, benzoylacetonitrile, malononitrile, malonamide, isoquinolin-4-one, chroman-2,4-dione, 5H-furan-2-one, 5H-3-pyrrolin-2-one, 1,1,3-tricyanopropene and telluracyclohexanedione.

One or more spectral sensitizing dyes may be employed. Dyes with sensitizing maxima at wavelengths throughout the visible and infrared spectrum and with a great variety of spectral sensitivity curve shapes are known. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization greater in some spectral region than that from any concentration of one of the dyes alone or that which would result from the additive effect of the dyes. Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, *Photographic Science and Engineering*, Vol. 18, 1974, pp. 418–430.

Spectral sensitizing dyes can also affect the emulsions in other ways. For emulsion preparation, spectrally sensitizing dyes can increase photographic speed within the spectral region of inherent sensitivity. Spectral sensitizing dyes can also function as antifoggants or stabilizers, development accelerators or inhibitors, reducing or nucleating agents, and halogen acceptors or electron acceptors, as disclosed in Brooker et al U.S. Pat. No. 2,131,038, Illingsworth et al U.S. Pat. No. 3,501,310, Webster et al U.S. Pat. No. 3,630,749, Spence et al U.S. Pat. No. 3,718,470 and Shiba et al U.S. Pat. No. 3,930,860.

Among useful spectral sensitizing dyes for sensitizing the emulsions satisfying the requirements of the invention are those found in U.K. Patent 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,493,747, '748, 2,526,632, 2,739,964 (Reissue 24,292), 2,778,823, 2,917,516, 3,352,857, 3,411,916 and 3,431,111, Sprague U.S. Pat. No. 2,503,776, Nys et al U.S. Pat. No. 3,282,933, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349, the disclosures of which are here incorporated by reference. Examples of useful supersensitizing-dye combinations, of non-light-absorbing addenda which function as supersensitizers or of useful dye combinations are found in McFall et al U.S. Pat. No. 2,933,390, Jones et al U.S. Pat. No. 2,937,089, Motter U.S. Pat. No. 3,506,443 and Schwan et al U.S. Pat. No. 3,672,898, the disclosures of which are here incorporated by reference.

Spectral sensitizing dyes can be added at any stage during the emulsion preparation. They may be added at the beginning of or during precipitation as described by Wall, *Photographic Emulsions*, American Photographic Publishing Co., Boston, 1929, p. 65, Hill U.S. Pat. No. 2,735,766, Philippaerts et al U.S. Pat. No. 3,628,960, Locker U.S. Pat. No. 4,183,756, Locker et al U.S. Pat. No. 4,225,666 and *Research Disclosure*, Vol. 181, May, 1979, Item 18155, and Tani et al published European Patent Application EP 301,508. They can be added prior to or during chemical sensitization as described by Kofron et al U.S. Pat. No. 4,439,520, Dickerson U.S. Pat. No. 4,520,098, Maskasky U.S. Pat. No. 4,435,501 and Philippaerts et al cited above. They can be added before or during emulsion washing as described by Asami et al published European Patent Application EP 287,100 and Metoki et al published European Patent Application EP 291,399. The dyes can be mixed in directly before coating as described by Collins et al U.S. Pat. No. 2,912,343. Small amounts of iodide can be adsorbed to the emulsion grains to promote aggregation and adsorption of the spectral sensitizing dyes as described by Dickerson cited above. Postprocessing dye stain can be reduced by the proximity to the dyed emulsion layer of fine high-iodide grains as described by Dickerson. Depending on their solubility, the spectral-sensitizing dyes can be added to the emulsion as solutions in water or such solvents as methanol, ethanol, acetone or pyridine; dissolved in surfactant solutions as described by Sakai et al U.S. Pat. No. 3,822,135; or as dispersions as described by Owens et al U.S. Pat. No. 3,469,987 and Japanese published Patent Application (Kokai) 24185/71. The dyes can be selectively adsorbed to particular crystallographic faces of the emulsion grain as a means of restricting chemical sensitization centers to other faces, as described by Mifune et al published European Patent Application 302,528. The spectral sensitizing dyes may be used in conjunction with poorly adsorbed luminescent dyes, as described by Miyasaka et al published European Patent Applications 270,079, 270,082 and 278,510.

The following illustrate specific spectral sensitizing dye selections:

SS-1

Anhydro-5'-chloro-3'-di-(3-sulfopropyl)naphtho[1,2-d]-thiazolothiacyanine hydroxide, sodium salt

SS-2

Anhydro-5'-chloro-3'-di-(3-sulfopropyl)naphtho[1,2-d]-oxazolothiacyanine hydroxide, sodium salt

SS-3

Anhydro-4,5-benzo-3'-methyl-4'-phenyl-1-(3-sulfopropyl)naphtho[1,2-d]thiazolothiazolocyanine hydroxide

SS-4

1,1'-Diethylnaphtho[1,2-d]thiazolo-2'-cyanine bromide

SS-5

Anhydro-1,1'-dimethyl-5,5'-di-(trifluoromethyl)-3-(4-sulfobuyl)-3'-(2,2,2-trifluoroethyl)benzimidazolocarbocyanine hydroxide

SS-6

Anhydro-3,3'-(2-methoxyethyl)-5,5'-diphenyl-9-ethyloxacarbocyanine, sodium salt

SS-7

Anhydro-11-ethyl-1,1'-di-(3-sulfopropyl)naphtho[1,2-d]oxazolocarbocyanine hydroxide, sodium salt

SS-8

Anhyydro-5,5'-dichloro-9-ethyl-3,3'-di-(3-sulfopropyl)oxaselenacarbocyanine hydroxide, sodium salt

SS-9

5,6-Dichloro-3',3'-dimethyl-1,1',3-triethylbenzimidazolo-3H-indolocarbocyanine bromide

SS-10

Anhydro-5,6-dichloro-1,1-diethyl-3-(3-sulfopropylbenzimidazolooxacarbocyanine hydroxide

SS-11

Anhydro-5,5'-dichloro-9-ethyl-3,3'-di-(2-sulfoethylcarbamoylmethyl)thiacarbocyanine hydroxide, sodium salt

SS-12

Anhydro-5',6'-dimethoxy-9-ethyl-5-phenyl-3-(3-sulfobutyl)-3'-(3-sulfopropyl)oxathiacarbocyanine hydroxide, sodium salt

SS-13

Anhydro-5,5'-dichloro-9-ethyl-3-(3-phosphonopropyl)-3'-(3-sulfopropyl)thiacarbocyanine hydroxide

SS-14

Anhydro-3,3'-di-(2-carboxyethyl)-5,5'-dichloro-9-ethylthiacarbocyanine bromide

SS-15

Anhydro-5,5'-dichloro-3-(2-carboxyethyl)-3'-(3-sulfopropyl)thiacyanine sodium salt

SS-16

9-(5-Barbituric acid)-3,5-dimethyl-3'-ethyltellurathiacarbocyanine bromide

SS-17

Anhydro-5,6-methylenedioxy-9-ethyl-3-methyl-3'-(3-sulfopropyl)tellurathiacarbocyanine hydroxide

SS-18

3-Ethyl-6,6'-dimethyl-3'-pentyl-9.11-neopentylene-thiadicarbocyanine bromide

SS-19

Anhydro-3-ethyl-9,11-neopentylene-3'-(3-sulfopropyl)thiadicarbocyanine hydroxide

SS-20

Anhydro-3-ethyl-11,13-neopentylene-3'-(3-sulfopropyl)oxathiatricarbocyanine hydroxide, sodium salt

SS-21

Anhydro-5-chloro-9-ethyl-5'-phenyl-3'-(3-sulfobutyl)-3-(3-sulfopropyl)oxacarbocyanine hydroxide, sodium salt

SS-22

Anhydro-5,5'-diphenyl-3,3'-di-(3-sulfobutyl)-9-ethyloxacarbocyanine hydroxide, sodium salt

SS-23

Anhydro-5,5'-dichloro-3,3'-di-(3-sulfopropyl)-9-ethylthiacarbocyanine hydroxide, triethylammonium salt

SS-24

Anhydro-5,5'-dimethyl-3,3'-di-(3-sulfopropyl)-9-ethylthiacarbocyanine hydroxide, sodium salt

SS-25

Anhydro-5,6-dichloro-1-ethyl-3-(3-sulfobutyl)-1'-(3-sulfopropyl)benzimidazolonaphtho[1,2-d]-thiazolocarbocyanine hydroxide, triethylammonium salt

SS-26

Anhydro-11-ethyl-1,1'-di-(3-sulfopropyl)naphth[1,2-d]-oxazolocarbocyanine hydroxide, sodium salt

SS-27

Anhydro-3,9-diethyl-3'-methylsulfonylcarbamoylmethyl-5-phenyloxathiacarbocyanine p-toluenesulfonate

SS-28

Anhydro-6,6'-dichloro-1,1'-diethyl-3,3'-di-(3-sulfopropyl)-5,5'-bis(trifluoromethyl)benzimidazolocarbocyanine hydroxide, sodium salt

SS-29

Anhydro-5'-chloro-5-phenyl-3,3'-di-(3-sulfopropyl-)oxathiacyanine hydroxide, sodium salt

SS-30

Anhydro-5,5'-dichloro-3,3'-di-(3-sulfopropyl)-thiacyanine hydroxide, sodium salt

SS-31

3-Ethyl-5-[1,4-dihydro-1-(4-sulfobutyl)pyridin-4-ylidene]rhodanine, triethylammonium salt

SS-32

1-Carboxyethyl-5-[2-(3-ethylbenzoxazolin-2-ylidene)ethylidene]-3-phenylthiohydantoin

SS-33

4-[2-((1,4-Dihydro-1-dodecylpyridin-ylidene)ethylidene]-3-phenyl-2-isoxazolin-5-one

SS-34

5-(3-Ethylbenzoxazolin-2-ylidene)-3-phenylrhodanine

SS-35

1,3-Diethyl-5-{[1-ethyl-3-(3-sulfopropyl)benzimidzolin-2-ylidene]ethylidene}-2-thiobarbituric acid

SS-36

5-[2-(3-Ethylbenzoxazolin-2-ylidene)ethylidene]-1-methyl-2-dimethylamino-4-oxo-3-phenylimidazolinium p-toluenesulfonate

SS-37

5-[2-(5-Carboxy-3-methylbenzoxazolin-2-ylidene)ethylidene]-3-cyano-4-phenyl-1-(4-methylsulfonamido-3-pyrrolin-5-one

SS-38

2-[4-(Hexylsulfonamido)benzoylcyanomethine]-2-{2-(3-(2-methoxyethyl)-5-[(2-methoxyethyl)sulfonamido]-benzoxazolin-2-ylidene}ethylidene}acetonitrile

SS-39

3-Methyl-4-[2-(3-ethyl-5,6-dimethylbenzotellurazolin-2-ylidene)ethylidene]-1-phenyl-2-pyrazolin-5-one

SS-40

3-Heptyl-1-phenyl-5-{4-[3-(3-sulfobutyl)-naphtho[1,2-d]thiazolin]-2-butenylidene}-2-thiohydantoin

SS-41

1,4-Phenylene-bis(2-aminovinyl-3-methyl-2-thiazolinium]dichloride

SS-42

Anhydro-4-{2-[3-(3-sulfopropyl)thiazolin-2-ylidene]-ethylidene}-2-{3-[3-(3-sulfopropyl)thiazolin-2-ylidene]propenyl]}-5-oxazolium, hydroxide, sodium salt

SS-43

3-Carboxymethyl 5-{3-carboxymethyl-4-oxo-5-methyl-1,3,4-thiadiazolin-2-ylidene)ethylidene]thiazolin-2-ylidene)rhodanine, dipotassium salt

SS-44

1,3-Diethyl-5-[1-methyl-2-(3,5-dimethylbenzotellurazolin-2-ylidene)ethylidene]-2-thiobarbituric acid

SS-45

3-Methyl-4-[2-(3-ethyl-5,6-dimethylbenzotellurazolin-2-ylidene)-1-methylethylidene]-1-phenyl-2-pyrazolin-5-one

SS-46

1,3-Diethyl-5-[1-ethyl-2-(3-ethyl-5,6-dimethoxybenzotellurazolin-2-ylidene)ethylidene]-2-thiobarbituric acid

SS-47

3-Ethyl-5-{[(ethylbenzothiazolin-2-ylidene)-methyl]-[(1,5-dimethylnaphtho[1,2-d]selenazolin-2-ylidene)methyl]methylene}rhodanine

SS-48

5-{Bis[(3-ethyl-5,6-dimethylbenzothiazolin-2-ylidene)methyl]methylene}-1,3-diethyl-barbituric acid

SS-49

3-Ethyl-5-{[(3-ethyl-5-methylbenzotellurazolin-2-ylidene)methyl][1-ethylnaphtho[1,2-d]-tellurazolin-2-ylidene)methyl]methylene}rhodanine

SS-50

Anhydro-5,5'-diphenyl-3,3'-di-(3-sulfopropyl)-thiacyanine hydroxide, triethylammonium salt

SS-51

Anhydro-5-chloro-5'-phenyl-3,3'-di-(3-sulfopropyl)thia-cyanine hydroxide, triethylammonium salt Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Most of the antifoggants effective in the emulsions of this invention can also be used in developers and can be classified under a few general headings, as illustrated by C. E. K. Mees, *The Theory of the Photographic Process,* 2Nd Ed., Macmillan, 1954, pp. 677–680.

To avoid such instability in emulsion coatings, stabilizers and antifoggants can be employed, such as halide ions (e.g., bromide salts); chloropalladates and chloropalladites as illustrated by Trivelli et al U.S. Pat. No. 2,566,263; water-soluble inorganic salts of magnesium, calcium, cadmium, cobalt, manganese and zinc as illustrated by Jones U.S. Pat. No. 2,839,405 and Sidebotham U.S. Pat. No. 3,488,709; mercury salts as illustrated by Allen et al U.S. Pat. No. 2,728,663; selenols and diselenides as illustrated by Brown et al U.K. Patent 1,336,570 and Pollet et al U.K. Patent 1,282,303; quaternary ammonium salts of the type illustrated by Allen et al U.S. Pat. No. 2,694,716, Brooker et al U.S. Pat. No. 2,131,038, Graham U.S. Pat. No. 3,342,596 and Arai et al U.S. Pat. No. 3,954,478; azomethine desensitizing dyes as illustrated by Thiers et al U.S. Pat. No. 3,630,744; isothiourea derivatives as illustrated by Herz et al U.S. Pat. No. 3,220,839 and Knott et al U.S. Pat. No. 2,514,650; thiazolidines as illustrated by Scavron U.S. Pat. No. 3,565,625; peptide derivatives as illustrated by Maffet U.S. Pat. No. 3,274,002; pyrimidines and 3-pyrazolidones as illustrated by Welsh U.S. Pat. No. 3,161,515 and Hood et al U.S. Pat. No. 2,751,297; azotriazoles and azotetrazoles as illustrated by Baldassarri et al U.S. Pat. No. 3,925,086; azaindenes, particularly tetraazaindenes, as illustrated by Heimbach U.S. Pat. No. 2,444,605, Knott U.S. Pat. No. 2,933,388, Williams U.S. Pat. No. 3,202,512, *Research Disclosure*, Vol. 134, Jun., 1975, Item 13452, and Vol. 148, Aug., 1976, Item 14851, and Nepker et al U.K. Patent 1,338,567; mercaptotetrazoles, -triazoles and -diazoles as illustrated by Kendall et al U.S. Pat. No. 2,403,927, Kennard et al U.S. Pat. No. 3,266,897, *Research Disclosure*, Vol. 116, Dec., 1973, Item 11684, Luckey et al U.S. Pat. No. 3,397,987 and Salesin U.S. Pat. No. 3,708,303; azoles as illustrated by Peterson et al U.S. Pat. No. 2,271,229 and *Research Disclosure*, Item 11684, cited above; purines as illustrated by Sheppard et al U.S. Pat. No. 2,319,090, Birr et al U.S. Pat. No. 2,152,460, *Research Disclosure*, Item 13452, cited above, and Dostes et al French Patent 2,296,204, polymers of 1,3-dihydroxy(and/or 1,3-carbamoxy)-2-methylenepropane as illustrated by Saleck et al U.S. Pat. No. 3,926,635 and tellurazoles, tellurazolines, tellurazolinium salts and tellurazolium salts as illustrated by Gunther et al U.S. Pat. No. 4,661,438, aromatic oxatellurazinium salts as illustrated by Gunther, U.S. Pat. No. 4,581,330 and Przyklek-Elling et al U.S. Pat. Nos. 4,661,438 and 4,677,202. High-chloride emulsions can be stabilized by the presence, especially during chemical sensitization, of elemental sulfur as described by Miyoshi et al European published Patent Application EP 294,149 and Tanaka et al European published Patent Application EP 297,804 and thiosulfonates as described by Nishikawa et al European published Patent Application EP 293,917.

Among useful stabilizers for gold sensitized emulsions are water-insoluble gold compounds of benzothiazole, benzoxazole, naphthothiazole and certain merocyanine and cyanine dyes, as illustrated by Yutzy et al U.S. Pat. No. 2,597,915, and sulfinamides, as illustrated by Nishio et al U.S. Pat. No. 3,498,792.

Among useful stabilizers in layers containing poly(alkylene oxides) are tetraazaindenes, particularly in combination with Group VIII noble metals or resorcinol derivatives, as illustrated by Carroll et al U.S. Pat. No. 2,716,062, U.K. Patent 1,466,024 and Habu et al U.S. Pat. No. 3,929,486; quaternary ammonium salts of the type illustrated by Piper U.S. Pat. No. 2,886,437; water-insoluble hydroxides as illustrated by Maffet U.S. Pat. No. 2,953,455; phenols as illustrated by Smith U.S. Pat. Nos. 2,955,037 and '038; ethylene diurea as illustrated by Dersch U.S. Pat. No. 3,582,346; barbituric acid derivatives as illustrated by Wood U.S. Pat. No. 3,617,290; boranes as illustrated by Bigelow U.S. Pat. No. 3,725,078; 3-pyrazolidinones as illustrated by Wood U.K. Patent 1,158,059 and aldoximines, amides, anilides and esters as illustrated by Butler et al U.K. Patent 988,052.

The emulsions can be protected from fog and desensitization caused by trace amounts of metals such as copper, lead, tin, iron and the like by incorporating addenda such as sulfocatechol-type compounds, as illustrated by Kennard et al U.S. Pat. No. 3,236,652; aldoximines as illustrated by Carroll et al U.K. Patent 623,448 and meta- and polyphosphates as illustrated by Draisbach U.S. Pat. No. 2,239,284, and carboxylic acids such as ethylenediamine tetraacetic acid as illustrated by U.K. Patent 691,715.

Among stabilizers useful in layers containing synthetic polymers of the type employed as vehicles and to improve covering power are monohydric and polyhydric phenols as illustrated by Forsgard U.S. Pat. No. 3,043,697; saccharides as illustrated by U.K. Patent 897,497 and Stevens et al U.K. Patent 1,039,471, and quinoline derivatives as illustrated by Dersch et al U.S. Pat. No. 3,446,618.

Among stabilizers useful in protecting the emulsion layers against dichroic fog are addenda such as salts of nitron as illustrated by Barbier et al U.S. Pat. Nos. 3,679,424 and 3,820,998; mercaptocarboxylic acids as illustrated by Willems et al U.S. Pat. No. 3,600,178; and addenda listed by E. J. Birr, *Stabilization of Photographic*

*Silver Halide Emulsions*, Focal Press. London. 1974, pp. 126–218.

Among stabilizers useful in protecting emulsion layers against development fog are addenda such as azabenzimidazoles as illustrated by Bloom et al U.K. Patent 1,356,142 and U.S. Pat. No. 3,575,699, Rogers U.S. Pat. No. 3,473,924 and Carlson et al U.S. Pat. No. 3,649,267; substituted benzimidazoles, benzothiazoles, benzotriazoles and the like as illustrated by Brooker et al U.S. Pat. No. 2,131,038, Land U.S. Pat. No. 2,704,721, Rogers et al U.S. Pat. No. 3,265,498; mercapto-substituted compounds, e.g., mercaptotetrazoles, as illustrated by Dimsdale et al U.S. Pat. No. 2,432,864, Rauch et al U.S. Pat. No. 3,081,170, Weyerts et al U.S. Pat. No. 3,260,597, Grasshoff et al U.S. Pat. No. 3,674,478 and Arond U.S. Pat. No. 3,706,557; isothiourea derivatives as illustrated by Herz et al U.S. Pat. No. 3,220,839, and thiodiazole derivatives as illustrated by von Konig U.S. Pat. No. 3,364,028 and von Konig et al U.K. Patent 1,186,441.

Where hardeners of the aldehyde type are employed, the emulsion layers can be protected with antifoggants such as monohydric and polyhydric phenols of the type illustrated by Sheppard et al U.S. Pat. No. 2,165,421; nitro-substituted compounds of the type disclosed by Rees et al U.K. Patent 1,269,268; poly(alkylene oxides) as illustrated by Valbusa U.K. Patent 1,151,914, and mucohalogenic acids in combination with urazoles as illustrated by Allen et al U.S. Pat. Nos. 3,232,761 and 3,232,764, or further in combination with maleic acid hydrazide as illustrated by Rees et al U.S. Pat. No. 3,295,980.

To protect emulsion layers coated on linear polyester supports, addenda can be employed such as parabanic acid, hydantoin acid hydrazides and urazoles as illustrated by Anderson et al U.S. Pat. No. 3,287,135, and piazines containing two symmetrically fused 6-member carbocyclic rings, especially in combination with an aldehyde-type hardening agent, as illustrated in Rees et al U.S. Pat. No. 3,396,023.

Kink desensitization of the emulsions can be reduced by the incorporation of thallous nitrate as illustrated by Overman U.S. Pat. No. 2,628,167; compounds, polymeric latices and dispersions of the type disclosed by Jones et al U.S. Pat. Nos. 2,759,821 and '822; azole and mercaptotetrazole hydrophilic colloid dispersions of the type disclosed by *Research Disclosure*, Vol. 116, Dec., 1973, Item 11684; plasticized gelatin compositions of the type disclosed by Milton et al U.S. Pat. No. 3,033,680; water-soluble interpolymers of the type disclosed by Rees et al U.S. Pat. No. 3,536,491; polymeric latices prepared by emulsion polymerization in the presence of poly(alkylene oxide) as disclosed by Pearson et al U.S. Pat. No. 3,772,032, and gelatin graft copolymers of the type disclosed by Rakoczy U.S. Pat. No. 3,837,861.

Where the photographic element is to be processed at elevated bath or drying temperatures, as in rapid access processors, pressure desensitization and/or increased fog can be controlled by selected combinations of addenda, vehicles, hardeners and/or processing conditions as illustrated by Abbott et al U.S. Pat. No. 3,295,976, Barnes et al U.S. Pat. No. 3,545,971, Salesin U.S. Pat. No. 3,708,303, Yamamoto et al U.S. Pat. No. 3,615,619, Brown et al U.S. Pat. No. 3,623,873, Taber U.S. Pat. No. 3,671,258, Abele U.S. Pat. No. 3,791,830, *Research Disclosure*, Vol. 99, Jul., 1972, Item 9930, Florens et al U.S. Pat. No. 3,843,364, Priem et al U.S. Pat. No. 3,867,152, Adachi et al U.S. Patent 3,967,965 and Mikawa et al U.S. Pat. Nos. 3,947,274 and 3,954,474.

In addition to increasing the pH or decreasing the pAg of an emulsion and adding gelatin, which are known to retard latent-image fading, latent-image stabilizers can be incorporated, such as amino acids, as illustrated by Ezekiel U.K. Patents 1,335,923, 1,378,354, 1,387,654 and 1,391,672, Ezekiel et al U.K. Patent 1,394,371, Jefferson U.S. Pat. No. 3,843,372, Jefferson et al U.K. Patent 1,412,294 and Thurston U.K. Patent 1,343,904; carbonyl-bisulfite addition products in combination with hydroxybenzene or aromatic amine developing agents as illustrated by Seiter et al U.S. Pat. No. 3,424,583; cycloalkyl-1,3-diones as illustrated by Beckett et al U.S. Pat. No. 3,447,926; enzymes of the catalase type as illustrated by Matejec et al U.S. Pat. No. 3,600,182; halogen-substituted hardeners in combination with certain cyanine dyes as illustrated by Kumai et al U.S. Pat. No. 3,881,933; hydrazides as illustrated by Honig et al U.S. Pat. No. 3,386,831; alkenyl benzothiazolium salts as illustrated by Arai et al U.S. Pat. No. 3,954,478; hydroxy-substituted benzylidene derivatives as illustrated by Thurston U.K. Patent 1,308,777 and Ezekiel et al U.K. Patents 1,347,544 and 1,353,527; mercapto-substituted compounds of the type disclosed by Sutherns U.S. Pat. No. 3,519,427; metal-organic complexes of the type disclosed by Matejec et al U.S. Pat. No. 3,639,128; penicillin derivatives as illustrated by Ezekiel U.K. Patent 1,389,089; propynylthio derivatives of benzimidazoles, pyrimidines, etc., as illustrated by von Konig et al U.S. Pat. No. 3,910,791; combinations of iridium and rhodium compounds as disclosed by Yamasue et al U.S. Pat. No. 3,901,713; sydnones or sydnone imines as illustrated by Noda et al U.S. Pat. No. 3,881,939; thiazolidine derivatives as illustrated by Ezekiel U.K. Patent 1,458,197 and thioether-substituted imidazoles as illustrated by *Research Disclosure*, Vol. 136, Aug., 1975, Item 13651.

In addition to the features described above the tabular grain emulsions satisfying the roll film requirements of the invention can include conventional features of the type found in tabular grain emulsions useful in roll film constructions. Such conventional tabular grain emulsion features are further illustrated by the following incorporated by reference disclosures:

ICBR-1 Kofron et al U.S. Pat. No. 4,439,520, issued Mar. 27, 1984;

ICBR-2 Wey et al U.S. Pat. No. 4,414,306, issued Nov. 8, 1983;

ICBR-3 Solberg et al U.S. Pat. No. 4,433,048, issued Feb. 21, 1984;

ICBR-4 Wilgus et al U.S. Pat. No. 4,434,226, issued Feb. 28, 1984;

ICBR-5 Maskasky U.S. Pat. No. 4,435,501, issued Mar. 6, 1984;

ICBR-6 Maskasky U.S. Pat. No. 4,643,966, issued Feb. 17, 1987;

ICBR-7 Daubendiek et al U.S. Pat. No. 4,672,027, issued Jan. 9, 1987;

ICBR-8 Daubendiek et al U.S. Pat. No. 4,693,964, issued Sep. 15, 1987;

ICBR-9 Maskasky U.S. Pat. No. 4,713,320, issued Dec. 15, 1987;

ICBR-10 Saitou et al U.S. Pat. No. 4,797,354, issued Jan. 10, 1989;

ICBR-11 Ikeda et al U.S. Pat. No. 4,806,461, issued Feb. 21, 1989;

ICBR-12 Makino et al U.S. Pat. No. 4,853,322, issued Aug. 1, 1989; and

ICBR-13 Daubendiek et al U.S. Pat. No. 4,914,014, issued Apr. 3, 1990.

Roll films according to the invention contain at least one high chloride {100} tabular grain emulsion layer. In the simplest contemplated form of the invention the roll film is a black-and-white film containing a single high chloride {100} tabular grain emulsion layer. In another common black-and-white roll film construction two emulsions are present differing in photographic speed, with the faster emulsion coated over or blended with the slower emulsion. In this construction the high chloride {100} tabular grain emulsion can form either the faster or slower emulsion or both. For example, when image definition is of paramount importance, a faster high chloride {100} tabular grain emulsion is preferably coated over a slower emulsion layer, which can contain a conventional nontabular grain emulsion of any convenient halide composition. For a very high speed roll film, a preferred construction is to coat a conventional high aspect ratio tabular grain silver iodobromide emulsion in the overlying faster emulsion layer and to coat a high chloride {100} tabular grain emulsion in the underlying emulsion layer. In each of the constructions the presence of a high chloride emulsion in the layer nearest the support facilitates rapid processing. In addition to the emulsion layer or layers and the support the roll film can and typically does additionally include a conventional antihalation layer interposed between the support and the nearest emulsion layer or coated on the opposite side of the support and/or a conventional photographic vehicle overcoat, typically including a matting agent and one or more surfactants, UV-absorbers and/or lubricants.

Black-and-white roll films usually rely on developed silver to produce a viewable image. It is well known to supplement or replace the silver image with a neutral density dye image, where the dye image is formed by the same techniques employed in color photography, except that instead of forming a single dye of a neutral hue it is usually more advantageous to form neutral hues by employing a combination of dyes.

Monochromatic color roll films can be constructed identically to the black-and-white roll films. In the simplest roll film construction dye image-forming compounds are introduced into the film during processing and developed silver is bleached to leave a dye image. It is usually more convenient to incorporate one or more dye image-forming compounds in the color roll film in reactive association with the emulsion layer or layers. Usually reactive association is achieved by incorporating the dye image providing compound in the emulsion layer or layers or in an adjacent layer, usually a contiguous adjacent layer.

Multicolor roll films differ from monochromatic color roll films in that at least three superimposed dye image forming layer units are coated on the film support. Typically a blue recording layer unit is provided to produce a viewable yellow dye image, a green recording layer unit is provided to produce a viewable magenta dye image, and a red recording layer unit is provided to produce a viewable cyan dye image. Each layer unit contains at least one emulsion layer. Commonly each layer unit contains two or three superimposed emulsion layers differing in sensitivity, with the more sensitive of adjacent emulsion layers within a layer unit being coated farther from the support. In addition to the layers noted, muticolor roll films include an interlayer containing an oxidized developing agent scavenger between adjacent layer units to avoid color contamination of the separate blue, green and red exposure records.

In multicolor films that are intended to be scanned for computer storage of image information as opposed to being used directly for producing a color print it is recognized that one, some or all of the layer units can, if desired, form "false color" dye images. Further, by eliminating silver bleaching it is possible to produce three separate exposure records using only two different image dyes. For example, the blue recording layer unit can form only a silver image, a yellow dye image, a magenta dye image, a cyan dye image or a near infrared dye image. If the blue recording layer unit does not form a dye image, then the green recording layer unit must form a dye image, which can be any hue noted above. If the blue recording layer unit does form a dye image, then the green recording layer unit can form only a silver image or a dye image of any hue other than that formed by the blue recording layer unit. Finally, if each of the blue and green recording layer units form dye images, the red recording layer unit can form only a silver image or a dye image of any hue not formed by the remaining layer units. If one of the blue and green recording layer units forms only a silver image, then the red recording layer unit must form a dye image.

In a specifically preferred form of the invention at least one emulsion layer in a color roll film according to the invention contains a high chloride {100} tabular grain emulsion and, in reactive association with the emulsion, at least one image-dye forming compound and an image modifying compound that contains a photographically useful group that is released by reaction of the modifying compound with oxidized developing agent. It is possible include a high chloride {100} tabular grain emulsion in only one emulsion layer of one layer unit, in all emulsion layers in only one layer unit, in one emulsion of each layer unit, or in more than one emulsion layer in each emulsion layer unit. In one specifically contemplated form of the invention all of the latent image forming emulsions in all of the layer units are high chloride {100} tabular grain emulsions. Any emulsions that are not high chloride {100} tabular grain emulsions can take any convenient conventional form known to be useful in roll films. In each occurrence of a high chloride {100} tabular grain emulsion it is preferably in reactive association with at least one image-dye forming compound and an image modifying compound that contains a photographically useful group that is released by reaction of the modifying compound with oxidized developing agent.

Following is a description of the terms "dye image-forming compound" and "photographically useful group-releasing compound", sometimes referred to simply as "PUG-releasing compound", as used herein.

A dye image-forming compound is typically a coupler compound, a dye redox releaser compound, a dye developer compound, an oxichromic developer compound, or a bleachable dye or dye precursor compound. Dye redox releaser, dye developer, and oxichromic developer compounds useful in color photographic elements that can be employed in image transfer processes are described in *The Theory of the Photographic Process*, 4th edition, T. H. James, editor, Macmillan, New York, 1977, Chapter 12, Section V, and in Section XXIII of *Research Disclosure*, Dec. 1989, Item 308119, published by Kenneth Mason Publications, Ltd., Dudley Annex, 12a North Street, Emsworth, Hampshire, P010 7DQ, United Kingdom. Dye compounds useful in color photographic elements employed in dye bleach processes are described in Chapter 12, Section IV, of *The Theory of the Photographic Process,* 4th edition.

Preferred dye image-forming compounds are coupler compounds, which react with oxidized color developing agents to form colored products, or dyes. A coupler compound contains a coupler moiety COUP, which is combined with the oxidized developer species in the coupling reaction to form the dye structure. A coupler compound can additionally contain a group, called a coupling-off group, that is attached to the coupler moiety by a bond that is cleaved upon reaction of the coupler compound with oxidized color developing agent. Coupling-off groups can be halogen, such as chloro, bromo, fluoro, and iodo, or organic radicals that are attached to the coupler moieties by atoms such as oxygen, sulfur, nitrogen, phosphorus, and the like.

A PUG-releasing compound is a compound that contains a photographically useful group and is capable of reacting with an oxidized developing agent to release said group. Such a PUG-releasing compound comprises a carrier moiety and a leaving group, which are linked by a bond that is cleaved upon reaction with oxidized developing agent. The leaving group contains the PUG, which can be present either as a preformed species, or as a blocked or precursor species that undergoes further reaction after cleavage of the leaving group from the carrier to produce the PUG. The reaction of an oxidized developing agent with a PUG-releasing compound can produce either colored or colorless products.

Carrier moieties (CAR) include hydroquinones, catechols, aminophenols, sulfonamidophenols, sulfonamidonaphthols, hydrazides, and the like that undergo cross-oxidation by oxidized developing agents. A preferred carrier moiety in a PUG-releasing compound is a coupler moiety COUP, which can combine with an oxidized color developer in the cleavage reaction to form a colored species, or dye. When the carrier moiety is a COUP, the leaving group is referred to as a coupling-off group. As described previously for leaving groups in general, the coupling-off group contains the PUG, either as a preformed species or as a blocked or precursor species. The coupler moiety can be ballasted or unballasted. It can be monomeric, or it can be part of a dimeric, oligomeric or polymeric coupler, in which case more than one group containing PUG can be contained in the coupler, or it can form part of a bis compound in which the PUG forms part of a link between two coupler moieties.

The PUG can be any group that is typically made available in a photographic element in an imagewise fashion. The PUG can be a photographic reagent or a photographic dye. A photographic reagent, which upon release further reacts with components in the photographic element as described herein, is a moiety such as a development inhibitor, a development accelerator, a bleach inhibitor, a bleach accelerator, an electron transfer agent, a coupler (for example, a competing coupler, a dye-forming coupler, or a development inhibitor releasing coupler, a dye precursor, a dye, a developing agent (for example, a competing developing agent, a dye-forming developing agent, or a silver halide developing agent), a silver complexing agent, a fixing agent, an image toner, a stabilizer, a hardener, a tanning agent, a fogging agent, an ultraviolet radiation absorber, an antifoggant, a nucleator, a chemical or spectral sensitizer, or a desensitizer.

The PUG can be present in the coupling-off group as a preformed species or it can be present in a blocked form or as a precursor. The PUG can be, for example, a preformed development inhibitor, or the development inhibiting function can be blocked by being the point of attachment to the carbonyl group bonded to PUG in the coupling-off group. Other examples are a preformed dye, a dye that is blocked to shift its absorption, and a leuco dye.

A PUG-releasing compound can be described by the formula CAR-(TIME)$_n$-PUG, wherein (TIME) is a linking or timing group, n is 0, 1, or 2, and CAR is a carrier moiety from which is released imagewise a PUG (when n is 0) or a PUG precursor (TIME)1-PUG or (TIME)2-PUG (when n is 1 or 2) upon reacting with oxidized developing agent. Subsequent reaction of (TIME)$_1$-PUG or (TIME)$_2$-PUG produces PUG.

Linking groups (TIME), when present, are groups such as esters, carbamates, and the like that undergo base-catalyzed cleavage, including intramolecular nucleophilic displacement, thereby releasing PUG. Where n is 2, the (TIME) groups can be the same or different. Suitable linking groups, which are also known as timing groups, are shown in U.S. Pat. Nos. 5,151,343; 5,051,345; 5,006,448; 4,409,323; 4,248,962; 4,847,185; 4,857,440; 4,857,447; 4,861,701; 5,021,322; 5,026,628, and 5,021,555, all incorporated herein by reference. Especially useful linking groups are p-hydroxphenylmethylene moieties, as illustrated in the previously mentioned U.S. Pat. Nos. 4,409,323; 5,151,343 and 5,006,448, and o-hydroxyphenyl substituted carbamate groups, disclosed in U.S. Pat. Nos. 5,151,343 and 5,021,555, which undergo intramolecular cyclization in releasing PUG. When TIME is joined to a COUP, it can be bonded at any of the positions from which groups are released from couplers by reaction with oxidized color developing agent. Preferably, TIME is attached at the coupling position of the coupler moiety so that, upon reaction of the coupler with oxidized color developing agent, TIME, with attached groups, will be released from COUP.

TIME can also be in a non-coupling position of the coupler moiety from which it can be displaced as a result of reaction of the coupler with oxidized color developing agent. In the case where TIME is in a non-coupling position of COUP, other groups can be in the coupling position, including conventional coupling off groups. Also, the same or different inhibitor moieties from those described in this invention can be used. Alternatively, COUP can have TIME and PUG in each of a coupling position and a non-coupling position. Accordingly, compounds useful in this invention can release more than one mole of PUG per mole of coupler.

TIME can be any organic group which will serve to connect CAR to the PUG moiety and which, after cleavage from CAR, will in turn be cleaved from the PUG moiety. This cleavage is preferably by an intramolecular nucleophilic displacement reaction of the type described in, for example, U.S. Pat. No. 4,248,962, or by electron transfer along a conjugated chain as described in, for example, U.S. Pat. No. 4,409,323.

As used herein, the term "intramolecular nucleophilic displacement reaction" refers to a reaction in which a nucleophilic center of a compound reacts directly, or indirectly through an intervening molecule, at another site on the compound, which is an electrophilic center, to effect displacement of a group or atom attached to the electrophilic center. Such compounds have both a nucleophilic group and an electrophilic group spatially related by the configuration of the molecule to promote reactive proximity. Preferably, the nucleophilic group and the electrophilic group are located in the compound so that a cyclic organic ring, or a transient cyclic organic ring, can be easily formed by an intramolecular reaction involving the nucleophilic center and the electrophilic center.

Useful timing groups are represented by the structure:

$$\text{Nu}-\text{LINK}-\text{E}$$

wherein:

Nu is a nucleophilic group attached to a position on CAR from which it will be displaced upon reaction of CAR with oxidized developing agent;

E is an electrophilic group attached to an inhibitor moiety as described and is displaceable therefrom by Nu after Nu is displaced from CAR; and LINK is a linking group for spatially relating Nu and E, upon displacement of Nu from CAR, to undergo an intramolecular nucleophilic displacement reaction with the formation of a 3- to 7-membered ring and thereby release the PUG moiety.

A nucleophilic group (Nu) is defined herein as a group of atoms one of which is electron rich. Such an atom is referred to as a nucleophilic center. An electrophilic group (E) is defined herein as a group of atoms one of which is electron deficient. Such an atom is referred to as an electrophilic center.

Thus, in PUG-releasing compounds as described herein, the timing group can contain a nucleophilic group and an electrophilic group, which groups are spatially related with respect to one another by a linking group so that, upon release from CAR, the nucleophilic center and the electrophilic center will react to effect displacement of the PUG moiety from the timing group. The nucleophilic center should be prevented from reacting with the electrophilic center until release from the CAR moiety, and the electrophilic center should be resistant to external attack, such as hydrolysis. Premature reaction can be prevented by attaching the CAR moiety to the timing group at the nucleophilic center or an atom in conjunction with a nucleophilic center, so that cleavage of the timing group and the PUG moiety from CAR unblocks the nucleophilic center and permits it to react with the electrophilic center, or by positioning the nucleophilic group and the electrophilic group so that they are prevented from coming into reactive proximity until release. The timing group can contain additional substituents, such as additional photographically useful groups (PUGs), or precursors thereof, which may remain attached to the timing group or be released.

It will be appreciated that, in the timing group, for an intramolecular reaction to occur between the nucleophilic group and the electrophilic group, the groups should be spatially related after cleavage from CAR so that they can react with one another. Preferably, the nucleophilic group and the electrophilic group are spatially related within the timing group so that the intramolecular nucleophilic displacement reaction involves the formation of a 3- to 7-membered ring, most preferably a 5- or 6-membered ring.

It will be further appreciated that for an intramolecular reaction to occur in the aqueous alkaline environment encountered during photographic processing, the thermodynamics should be such and the groups be so selected that an overall free energy decrease results upon ring closure, forming the bond between the nucleophilic group and the electrophilic group, and breaking the bond between the electrophilic group and the PUG. Not all possible combinations of nucleophilic group, linking group, and electrophilic group will yield a thermodynamic relationship favorable to breaking of the bond between the electrophilic group and the PUG moiety. However, it is within the skill of the art to select appropriate combinations taking the above energy relationships into account.

Representative Nu groups contain electron rich oxygen, sulfur and nitrogen atoms. Representative E groups contain electron deficient carbonyl, thiocarbonyl, phosphonyl and thiophosphonyl moieties. Other useful Nu and E groups will be apparent to those skilled in the art.

The linking group can be an acyclic group such as alkylene, for example, methylene, ethylene or propylene, or a cyclic group such as an aromatic group, such as phenylene or naphthylene, or a heterocyclic group, such as furan, thophene, pyridine, quinoline or benzoxazine. Preferably, LINK is alkylene or arylene. The groups Nu and E are attached to LINK to provide, upon release of Nu from CAR, a favorable spatial relationship for nucleophilic attack of the nucleophilic center in Nu on the electrophilic center in E. When LINK is a cyclic group, Nu and E can be attached to the same or adjacent rings. Aromatic groups in which Nu and E are attached to adjacent ring positions are particularly preferred LINK groups.

TIME can be unsubstituted or substituted. The substituents can be those which will modify the rate of reaction, diffusion, or displacement, such as halogen, including fluoro, chloro, bromo, or iodo, nitro, alkyl of 1 to 20 carbon atoms, acyl, such as carboxy, carboxyalkyl, alkoxycarbonyl, alkoxycarbonamido, sulfoalkyl, alkanesulfonamido, and alkylsulfonyl, solubilizing groups, ballast groups and the like, or they can be substituents which are separately useful in the photographic element, such as a stabilizer, an antifoggant, a dye (such as a filter dye or a solubilized masking dye) and the like. For example, solubilizing groups will increase the rate of diffusion; ballast groups will decrease the rate of diffusion; electron withdrawing groups will decrease the rate of displacement of the PUG.

As used herein, the term "electron transfer down a conjugated chain" is understood to refer to transfer of an electron along a chain of atoms in which alternate single bonds and double bonds occur. A conjugated chain is understood to have the same meaning as commonly used in organic chemistry. This further includes TIME groups capable of undergoing fragmentation reactions where the number of double bonds is zero. Electron transfer down a conjugated chain is described in, for example, U.S. Pat. No. 4,409,323.

As previously described, more than one sequential TIME moiety can be usefully employed. Useful TIME moieties can have a finite half-life or an extremely short half-life. The half-life is controlled by the specific structure of the TIME moiety, and may be chosen so as to best optimize the photographic function intended.

TIME moiety half-lives of from less than 0.001 second to over 10 minutes are known in the art. TIME moieties having a half-life of over 0.1 second are often preferred for use in PUG-releasing compounds that yield development inhibitor moieties, although use of TIME moieties with shorter half-lives to produce development inhibitor moieties is known in the art. The TIME moiety may either spontaneously liberate a PUG after being released from CAR, or may liberate PUG only after a further reaction with another species present in a process solution, or may liberate PUG during contact of the photographic element with a process solution.

Following is a listing of patents and publications that describe representative coupler compounds that contain COUP groups useful in the invention:

Couplers which form cyan dyes upon reaction with oxidized color developing agents are described in such representative patents and publications as: U.S. Pat. Nos. 2,772,162; 2,895,826; 3,002,836; 3,034,892; 2,474,293; 2,423,730; 2,367,531; 3,041,236; 4,333,999, "Farbkuppler-eine Literaturubersicht," published in Agfa Mitteilungen, Band III, pp. 156-175 (1961), and Section VII D of *Research Disclosure*, Item 308119, Dec. 1989. Preferably such couplers are phenols and naphthols.

Couplers which form magenta dyes upon reaction with oxidized color developing agent are described in such representative patents and publications as: U.S. Pat. Nos. 2,600,788; 2,369,489; 2,343,703; 2,311,082; 3,152,896; 3,519,429; 3,062,653; 2,908,573, "Farbkuppler-eine Literaturubersicht," published in Agfa Mitteilungen, Band III, pp. 126-156 (1961), and Section VII D of Research Disclosure, Item 308119, Dec. 1989. Preferably such couplers are pyrazolones or pyrazolotriazoles.

Couplers which form yellow dyes upon reaction with oxidized and color developing agent are described in such representative patents and publications as: U.S. Pat. Nos. 2,875,057; 2,407,210;.3,265,506; 2,298,443; 3,048,194; 3,447,928, "Farbkuppler-eine Literaturubersicht," published in Agfa Mitteilungen, Band III, pp. 112-126 (1961), and Section VII D of *Research Disclosure*, Item 308119, Dec. 1989. Preferably such couplers are acylacetamides, such as benzoylacetamides and pivaloylacetamides.

Couplers which form colorless products upon reaction with oxidized color developing agent are described in such representative patents as: U.K. Patent No. 861,138; U.S. Pat. Nos. 3,632,345; 3,928,041; 3,958,993 and 3,961,959. Preferably, such couplers are cyclic carbonyl-containing compounds which react with oxidized color developing agents but do not form dyes.

PUG groups that are useful in the present invention include, for example:

1. PUG's which form development inhibitors upon release

PUG's which form development inhibitors upon release are described in such representative patents as U.S. Pat. Nos. 3,227,554; 3,384,657; 3,615,506; 3,617,291; 3,733,201 and U.K. Pat. No. 1,450,479. Useful development inhibitors are iodide and heterocyclic compounds such as mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, oxadiazoles, benzotriazoles, benzodiazoles, oxazoles, thiazoles, diazoles, triazoles, thiadiazoles, oxathiazoles, thiatriazoles, tetrazoles, benzimidazoles, indazoles, isoindazoles, 1 mercaptooxazoles, mercaptothiadiaoles, mercaptothiazoles, mercaptotriazoles, mercaptooxadiazoles, mercaptodiazoles, mercaptooxathiazoles, tellurotetrazoles, or benzisodiazoles. Structures of typical development inhibitor moieties are:

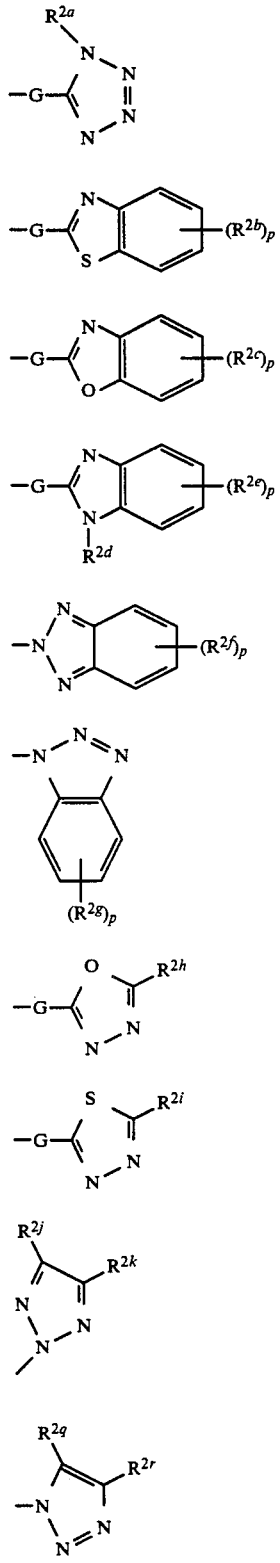

-continued

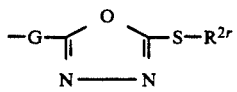

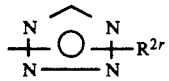

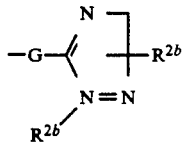

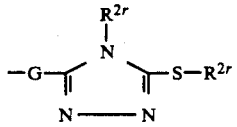

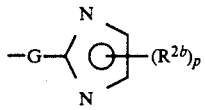

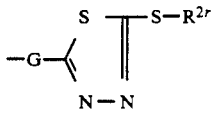

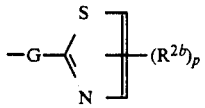

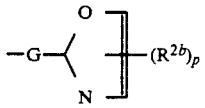

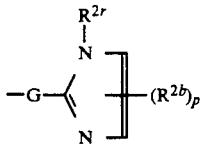

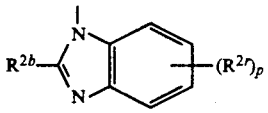

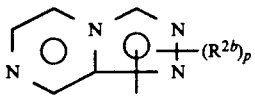

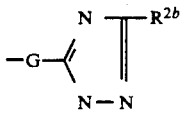

-continued

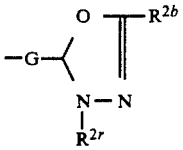

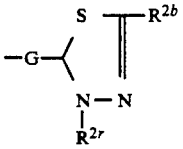

wherein:

G is S, Se, or Te, S being preferred; and wherein $R^{2a}$, $R^{2d}$, $R^{2h}$, $R^{2i}$, $R^{2j}$, $R^{2k}$, $R^{2q}$ and $R^{2r}$ are individually hydrogen, substituted or unsubstituted alkyl, straight chained or branched, saturated or unsaturated, of 1 to 8 carbon atoms such as methyl, ethyl, propyl, butyl, 1-ethylpentyl, 2-ethoxyethyl, t-butyl or i-propyl; alkoxy or alkylthio, such as methoxy, ethoxy, propoxy, butoxy, octyloxy, methylthio, ethylthio, propylthio, butylthio, or octylthiol; alkyl esters such as $CO_2CH_3$, $CO_2C_2H_5$, $CO_2C_3H_7$, $CO_2C_4H_9$, $CH_2CO_2CH_3$, $CH_2CO_2C_2H_5$, $CH_2CO_2C_3H_7$, $CH_2CO_2C_4H_9$, $CH_2CH_2CO_2CH_3$, $CH_2CH_2CO_2C_2H_5$, $CH_2CH_2CO_2C_3H_7$, and $CH_2CH_2CO_2C_4H_9$; aryl or heterocyclic esters such as $CO_2R^{2s}$, $CH_2CO_2R^{2s}$, and $CH_2CH_2CO_2R^{2s}$ wherein $R^{2s}$ is substituted or unsubstituted aryl, or a substituted or unsubstituted heterocyclic group; substituted or unsubstituted benzyl, such as methoxy-, chloro-, nitrohydroxy-, carboalkoxy-, carboaryloxy-, keto-, sulfonyl-, sulfenyl-, sulfinyl-, carbonamido-, sulfonamido-, carbamoyl-, or sulfamoyl-substituted benzyl; substituted or unsubstituted aryl, such as phenyl, naphthyl, or chloro-, methoxy-, hydroxy-, nitro-, hydroxy-, carboalkoxy-, carboaryloxy-, keto-, sulfonyl-, sulfenyl-, sulfinyl-, carbonamido-, sulfonamido-, carbamoyl-, or sulfamoyl-substituted phenyl. These substituents may be repeated more than once as substituents. $R^{2a}$, $R^{2d}$, $R^{2h}$, $R^{2i}$, $R^{2j}$, $R^{2k}$, $R^{2q}$ and $R^{2r}$ may also be a substituted or unsubstituted heterocyclic group selected from groups such as pyridine, pyrrole, furan, thiophene, pyrazole, thiazole, imidazole, 1,2,4-triazole, oxazole, thiadiazole, indole, benzthiophene, benzimidazole, benzoxazole and the like wherein the substitutents are as selected from those mentioned previously.

$R^{2b}$, $R^{2c}$, $R^{2e}$, $R^{2f}$, and $R^{2g}$, are as described for $R^{2a}$, $R^{2d}$, $R^{2h}$, $R^{2i}$, $R^{2j}$, $R^{2k}$, $R^{2q}$ and $R^{2r}$; or, are individually one or more halogens such as chloro, fluoro or bromo and p is 0, 1, 2, 3 or 4.

2. PUGs which are dyes, or form dyes upon release

Suitable dyes and dye precursors include azo, azomethine, azophenol, azonaphthol, azoaniline, azopyrazolone, indoaniline, indophenol, anthraquinone, triarylmethane, alizarin, nitro, quinoline, indigoid and phthalocyanine dyes or precursors of such dyes such as leuco dyes, tetrazolium salts or shifted dyes. These dyes can be metal complexed or metal complexable. Representative patents describing such dyes are U.S. Pat. Nos. 3,880,658; 3,931,144; 3,932,380; 3,932,381; 3,942,987, and 4,840,884. Preferred dyes and dye precursors are azo, azomethine, azophenol, azonaphthol, azoaniline, and indoaniline dyes and dye precursors. Structures of typical dyes and dye precursors are:

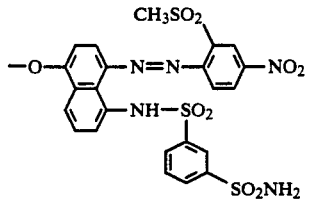

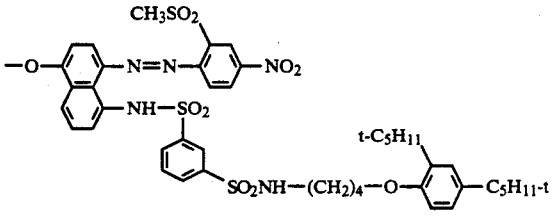

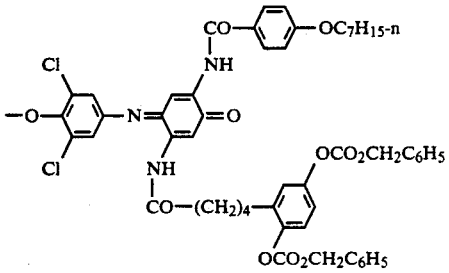

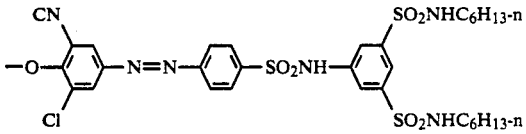

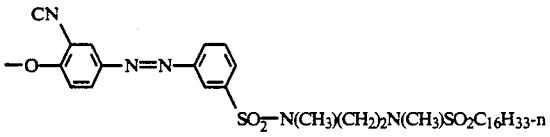

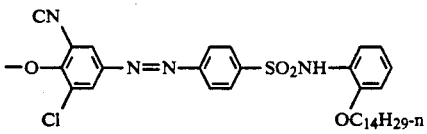

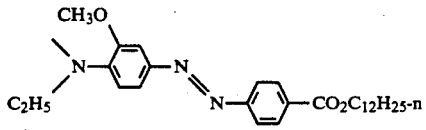

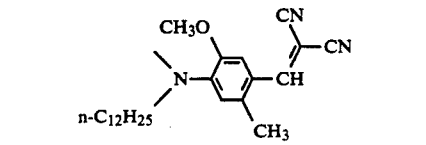

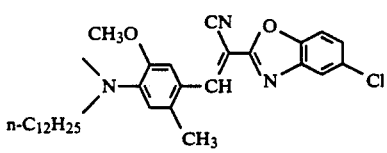

-continued

Suitable azo, azamethine and methine dyes are represented by the formulae in U.S. Pat. No. 4,840,884, col. 8, lines 1-70. Dyes can be chosen from those described, for example, in J. Fabian and H. Hartmann, *Light Absorption of Organic Colorants*, published by Springer-Verlag Co., but are not limited thereto. Typical dyes are azo dyes having a radical represented by the following formula:

$$-X-Y-N=N-Z$$

wherein X is a hetero atom such as an oxygen atom, a nitrogen atom and a sulfur atom, Y is an atomic group containing at least one unsaturated bond having a conjugated relation with the azo group, and linked to X through an atom constituting the unsaturated bond, Z is an atomic group containing at least one unsaturated bond capable of conjugating with the azo group, and the number of carbon atoms contained in Y and Z is 10 or more.

Furthermore, Y and Z are each preferably an aromatic group or an unsaturated heterocyclic group. As the aromatic group, a substituted or unsubstituted phenyl or naphthyl group is preferred. As the unsaturated heterocyclic group, a 4- to 7-membered heterocyclic group containing at least one hetero atom selected from a nitrogen atom, a sulfur atom and an oxygen atom is preferred, and it may be part of a benzene-condensed ring system. The heterocyclic group means groups having a ring structure such as pyrrole, thiophene, furan, imidazole, 1,2,4-triazole, oxazole, thiadiazole, pyridine, indole, benzthiophene, benzimidazole, or benzoxazole.

Y may be substituted with other groups as well as X and the azo groups. Examples of such other groups include an aliphatic or alicyclic hydrocarbon group, an aryl group, an acyl group, an alkoxycarbonyl group, an aryloxycarbonyl group, an acylamino group, an alkylthio, an arylthio group, a heterocyclic group, a sulfonyl group, a halogen atom, a nitro group, a nitroso group, a cyano group, —COOM (M=H, an alkali metal atom or $NH_4$), a hydroxyl group, a sulfonamido group, an alkoxy group, an aryloxy group, and an acyloxy group. In addition, a carbamoyl group, an amino group, a ureido group, a sulfamoyl group, a carbamoylsulfonyl group and a hydrazino group are included. These groups may be further substituted with a group such as those disclosed above repeatedly, for example once or twice.

In the case where Z is a substituted aryl group or a substituted unsaturated heterocyclic group, groups listed as substituents for Y can be used in the same manner for Z.

When Y and Z contain an aliphatic or alicyclic hydrocarbon moiety as a substituent, any substituted or unsubstituted, saturated, unsaturated or straight or branched groups having, in the case of an aliphatic hydrocarbon moiety, from 1 to 32, preferably from 1 to 20 carbon atoms, and, in the case of an alicyclic hydrocarbon moiety having from 5 to 32, preferably from 5 to 20 carbon atoms, can be used. When substitution is carried out repeatedly, the uppermost number of carbon atoms of the thus obtained substituent is preferably 32.

When Y and Z contain an aryl moiety as a substituent, the number of carbon atoms of the moiety is generally from 6 to 10, and preferably it is a substituted or unsubstituted phenyl group. In the present invention, groups in the formulas shown hereinabove and hereinafter are defined as follows:

An acyl group, a carbamoyl group, an amino group, a ureido group, a sulfamoyl group, a carbamoylsulfonyl group, an urethane group, a sulfonamido group, a hydrazino group, and the like represents unsubstituted groups thereof and substituted groups thereof which are substituted with an aliphatic hydrocarbon group, an alicyclic hydrocarbon group or an aryl group to form mono-, di-, or tri-substituted groups; an acylamino group, a sulfonyl group, a sulfonamido group, an acyloxy group and the like each is aliphatic alicyclic, and aromatic group.

Typical examples of this group represented by formula for azo dyes shown above are contained in, for example, U.S. Pat. Nos. 4,424,156 and 4,857,447, column 6, lines 35–70.

3. PUG's which are couplers

Couplers released can be nondiffusible color-forming couplers, non-color forming couplers or diffusible competing couplers. Representative patents and publications describing competing couplers are: "On the Chemistry of White Couplers," by W. Puschel, Agfa-Gevaert AG Mitteilungen and der Forschungs-Laboratorium der Agfa-Gevaert AG, Springer Verlag, 1954, pp. 352–367; U.S. Pat. Nos. 2,998,314; 2,808,329; 2,689,793; 2,742,832; German Patent No. 1,168,769 and British Patent No. 907,274. Structures of useful competing couplers are:

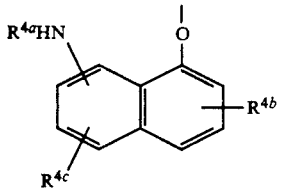

where $R^{4a}$ is hydrogen or alkylcarbonyl, such as acetyl, and $R^{4b}$ and $R^{4c}$ are individually hydrogen or a solubilizing group, such as sulfo, aminosulfonyl, and carboxy

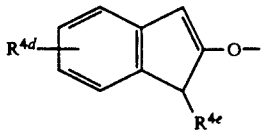

where $R^{4d}$ is as defined above and $R^{4e}$ is halogen, aryloxy, arylthio, or a development inhibitor, such as a mercaptotetrazole, such as phenylmercaptotetrazole or ethylmercaptotetrazole.

4. PUG's which form developing agents

Developing agents released can be color developing agents, black-and-white developing agents or cross-oxidizing developing agents. They include aminophenols, phenylenediamines, hydroquinones and pyrazolidones. Representative patents are: U.S. Pat. Nos. 2,193,015; 2,108,243; 2,592,364; 3,656,950; 3,658,525; 2,751,297; 2,289,367; 2,772,282; 2,743,279; 2,753,256 and 2,304,953.

Structures of suitable developing agents are:

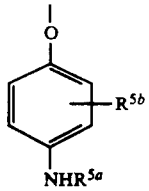

where $R^{5a}$ is hydrogen or alkyl of 1 to 4 carbon atoms and $R^{5b}$ is hydrogen or one or more halogen such as chloro or bromo; or alkyl of 1 to 4 carbon atoms such as methyl, ethyl or butyl groups.

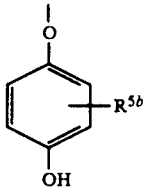

where $R^{5b}$ is as defined above.

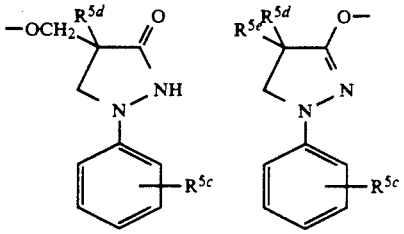

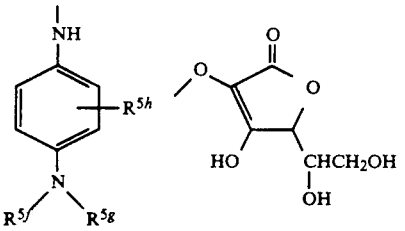

where $R^{5c}$ is hydrogen or alkyl of 1 to 4 carbon atoms and $R^{5d}$, $R^{5e}$, $R^{5f}$, $R^{5g}$, and $R^{5h}$ are individually hydrogen, alkyl of 1 to 4 carbon atoms such as methyl or ethyl; hydroxyalkyl of 1 to 4 carbon atoms such as hydroxymethyl or hydroxyethyl or sulfoalkyl containing 1 to 4 carbon atoms.

5. PUG's which are bleach inhibitors

Representative patents are U.S. Pat. Nos. 3,705,801; 3,715,208; and German OLS No. 2,405,279. Structures of typical bleach inhibitors are:

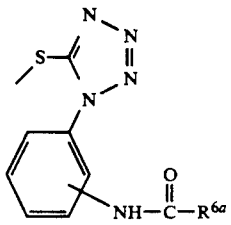

-continued

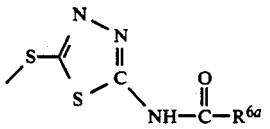

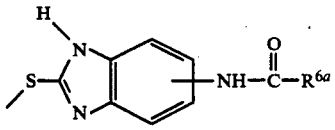

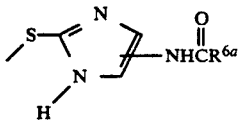

where $R^{6a}$ is alkyl or aryl or 6 to 20 carbon atoms.

6. PUG's which are bleach accelerators

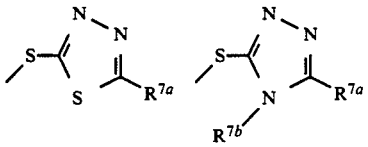

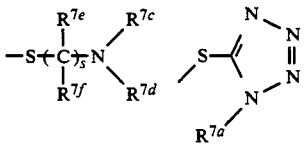

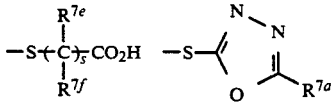

wherein $R^{7a}$ is hydrogen, alkyl, such as methyl, ethyl, and butyl, alkoxy, such as ethoxy and butoxy, or alkylthio, such as ethylthio and butylthio, for example containing 1 to 6 carbon atoms, and which may be unsubstituted or substituted; $R^{7b}$ is hydrogen, substituted or unsubstituted alkyl, or substituted or unsubstituted aryl, such as phenyl; $R^{7c}$, $R^{7d}$, $R^{7e}$ and $R^{7f}$ are individually hydrogen, substituted or unsubstituted alkyl, or substituted or unsubstituted aryl, such as straight chained or branched alkyl containing 1 to 6 carbon atoms, for example methyl, ethyl and butyl; s is 1 to 6; $R^{7c}$ and $R^{7d}$, or $R^{7e}$ and $R^{7f}$ together may form a 5-, 6-, or 7-membered ring.

It is often preferred for $R^{7a}$ and $R^{7b}$ to be solubilizing functions by the structure:

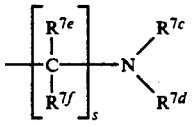

or

-continued

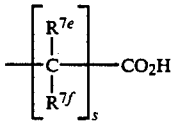

where $R^{7c}$, $R^{7d}$, $R^{7e}$, $R^{7f}$, and s are as defined above.

Other PUGs representative of bleach accelerators, can be found in for example U.S. Pat. Nos. 4,705,021; 4,912,024; 4,959,299; 4,705,021; 5,063,145, columns 21–22, lines 1–70; and EP Patent No. 0,193,389.

7. PUGs which are electron transfer agents (ETAs)

ETAs useful in the present invention are 1-aryl-3-pyrazolidinone derivatives which, once released, become active electron transfer agents capable of accelerating development under processing conditions used to obtain the desired dye image.

The electron transfer agent pyrazolidinone moieties which have been found to be useful in providing development acceleration function are derived from compounds generally of the type described in U.S. Pat. Nos. 4,209,580;, 4,463,081; 4,471,045; and 4,481,287 and in published Japanese patent application No. 62-123,172. Such compounds comprise 3-pyrazolidinone structures having an unsubstituted or substituted aryl group in the 1-position. Also useful are the combinations disclosed in U.S. Pat. No. 4,859,578. Preferably these compounds have one or more alkyl groups in the 4- or 5-positions of the pyrazolidinone ring.

Electron transfer agents suitable for use in this invention are represented by the following two formulas:

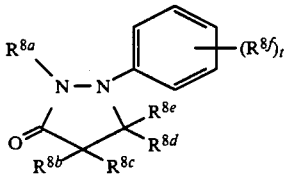

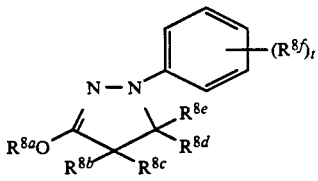

wherein:

$R^{8a}$ is hydrogen;

$R^{8b}$ and $R^{8c}$ each independently represents hydrogen, substituted or unsubstituted alkyl having from 1 to about 8 carbon atoms (such as hydroxyalkyl), carbamoyl, or substituted or unsubstituted aryl having from 6 to about 10 carbon atoms;

$R^{8d}$ and $R^{8e}$ each independently represents hydrogen, substituted or unsubstituted alkyl having from 1 to about 8 carbon atoms or substituted or unsubstituted aryl having from 6 to about 10 carbon atoms;

$R^{8f}$, which may be present in the ortho, meta or para positions of the benzene ring, represents halogen, substituted or unsubstituted alkyl having from 1 to about 8 carbon atoms, or substituted or unsubstituted alkoxy having from 1 to about 8 carbon atoms, or sulfonamido, and when m is greater than 1, the $R^{8f}$ substituents can be the same or different or can be taken together to form a carbocyclic or a heterocyclic ring, for example a benzene or an alkylenedioxy ring; and t is 0 or 1 to 3.

When $R^{8b}$ and $R^{8c}$ groups are alkyl, it is preferred that they comprise from 1 to 3 carbon atoms. When $R^{8b}$ and $R^{8c}$ represent aryl, they are preferably phenyl.

$R^{8d}$ and $R^{8e}$ are preferably hydrogen.

When $R^{8f}$ represents sulfonamido, it may be, for example, methanesulfonamido, ethanesulfonamido or toluenesulfonamido.

8. PUGs which are development inhibition redox releasers (DIRRs)

DIRRs useful in the present invention include hydroquinone, catechol, pyrogallol, 1,4-naphthohydroquinone, 1,2-naphthoquinone, sulfonamidophenol, sulfonamidonaphthol and hydrazide derivatives which, once released, become active inhibitor redox releasing agents that are then capable of releasing a development inhibitor upon reaction with a nucleophile such as hydroxide ion under processing conditions used to obtain the desired dye image. Such redox releasers are represented by formula (II) in U.S. Pat. No. 4,985,336; col. 3, lines 10 to 25 and formulas (III) and (IV) col.14, line 54 to col. 17, line 11. Other redox releasers can be found in European Patent Application No. 0,285,176. Typical redox releasers include the following:

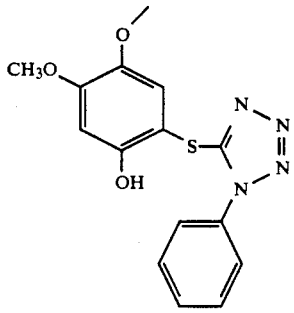

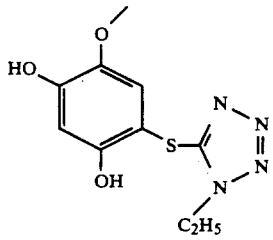

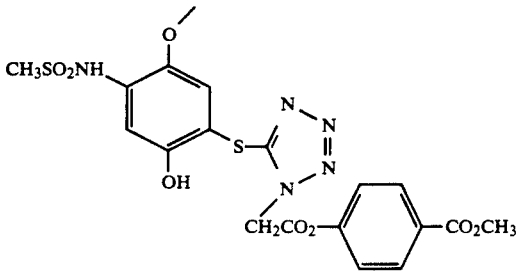

-continued

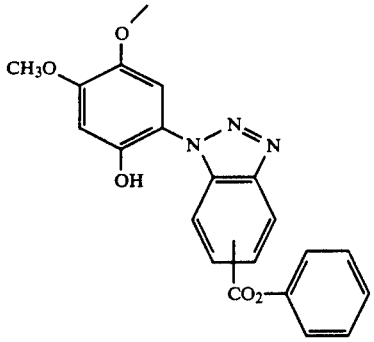

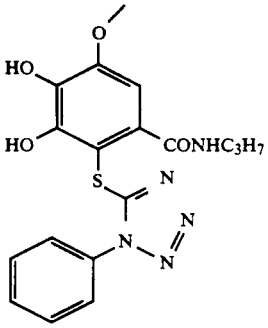

Couplers containing other suitable redox releasers can be fond in for example, U.S. Pat. No. 4,985,336; cols. 17 to 62.

The following formula represents a 5-, 6-, or 7-membered nitrogen-containing unsaturated heterocyclic group which has 2 to 6 carbon atoms, which is connected to the carrier moiety through the nitrogen atom and which has a sulfonamido group and a development inhibitor group or a precursor thereof, on the ring carbon atoms. Z represents an atomic group necessary to form a 5-, 6-, or 7-membered nitrogen-containing unsaturated heterocyclic ring containing 2 to 6 carbon atoms together with the nitrogen atom; DI represents a development inhibitor group; and R represents a substituent; and DI is connected to a carbon atom of the heterocyclic ring represented by Z through a hetero atom included therein, and the sulfonamido group is connected to a carbon atom of the heterocyclic ring represented by Z, provided that the nitrogen atom through which the heterocyclic group is connected to the carrier moiety and the nitrogen atom in the sulfonamido group are positioned so as to satisfy the Kendall-Pelz rule as described, for example, in *The Theory Of The Photographic Process,* 4th edition, pp. 298–325.

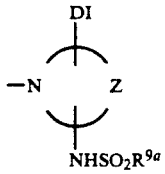

The group represented by the above formula is a group capable of being oxidized by the oxidation product of a developing agent. More specifically, the sulfonamido group thereon is oxidized to a sulfonylimino group from which a development inhibitor is cleaved.

Specific examples of the just described development inhibiting redox releasers are as follows:

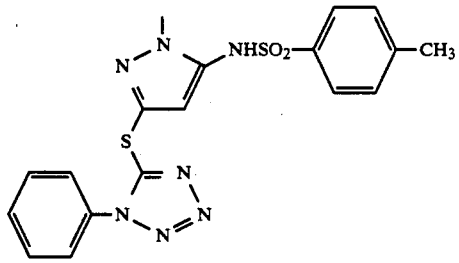

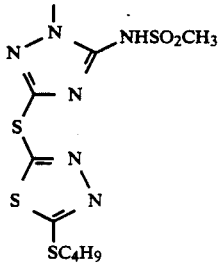

Other examples of development inhibiting redox releasers can be found in the couplers represented in for example European Patent Application 0,362,870; page 13, line 25 to page 29, line 20.

In a preferred embodiment, the PUG-releasing compound is a development inhibitor-releasing (DIR) compound. These DIR compounds may be incorporated in the same layer as the emulsions of this invention, in reactive association with this layer or in a different layer of the photographic material, all as known in the art.

These DIR compounds may be among those classified as "diffusable," meaning that they enable release of a highly transportable inhibitor moiety, or they may be classified as "non-diffusible", meaning that they enable release of a less transportable inhibitor moiety. The DIR compounds may comprise a timing or linking group as known in the art.

The inhibitor moiety of the DIR compound may be unchanged as the result of exposure to photographic processing solution. However, the inhibitor moiety may change in structure and effect in the manner disclosed in U.K. Patent No. 2,099,167; European Patent Application 167,168; Japanese Kokai 205150/83; or U.S. Pat. No. 4,782,012 as the result of photographic processing.

When the DIR compounds are dye-forming couplers, they may be incorporated in reactive association with complementary color sensitized silver halide emulsions, as for example a cyan dye-forming DIR coupler with a red sensitized emulsion or in a mixed mode, for example, a yellow dye-forming DIR coupler with a green sensitized emulsion, all known in the art.

The DIR compounds may also be incorporated in reactive association with bleach accelerator-releasing couplers, as disclosed in U.S. Pat. Nos. 4,912,024 and 5,135,839, and with the bleach accelerator-releasing compounds disclosed in U.S. Pat. Nos. 4,865,956 and 4,923,784, all incorporated herein by reference.

Specific DIR compounds useful in the practice of this invention are disclosed in the above cited references, in commercial use, and in the examples demonstrating the practice of this invention contained herein.

The dye image-forming compounds and PUG-releasing compounds can be incorporated in photographic elements of the present invention by means and processes known in the photographic art. A photographic element in which the dye image-forming and PUG-releasing compounds are incorporated can be a monocolor element comprising a support and a single silver halide emulsion layer, or it can be a multicolor, multilayer element comprising a support and multiple silver halide emulsion layers. The above described compounds can be incorporated in at least one of the silver halide emulsion layers and/or in at least one other layer, such as an adjacent layer, where they are in reactive association with the silver halide emulsion layer and are thereby able to react with the oxidized developing agent produced by development of silver halide in the emulsion layer. Additionally, the silver halide emulsion layers and other layers of the photographic element can contain addenda conventionally contained in such layers.

A typical multicolor, multilayer photographic element can comprise a support having thereon a red-sensitized silver halide emulsion unit having associated therewith a cyan dye image-forming compound, a green-sensitized silver halide emulsion unit having associated therewith a magenta dye image-forming compound, and a blue-sensitized silver halide emulsion unit having associated therewith a yellow dye image-forming compound. Each silver halide emulsion unit can be composed of one or more layers, and the various units and layers can be arranged in different locations with respect to one another, as known in the prior art and as illustrated by layer order formats hereinafter described.

In an element of the invention, a layer or unit affected by PUG can be controlled by incorporating in appropriate locations in the element a layer that confines the action of PUG to the desired layer or unit. Thus, at least one of the layers of the photographic element can be, for example, a scavenger layer, a mordant layer, or a barrier layer. Examples of such layers are described in, for example, U.S. Pat. Nos. 4,055,429; 4,317,892; 4,504,569; 4,865,946; and 5,006,451. The element can also contain additional layers such as antihalation layers, filter layers and the like. The element typically will have a total thickness, excluding the support, of from 5 to 30 μm. Thinner formulations of 5 to about 25 μm are generally preferred since these are known to provide improved contact with the process solutions. For the same reason, more swellable film structures are likewise preferred. Further, this invention may be particularly useful with a magnetic recording layer such as those described in *Research Disclosure*, Item 34390, Nov. 1992, p. 869.

In the following discussion of suitable materials for use in the elements of this invention, reference will be made to the previously mentioned *Research Disclosure*, Dec. 1989, Item 308119, the disclosures of which are incorporated herein by reference.

Suitable dispersing media for the emulsion layers and other layers of elements of this invention are described in Section IX of *Research Disclosure*, Dec. 1989, Item 308119, and publications therein.

In addition to the compounds described herein, the elements of this invention can include additional dye image-forming compounds, as described in Sections VII A-E and H, and additional PUG-releasing compounds, as described in Sections VII F and G of *Research Disclo-*

*sure*, Dec. 1989, Item 308119, and the publications cited therein.

The elements of this invention can contain brighteners (Section V), antifoggants and stabilizers (Section VI), antistain agents and image dye stabilizers (Section VII I and J), light absorbing and scattering materials (Section VIII), hardeners (Section X), coating aids (Section XI), plasticizers and lubricants (Section XII), antistatic agents (Section XIII), matting agents (Section XVI), and development modifiers (Section XXI), all in *Research Disclosure*, Dec. 1989, Item 308119.

The elements of the invention can be coated on a variety of supports, as described in Section XVII of *Research Disclosure*, Dec. 1989, Item 308119, and references cited therein.

The elements of this invention can be exposed to actinic radiation, typically in the visible region of the spectrum as described in greater detail hereinafter, to form a latent image and then processed to form a visible dye image, as described in Sections XVIII and XIX of *Research Disclosure*, Dec. 1989, Item 308119. Typically, processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N--(methanesulfonamido)ethylaniline sulfate hydrate, 4-amino-3-methyl-N-ethyl-N--hydroxyethylaniline sulfate, 4-amino-3--(methansulfonamido)ethyl-N,N-diethylaniline hydrochloride, and 4-amino-N-ethyl-N-(2-methoxyethyl)m-toluidine di-p-toluenesulfonic acid.

With negative-working silver halide, the processing step described above provides a negative image. The described elements are preferably processed in the Kodak Flexicolor TM C-41 color process as described in, for example, the British Journal of Photography Annual of 1988, pages 196–198. To provide a positive (or reversal) image, the color development step can be preceded by development with a non-chromogenic developing agent to develop exposed silver halide but not form dye, and then uniform fogging of the element to render unexposed silver halide developable. The Kodak E-6 Process is a typical reversal process.

Development is followed by the conventional steps of bleaching, fixing, or bleach-fixing, to remove silver or silver halide, washing, and drying.

In the following tables are shown compounds useful in the practice of the present invention.

Table I contains the formulas of typical dye image-forming coupler compounds.

Table II contains the formulas of typical PUG-releasing compounds that release development inhibitor groups or precursors thereof. In Table III are shown the formulas of representative examples of other kinds of PUG-releasing compounds.

Table IV provides the formulas of miscellaneous exemplary photographic compounds that can be used in elements of the invention.

TABLE I

Typical Dye Image-Forming Coupler Compounds

C-1

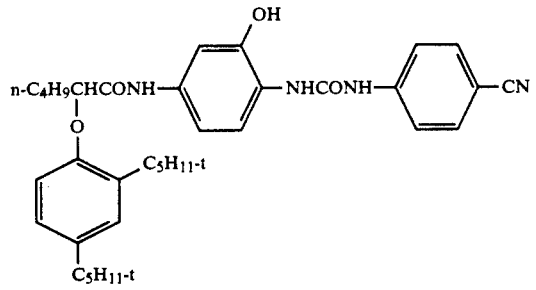

C-2

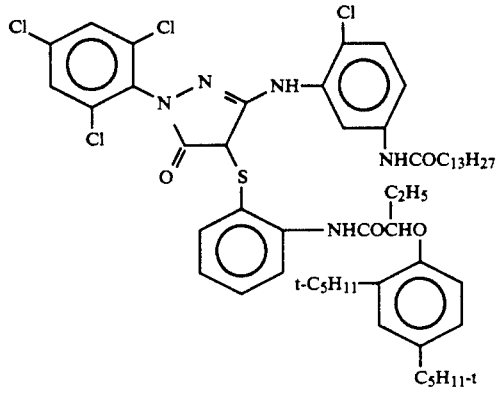

TABLE I-continued
Typical Dye Image-Forming Coupler Compounds
C-3
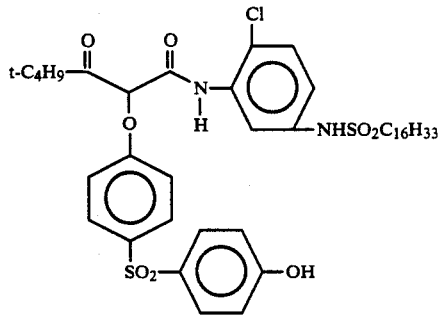
C-4
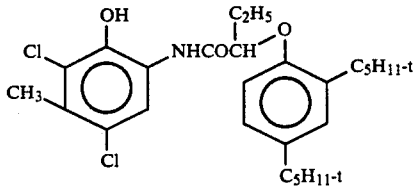
C-5
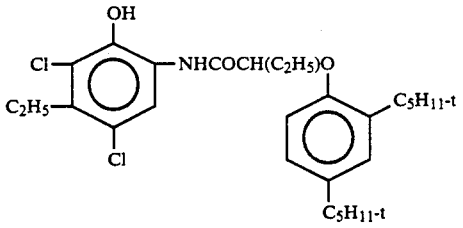
C-6
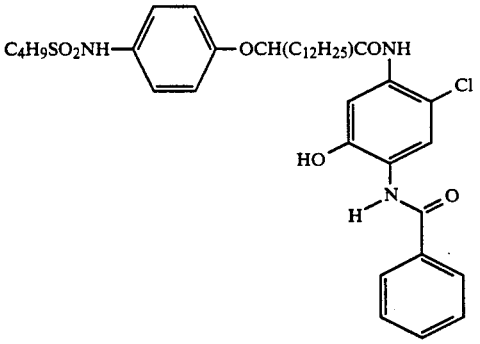
C-7
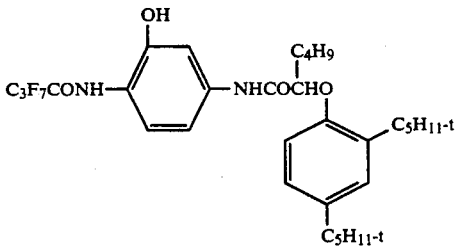

TABLE I-continued
Typical Dye Image-Forming Coupler Compounds
C-8
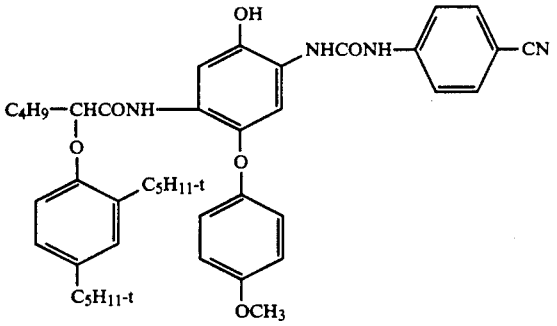
C-9
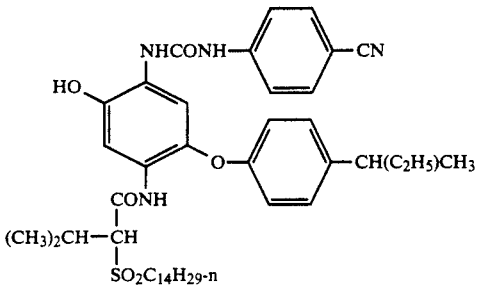
C-10
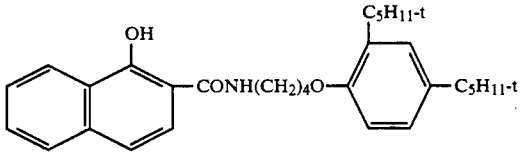
C-11
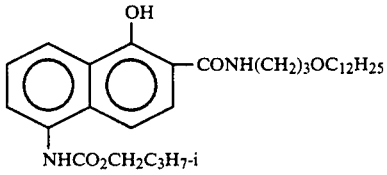
C-12
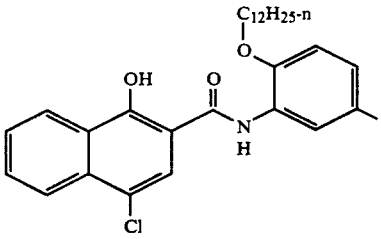
C-13
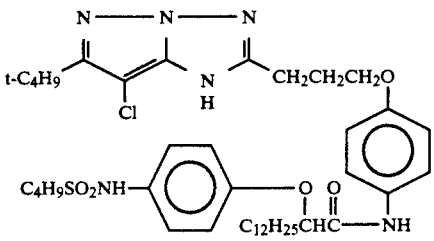

TABLE I-continued
Typical Dye Image-Forming Coupler Compounds
C-14
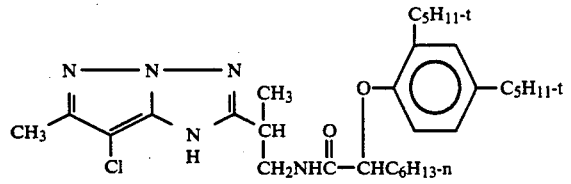
C-15
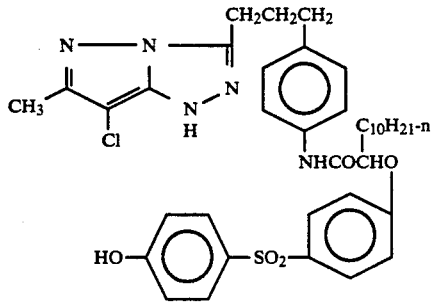
C-16
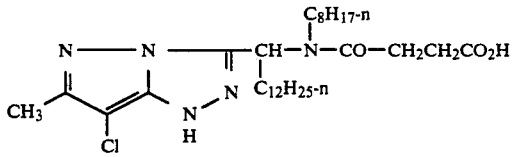
C-17
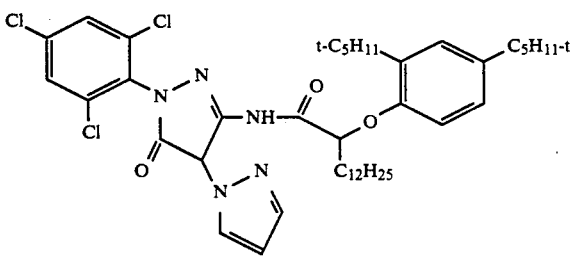
C-18
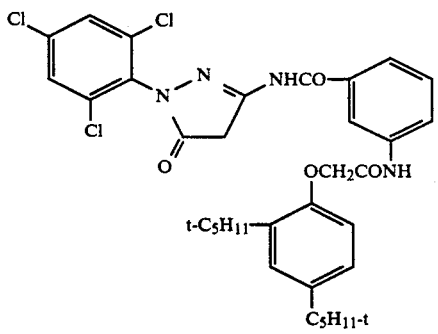
C-19
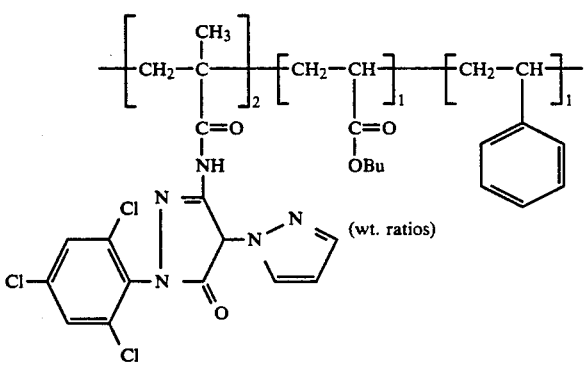
(wt. ratios)

TABLE I-continued
Typical Dye Image-Forming Coupler Compounds
C-20
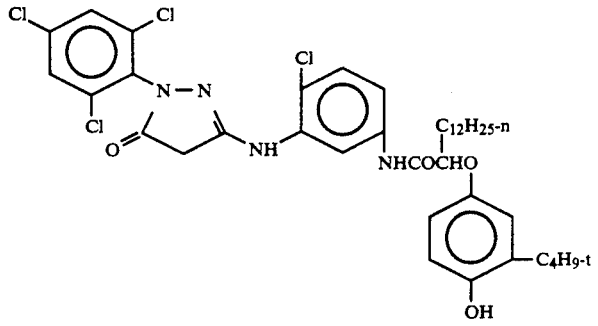
C-21
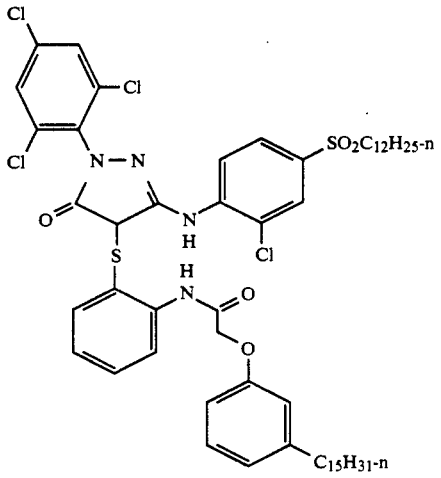
C-22
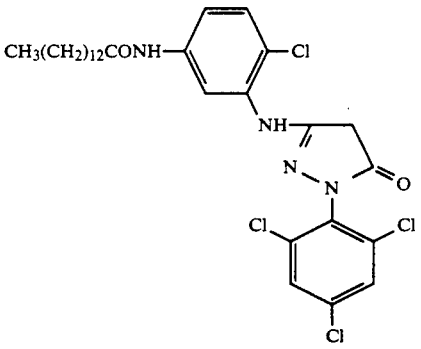
C-23
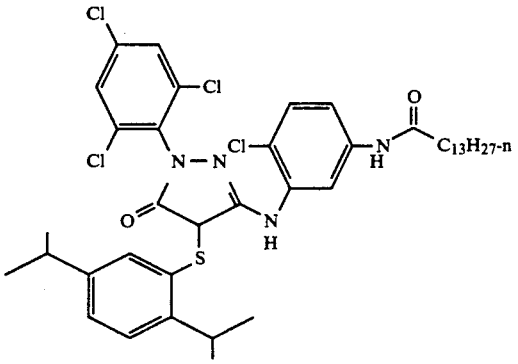

TABLE I-continued
Typical Dye Image-Forming Coupler Compounds
C-24
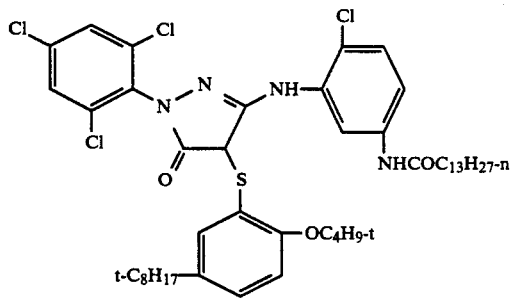
C-25
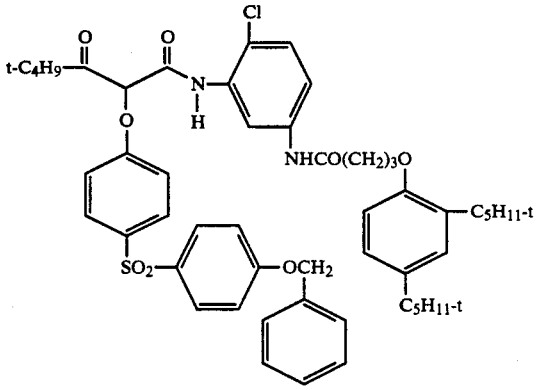
C-26
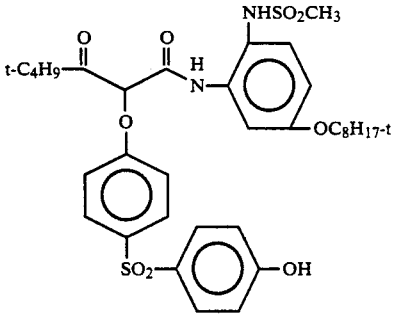
C-27
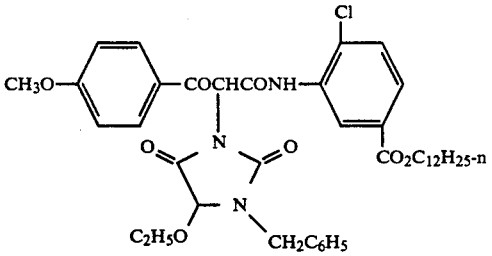
C-28
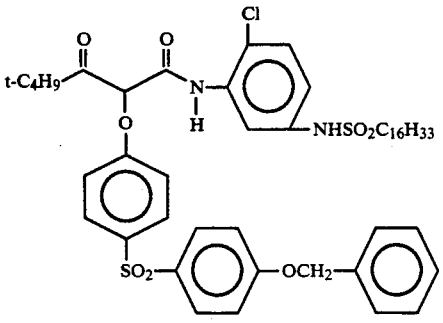

TABLE I-continued
Typical Dye Image-Forming Coupler Compounds
C-29
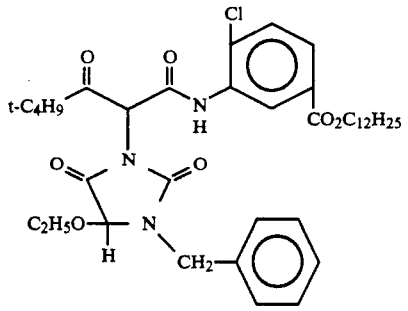
C-30
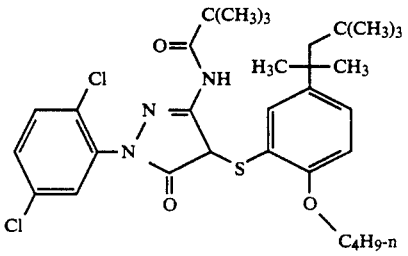
C-31
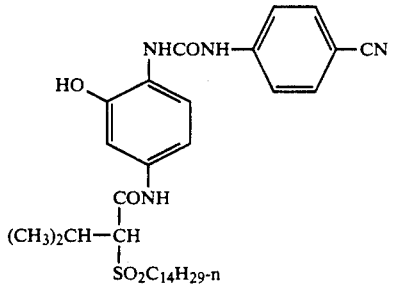
C-32
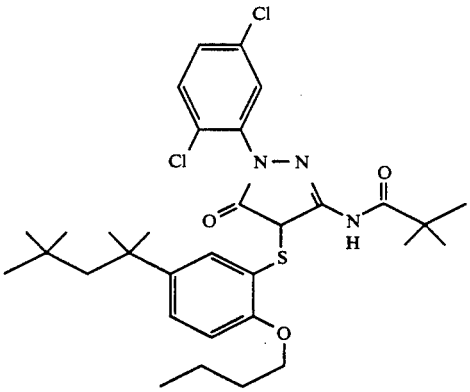
C-33
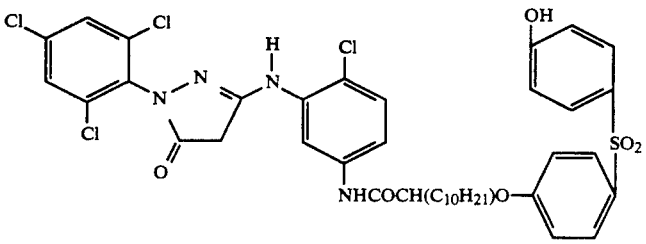

TABLE I-continued
Typical Dye Image-Forming Coupler Compounds
C-34
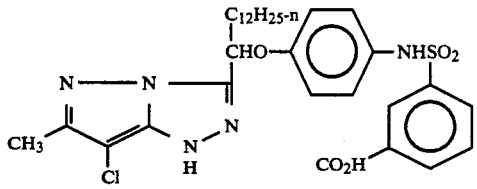
C-35
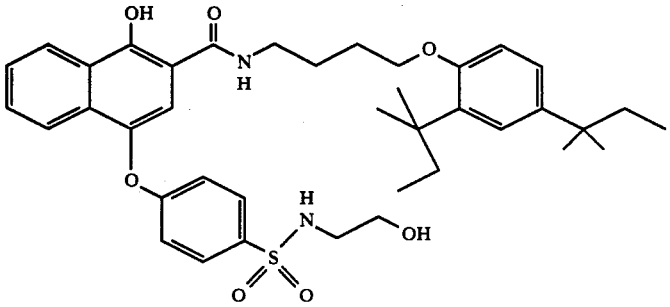
C-36
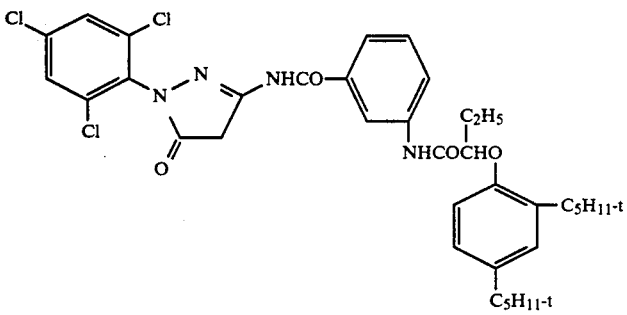
TABLE II
Typical PUG-Releasing Compounds That Release Development Inhibitor Groups or Precursors Thereof
D-1
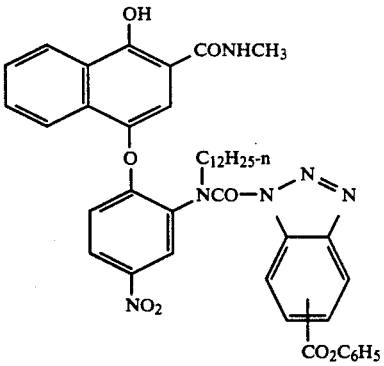

TABLE II-continued
Typical PUG-Releasing Compounds That Release
Development Inhibitor Groups or Precursors Thereof
D-2
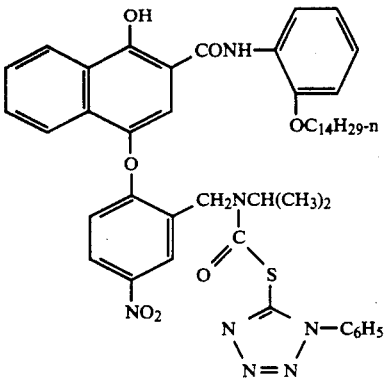
D-3
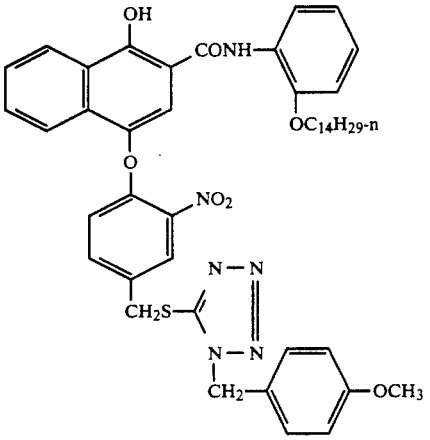
D-4
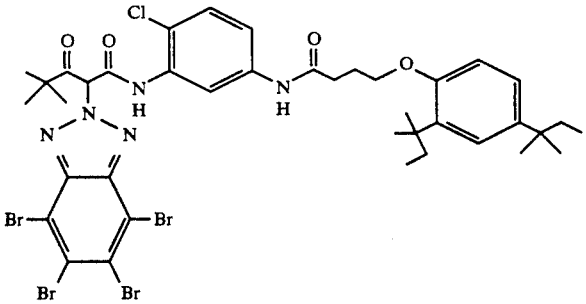
D-5
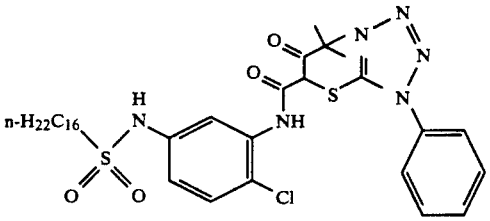

TABLE II-continued
Typical PUG-Releasing Compounds That Release
Development Inhibitor Groups or Precursors Thereof
D-6
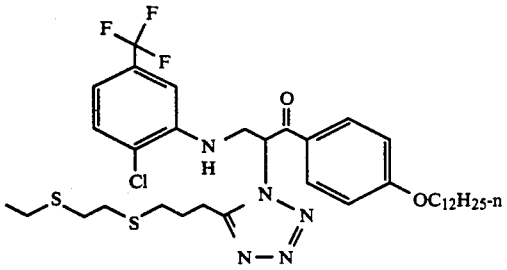
D-7
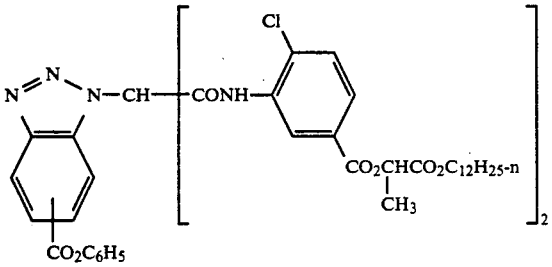
D-8
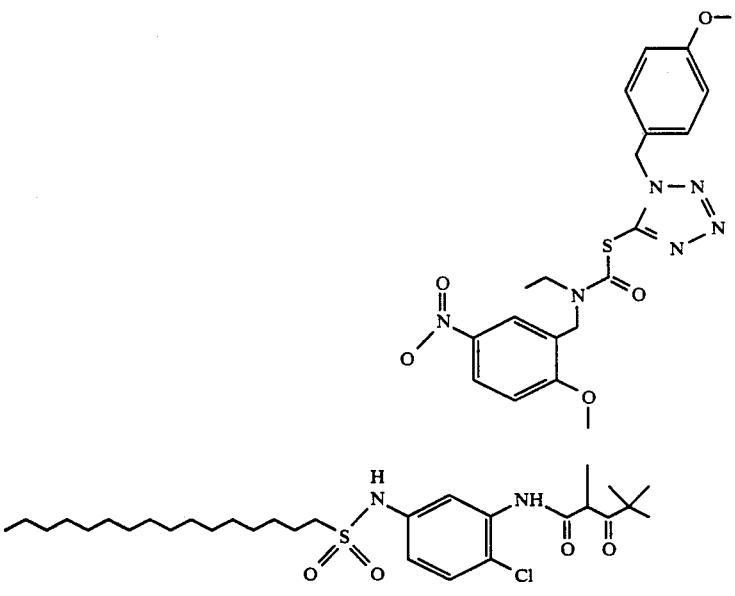
D-9
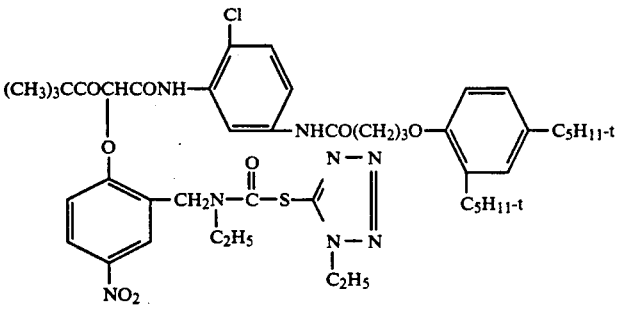

TABLE II-continued
Typical PUG-Releasing Compounds That Release
Development Inhibitor Groups or Precursors Thereof
D-10
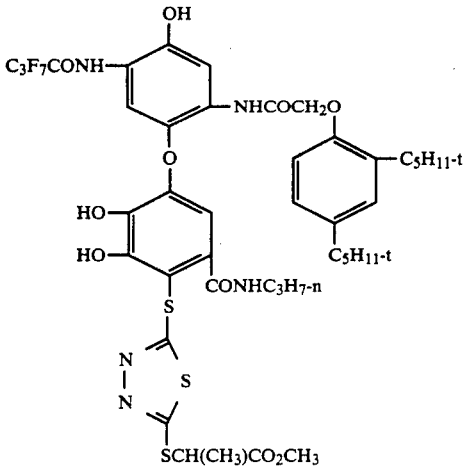
D-12
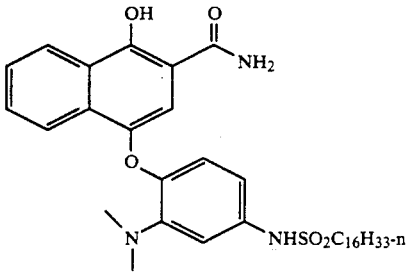
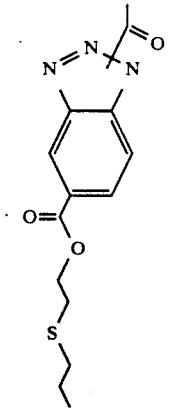
D-13
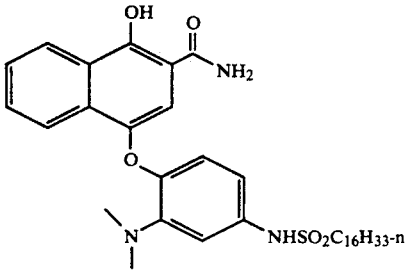

TABLE II-continued
Typical PUG-Releasing Compounds That Release Development Inhibitor Groups or Precursors Thereof
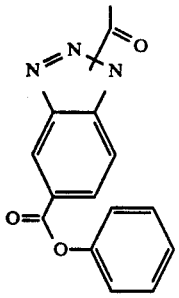
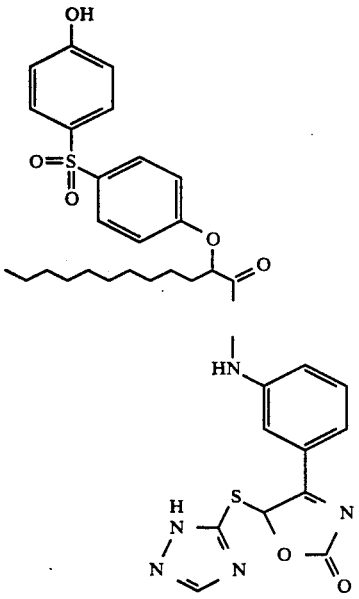
D-14
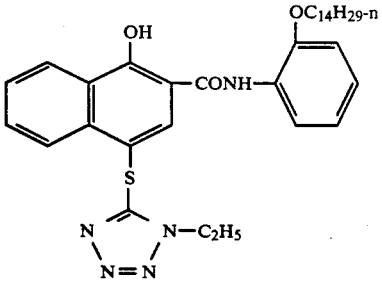
D-15
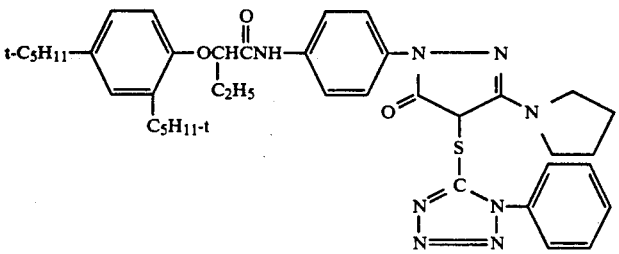
D-16

TABLE II-continued
Typical PUG-Releasing Compounds That Release
Development Inhibitor Groups or Precursors Thereof
D-17
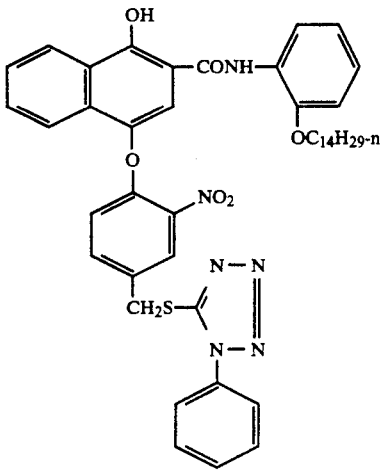
D-18
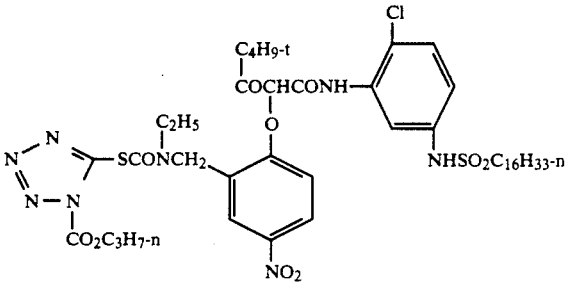
D-19
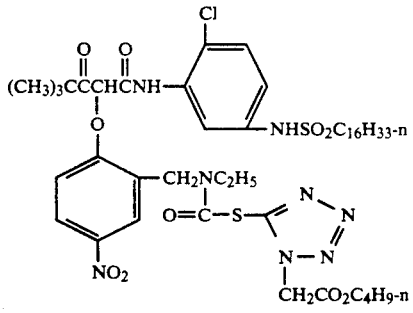
D-20
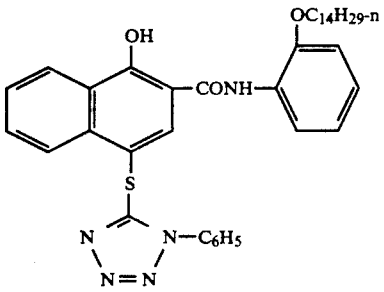

TABLE II-continued
Typical PUG-Releasing Compounds That Release Development Inhibitor Groups or Precursors Thereof
D-21
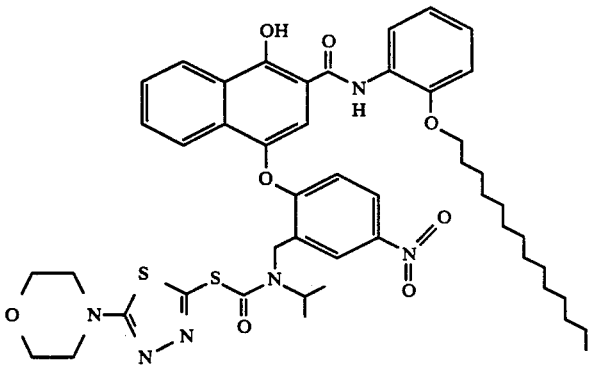
D-22
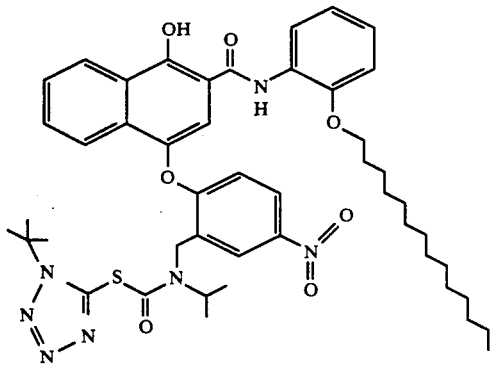
D-23
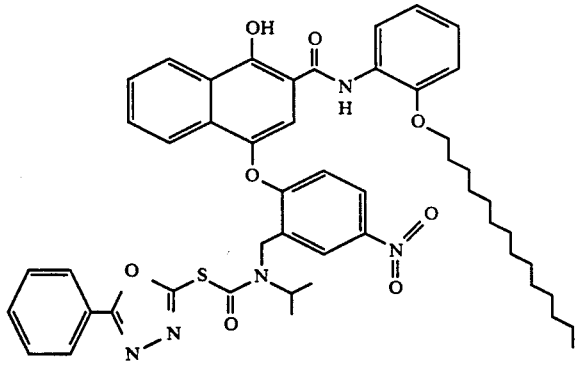
D-24
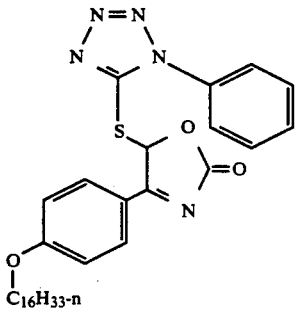

TABLE II-continued
Typical PUG-Releasing Compounds That Release Development Inhibitor Groups or Precursors Thereof
D-25
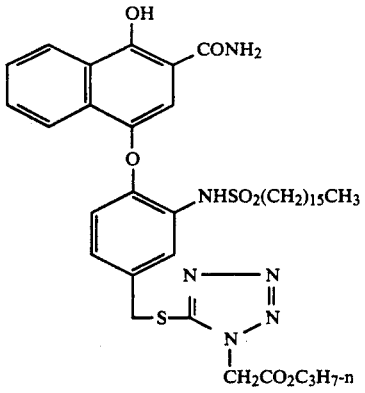
D-26
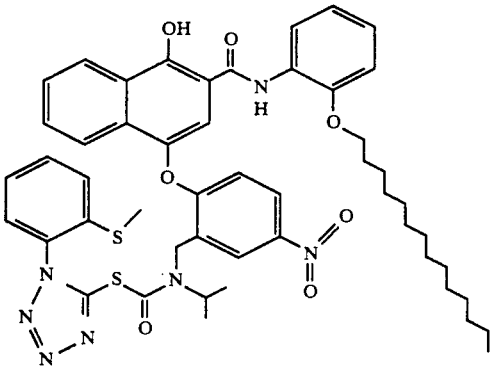
D-27
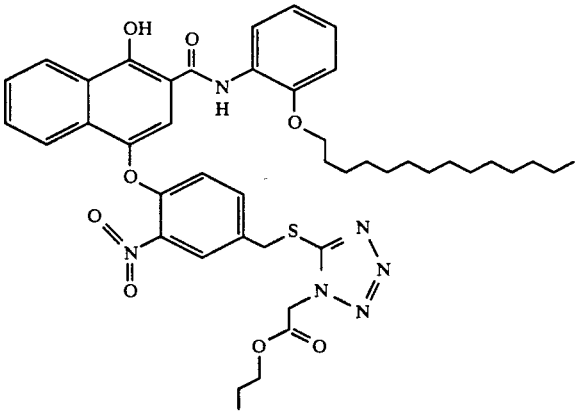
D-30
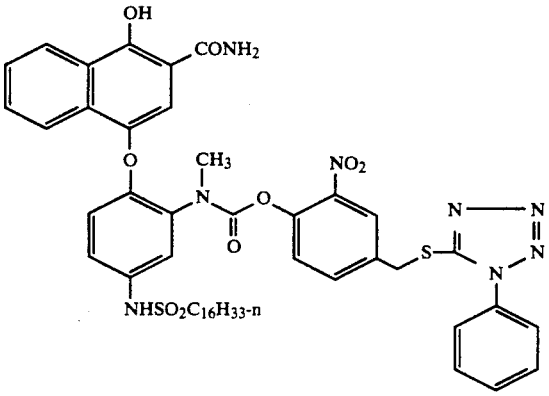

TABLE II-continued
| Typical PUG-Releasing Compounds That Release Development Inhibitor Groups or Precursors Thereof | |
|---|---|
| 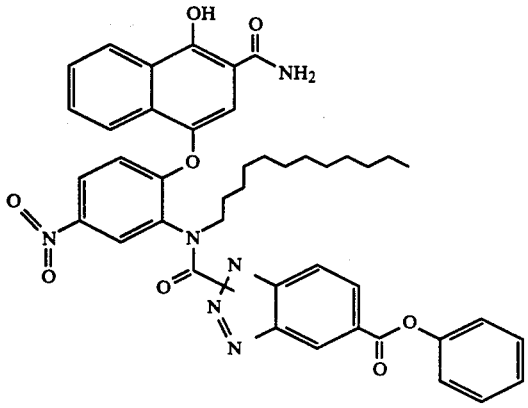 | D-31 |
| 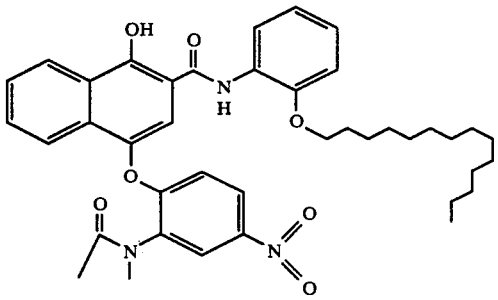 | D-32 |
| 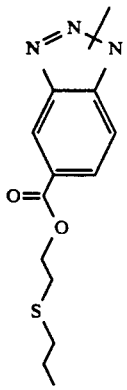 | |
| 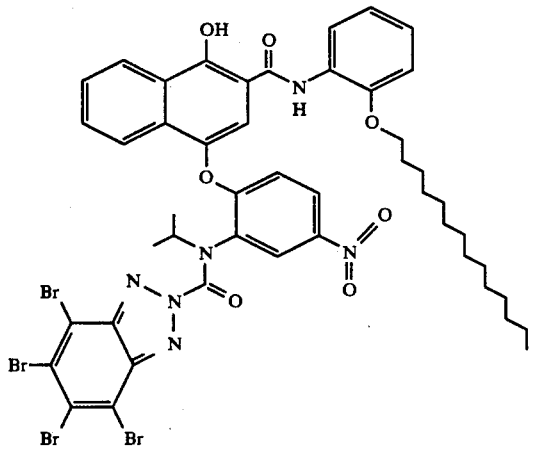 | D-33 |

TABLE II-continued
| Typical PUG-Releasing Compounds That Release Development Inhibitor Groups or Precursors Thereof | |
|---|---|
| 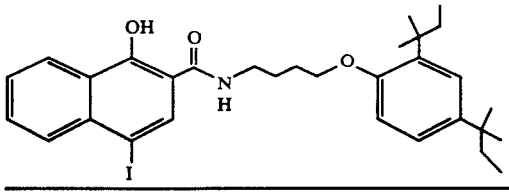 | C-45 |
TABLE III
| Typical PUG-Releasing Compounds That Release Groups Other Than Development Inhibitors | |
|---|---|
| Compound | PUG |
| 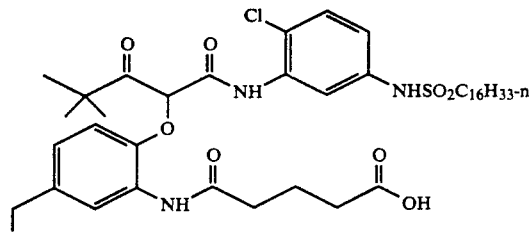 | Dye |
| 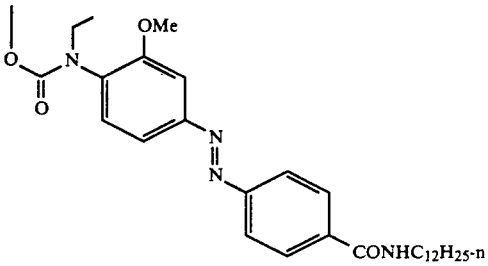 | |
| C-37 | |
| 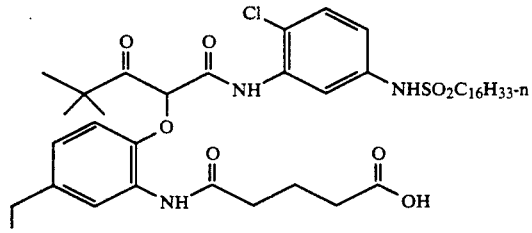 | Dye |
| 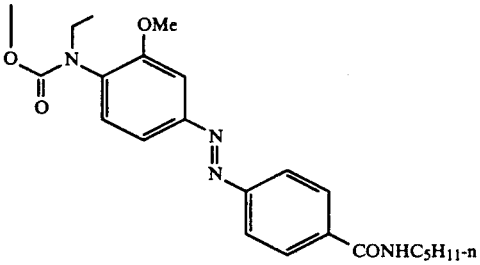 | |
| C-38 | |

TABLE III-continued
Typical PUG-Releasing Compounds That Release Groups Other Than Development Inhibitors
| Compound | PUG |
|---|---|
| 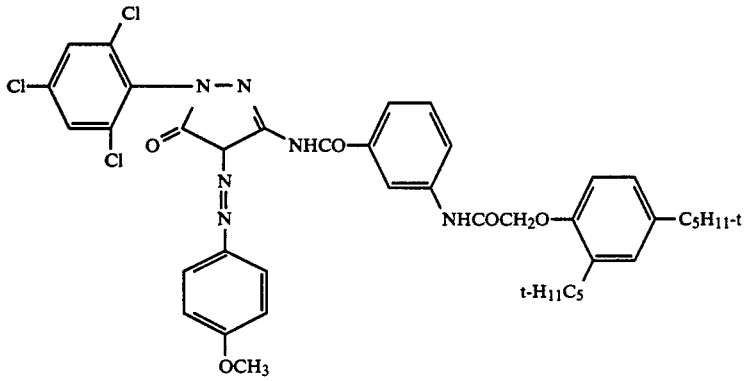 C-39 | Dye |
| 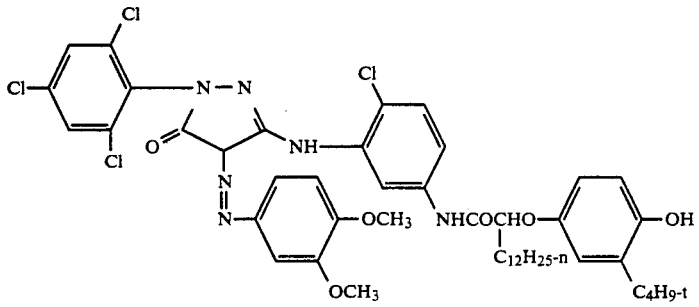 C-40 | Dye |
| 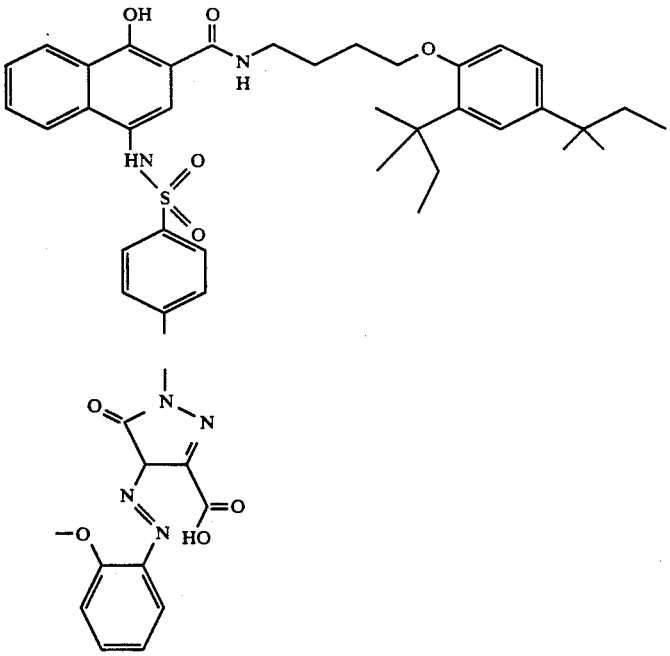 C-41 | Dye |

TABLE III-continued
| Typical PUG-Releasing Compounds That Release Groups Other Than Development Inhibitors | |
|---|---|
| Compound | PUG |
| 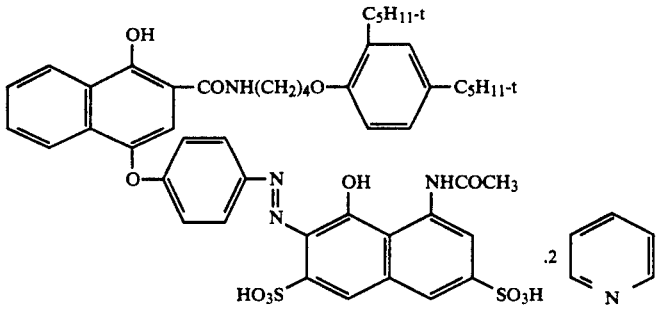 C-42 | Dye |
| 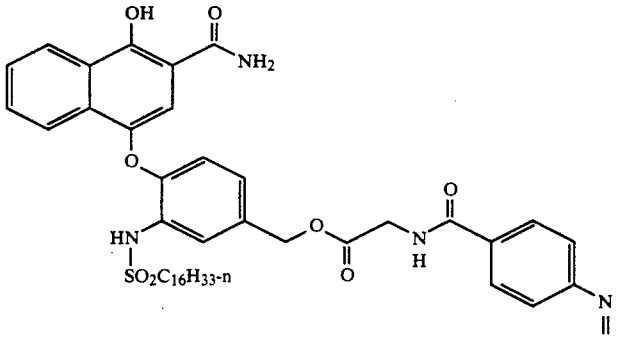 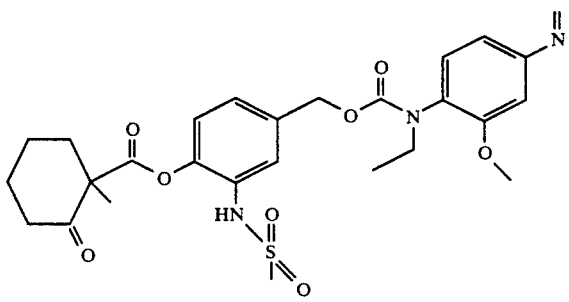 C-43 | Shifted Dye |
| 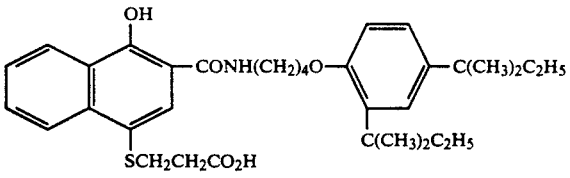 B-1 | Bleach Accelerator |
| 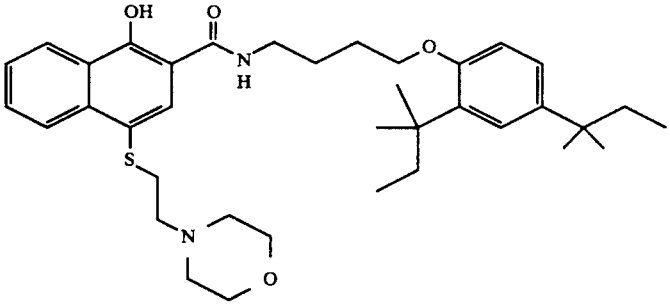 B-6 | Bleach Accelerator |

TABLE III-continued
Typical PUG-Releasing Compounds That
Release Groups Other Than Development Inhibitors
| Compound | PUG |
|---|---|
| 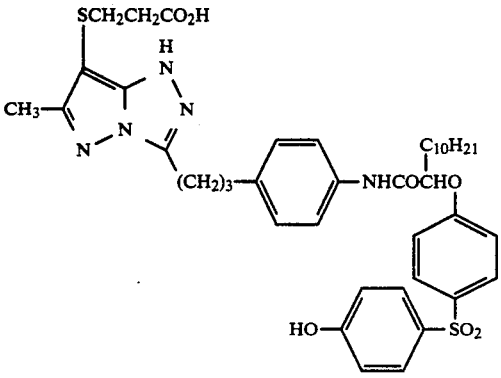 B-36 | Bleach Accelerator |
| 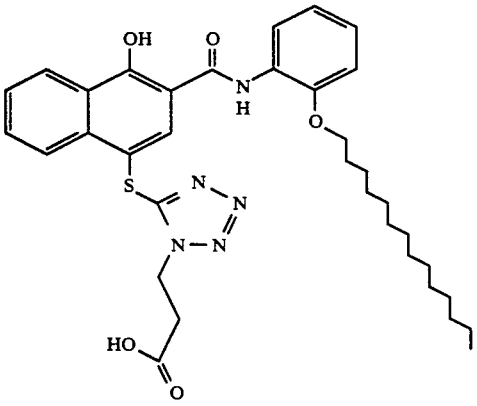 D-28 | Bleach Accelerator |
| 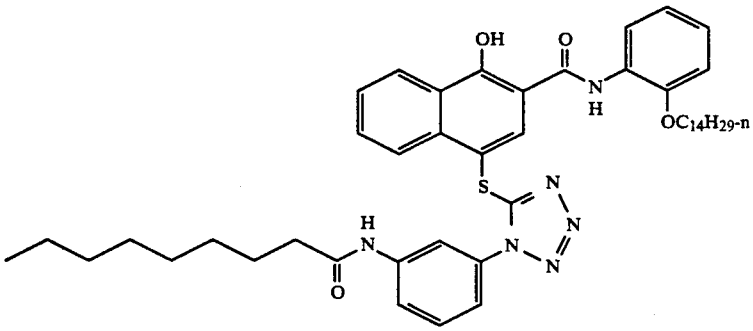 D-29 | Bleach Inhibitor |

TABLE III-continued
Typical PUG-Releasing Compounds That
Release Groups Other Than Development Inhibitors
| Compound | PUG |
|---|---|
| 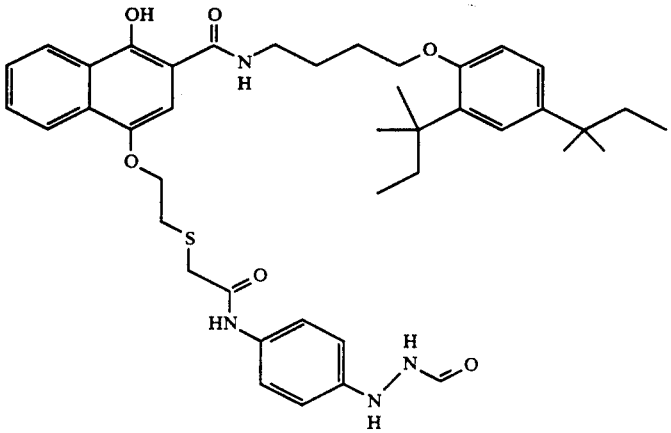 C-49 | Development Accelerator |
| 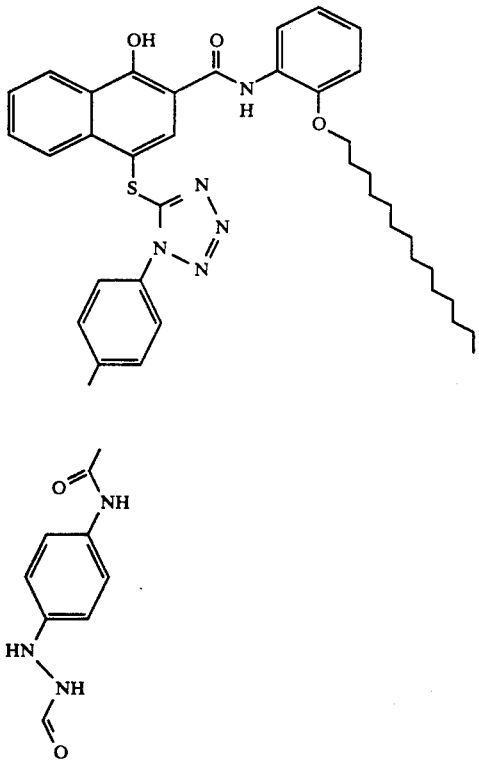 C-50 | Development Accelerator |

TABLE III-continued
| Typical PUG-Releasing Compounds That Release Groups Other Than Development Inhibitors | |
|---|---|
| Compound | PUG |
| 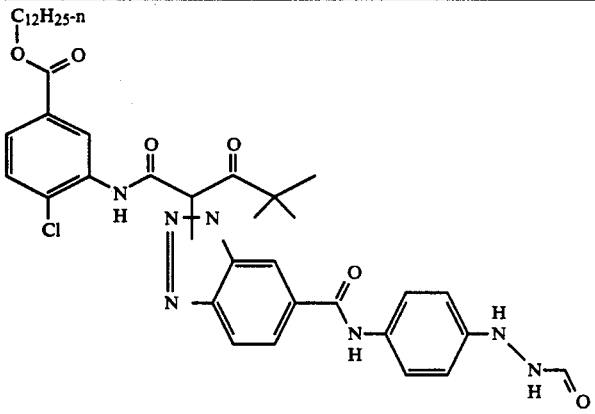 C-51 | Development Accelerator |
| 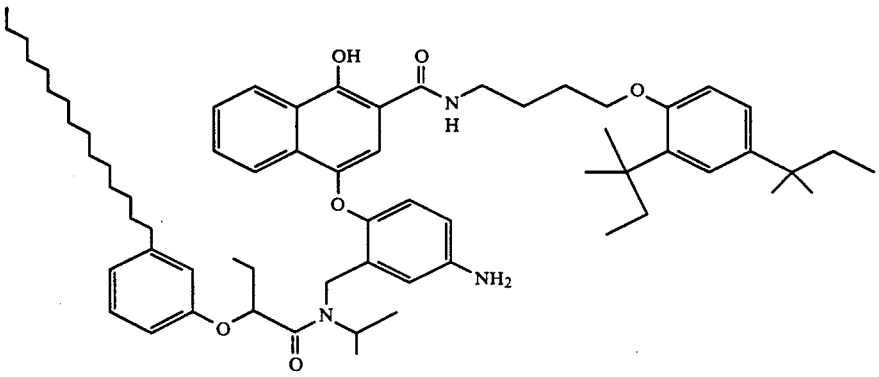 C-46 | Competing Coupler |
| 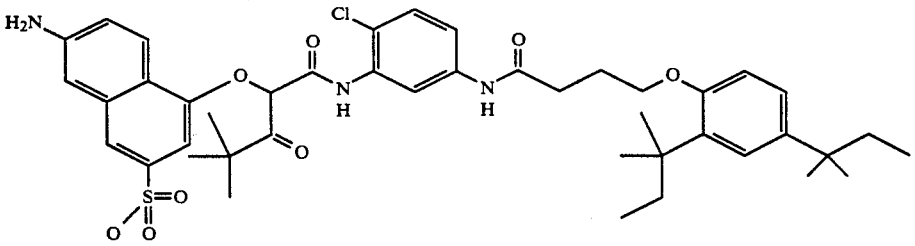 C-47 | Competing Coupler |
| 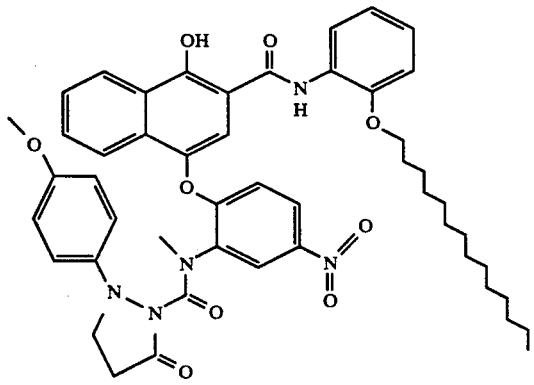 C-52 | Electron Transfer Agent |

TABLE IV
Miscellaneous Exemplary Photographic Compounds
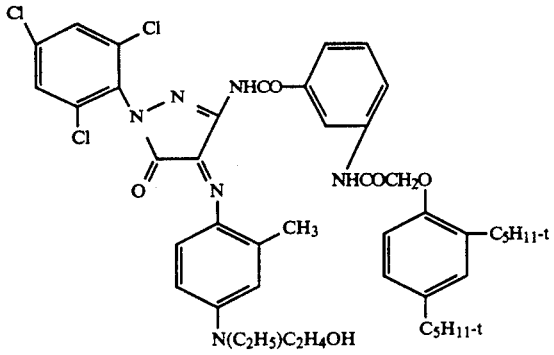
DYE-1
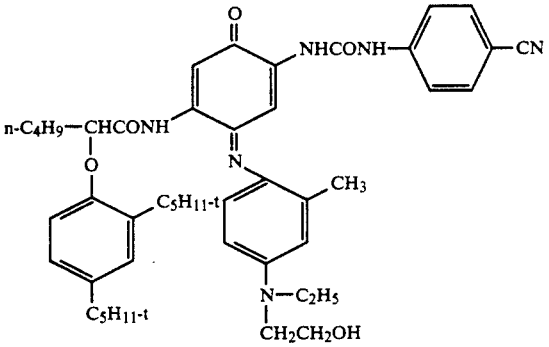
DYE-2
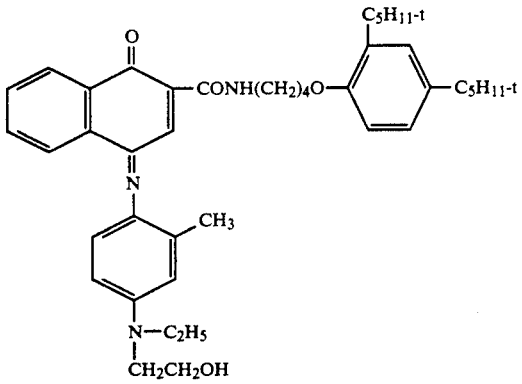
DYE-3
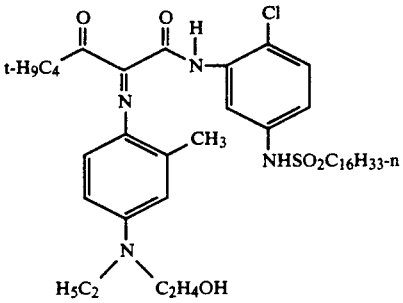
DYE-4
TABLE IV-continued
Miscellaneous Exemplary Photographic Compounds
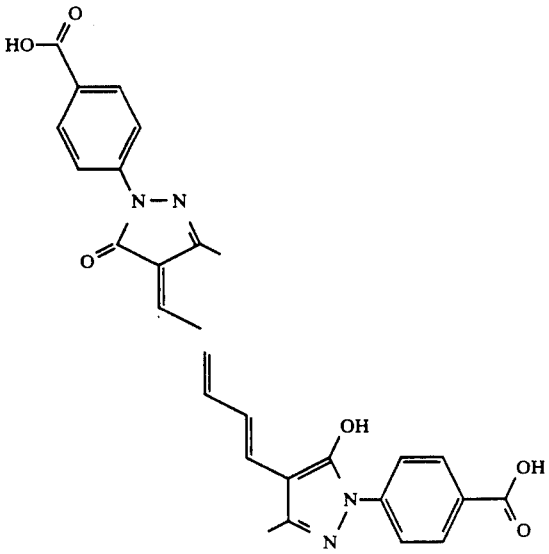
DYE-6
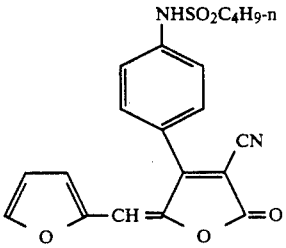
DYE-7
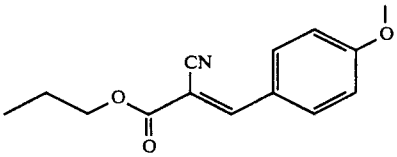
DYE-8
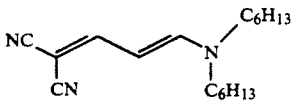
DYE-9
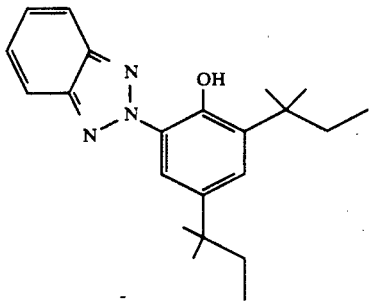
DYE-10

TABLE IV-continued

Miscellaneous Exemplary Photographic Compounds

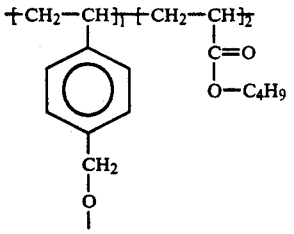

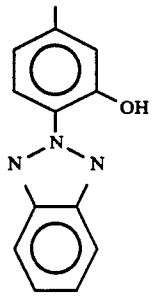

(wt. ratios)

DYE-11

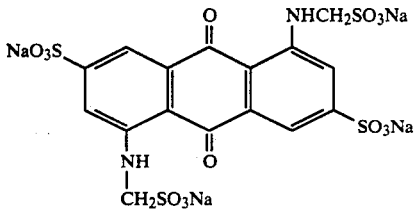

SOL-1

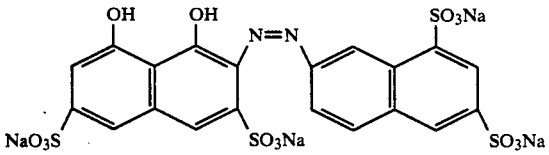

SOL-2

Mixture of Isomeric Didodecylhydroquinones

S-1

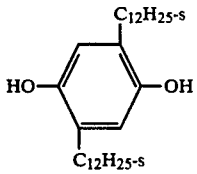

S-2

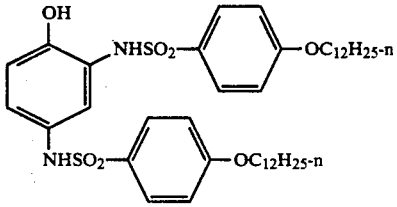

S-3

TABLE IV-continued

Miscellaneous Exemplary Photographic Compounds

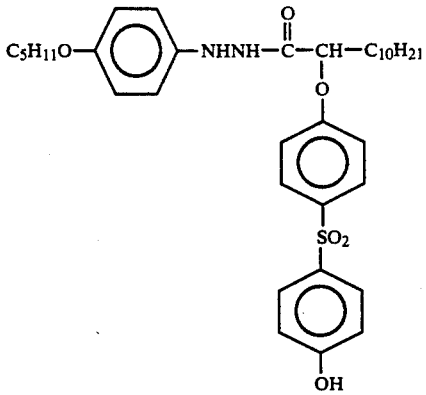

S-4

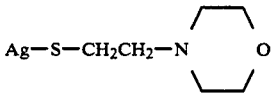

BA-1

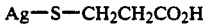

BA-2

The roll films can, but need not, contain conventional emulsions, addenda and layers in addition to those specifically described. Such conventional features are disclosed in ICBR-1 through ICBR-13, cited and incorporated by reference above. *Research Disclosure*, Vol. 308, Dec. 1989, Item 308,119, also provides a useful summary of conventional photographic features.

The quantities of silver halide are given in g of silver per $m^2$. The quantities of other materials are given in g per $m^2$. Since in each example the roll film is compared against one or more roll films identically constructed, except for identified features, a number of unvaried conventional components identical in each compared roll film group, such as hardeners, coupler solvents, oxidized developing agent scavengers, stabilizers, and sensitizers, are not individually enumerated. The emulsions were in each instance substantially optimally sulfur and gold sensitized and contained adsorbed spectral sensitizing dye to impart the stated spectral sensitivity. In all emulsions identified as tabular grain emulsions tabular grains accounted for more than 50 percent of total grain projected.

PHOTOGRAPHIC EXAMPLE 1

Photographic Sample ML-301 (Comparative Element)

A multicolor roll film was constructed in the following manner:

Support: Cellulose triacetate, thickness 127 μm.

Layer 1 Antihalation Layer: grey silver at 0.323 g with 2.44 g gelatin.

Layer 2 Lower Sensitivity Red-Recording Layer:

Red sensitized silver iodobromide emulsion, ≈4 mole percent iodide, mean ECD 0.5 μm, average grain thickness 0.08 μm, at 0.269 g; red sensitized silver iodobromide emulsion, ≈3.7 mole percent iodide, mean ECD 1.0 μm, average grain thickness 0.09 μm, at 0.538 g; C-1 at 0.70 g; D-3 at 0.075; with gelatin at 2.04 g.

Layer 3 Higher Sensitivity Red-Recording Layer:

Red sensitized silver iodobromide emulsion, ≈3.7 mole percent iodide, mean ECD 1.2 μm, average grain thickness 0.12 μm, at 0.538 g; C-1 at 0.129 g; D-3 at 0.065 g; with gelatin at 2.15 g.

Layer 4 Interlayer: 1.29 g of gelatin.

Layer 5 Lower Sensitivity Green-Recording Layer:

Green sensitized silver iodobromide emulsion, ≈4 mole percent iodide, mean ECD 0.5 μm, average grain thickness 0.08 μm, at 0.269 g; green sensitized silver iodobromide emulsion, ≈3.7 mole percent iodide, mean ECD 1.0 μm, average grain thickness 0.09 μm, at 0.538 g; C-2 at 0.323 g; D-2 at 0.108 g; with gelatin at 2.15 g.

Layer 6 Higher Sensitivity Green-Recording Layer:

Green sensitized silver iodobromide emulsion, ≈3.7 mole percent iodide, mean ECD 1.2 μm, average grain thickness 0.12 μm, at 0.538 g; magenta dye-forming image coupler C-2 at 0.086 g; DIR compound D-16 at 0.065 g, with gelatin at 1.72 g.

Layer 7 Interlayer: 1.29 g of gelatin.

Layer 8 Lower Sensitivity Blue-Recording Layer:

Blue sensitized silver iodobromide emulsion, ≈4 mole percent iodide, mean ECD 0.5 μm, average grain thickness 0.08 μm, at 0.161 g; blue sensitized silver iodobromide emulsion, ≈3.7 mole percent iodide, mean ECD 0.72 μm, average grain thickness 0.09 μm, at 0.269 g; C-3 at 1.08 g; D-8 at 0.065 g; with gelatin at 1.72 g.

Layer 9 Higher Sensitivity Blue-Recording Layer:

Blue sensitized silver iodobromide emulsion, ≈9 mole percent iodide, mean ECD 1.3 μm at 0.646 g; C-3 at 0.129 g; D-8 at 0.043 g; with gelatin at 1.72 g.

Layer 10 Protective Layer-1:

DYE-8 at 0.108 g: DYE-9 at 0.161 g; unsensitized silver bromide Lippman emulsion at 0.108 g; N,N,N-trimethyl-N-(2-perfluorooctylsulfonamidoethyl) ammonium iodide; sodium triisopropylnaphthalene sulfonate; and gelatin at 0.54 g.

Layer 11 Protective Layer-2:

Silicone lubricant at 0.026 g; tetraethylammonium perfluorooctanesulfonate; t-octylphenoxyethoxyethylsulfonic acid sodium salt; anti-matte poly(methylmethacrylate) beads at 0.0538 g; and gelatin at 0.54 g.

The total dry thickness of the light sensitive layers was about 16.4 μm while the total dry thickness of all the applied layers was about 21.7 μm.

Photographic Sample ML-302 (Comparative Element)

This multicolor roll film was identical to ML-301, except that the silver iodobromide emulsions were removed from layers 8 and 9 and replaced with equal weights of silver chloride emulsions as follows:

to Layer 8: Blue sensitized cubic grain silver chloride emulsion, average edge length 0.28 μm, at 0.43 g.

to Layer 9: Blue sensitized cubic grain silver chloride emulsion, average edge length 0.6 μm at 0.646 g.

Photographic Sample ML-303 (Example element)

This multicolor roll film was identical to ML-301, except that the silver iodobromide emulsions were removed from layers 8 and 9 and replaced with equal weights of silver chloride emulsions as follows:

to Layer 8: Blue sensitized {100} tabular grain silver iodochloride (0.05 mole percent iodide) emulsion, mean ECD 1.2 μm, average grain thickness 0.14 μm, at 0.43 g.

to Layer 9: Blue sensitized {100} tabular grain silver iodochloride (0.05 mole percent iodide) emulsion, mean ECD 1.4 μm, average grain thickness 0.14 μm, at 0.646 g.

Photographic Sample ML-304 (Example element)

This multicolor roll film was identical to ML-303, except that the silver iodobromide emulsions were removed from layers 2, 3, 5 and 6 and replaced with equal weights of silver iodochloride emulsions as follows:

to Layer 2: Red sensitized {100} tabular grain silver iodochloride (0.05 mole percent iodide) emulsion, mean ECD 1.2 μm, average grain thickness 0.14 μm, at 0.43 g.

to Layer 3: Red sensitized {100} tabular grain silver iodochloride (0.05 mole percent iodide) emulsion, mean ECD 1.4 μm, average grain thickness 0.14 μm, at 0.646 g.

to Layer 5: Green sensitized {100} tabular grain silver iodochloride (0.05 mole percent iodide) emulsion, mean ECD 1.2 μm, average grain thickness 0.14 μm, at 0.43 g.

to Layer 6: Green sensitized {100} tabular grain silver iodochloride (0.05 mole percent iodide) emulsion, mean ECD 1.4 μm, average grain thickness 0.14 μm, at 0.646 g.

Photographic Example 2 Lowered Film Bend Sensitivity

Photographic Samples ML-301 through ML-304 were evaluated for bend sensitivity by drawing unexposed looped 35mm strips between a pair of parallel metal plates rigidly held 2.8 mm apart. The test was performed twice on each sample, once with the film looped emulsion side in and once with the film looped emulsion side out. The samples were then processed using a color negative process, the Kodak Flexicolor TM C-41 process, described in the British Journal of Photography Annual of 1988 at pages 196–198. The bleach used in the process was modified so as to comprise 1,3-propylenediamine tetraacetic acid.

The density formed in the bent (or stressed) region was measured and compared to the fog density formed in the unstressed regions. Changes in density formation in the stressed regions is a measure of the film sample sensitivity to being tightly rolled, bent or otherwise kinked. Lower values of this stress fog are preferred since bend, stress or kink marks on a film intended for viewing or printing will produce unsightly marks and blemishes which detract from the visual appearance of the final image. Results of these test are shown in Table V below.

TABLE V

| | Film Bending Sensitivity | | | | | | | | |
|---|---|---|---|---|---|---|---|---|---|
| | Emulsion Type in Layer | | | Change in Density on Bending | | | | | |
| | | | | Emulsion In | | | Emulsion Out | | |
| Sample | 2 & 3 (Red) | 5 & 6 (Green) | 8 & 9 (Blue) | Red | Green | Blue | Red | Green | Blue |
| ML-301 control | IBr-T | IBr-T | IBr-T | 0.06 | 0.06 | 0.04 | 0.13 | 0.15 | 0.24 |

TABLE V-continued

| Sample | | Film Bending Sensitivity: Emulsion Type in Layer 2 & 3 (Red) | 5 & 6 (Green) | 8 & 9 (Blue) | Change in Density on Bending: Emulsion In Red | Green | Blue | Emulsion Out Red | Green | Blue |
|---|---|---|---|---|---|---|---|---|---|---|
| ML-302 | control | IBr-T | IBr-T | Cl-cube | 0.07 | 0.07 | 0.07 | 0.15 | 0.18 | 0.17 |
| ML-303 | inven. | IBr-T | IBr-T | Cl-T | 0.06 | 0.06 | 0.01 | 0.13 | 0.14 | 0.07 |
| ML-304 | inven. | Cl-T | Cl-T | Cl-T | 0.02 | 0.03 | 0.05 | 0.05 | 0.06 | 0.09 |

Here IBr-T indicates silver iodobromide tabular grain emulsions; Cl-cube indicates silver chloride cubic grain emulsions; and CL-T indicates high chloride {100} tabular grain emulsions.

As is readily apparent on examination of the data in Table V, replacement of the AgIBr emulsions in the blue sensitized layers of sample ML-301 by cubic grain AgCl emulsions to form sample ML-302 results in marginally increased stabilization (marginally lowered sensitivity increase) of the film sample to bending stress. Replacement of the cubic grain AgCl emulsions in the blue sensitive layers of sample ML-302 by high chloride {100} tabular grain emulsions to form inventive sample ML-303 results in markedly increased stabilization (markedly reduced film sensitivity increase) to bending stress. Replacement of the AgIBr emulsions in the red and green sensitive layers of ML-303 with high chloride {100} tabular grain emulsions to form sample ML-304 provides a sample that has markedly lowered sensitivity to bending stress. It is thus suggested that the film samples containing high chloride {100} tabular grain emulsions can be tightly wound on film spools or bent at high angles without forming unsightly stress fog marks, thereby making them ideal candidates for miniaturized cameras and film spools that require such flexible film samples so as to operate in a desired manner.

Photographic Example 3 Increased Image Sharpness

Photographic Samples ML-301 through ML-303 were exposed to sinusoidal patterns of white light to determine the Modulation Transfer Functon (MTF) as a function of spactial frequency, reported in cycles per mm (c/mm). Photographic processing was conducted as reported in Photographic Example 2. MTF evaluation was conducted by the procedures described by R. L. Lamberts and F. C. Eisen, "A System for the Automatic Evaluation of Modulation Transfer Functions of Photographic Materials", in the *Journal of Applied Engineering*, vol. 6, pp. 1-8, Feb. 1980.

Light scattering by the emulsions in the overlying blue recording emulsion layers was observed by recording the resolving power in cycles per mm in the underlying green and red recording layers. The higher the cycles per mm, the greater the resolving power and hence the greater the image sharpness in the identified emulsion layer. The results are summarized in Table VI.

TABLE VI

| Sample | | Resolving Power as a Function of the Emulsion in the Overlying Layer: Overlying Blue Layer | MTF (cycles/mm) Green | Red | Relative MTF Green | Red |
|---|---|---|---|---|---|---|
| ML-301 | control | IBr-T | 58 | 42 | 100% | 100% |
| ML-302 | control | Cl-Cubes | 43 | 38 | 74% | 90% |
| ML-303 | inven. | Cl-T | 62 | 58 | 107% | 138% |

It is apparent that incorporation of a high chloride {100} tabular grain emulsion (Cl-T) in the overlying blue recording emulsion layer greatly improves the resolving power of the underlying green and red recording emulsion layers. Neither the tabular grain silver iodobromide emulsion IBr-T nor the cubic grain silver chloride emulsion Cl-Cubes performs as well.

Although the advantage is demonstrated in Table VI in terms of increased MTF, it is possible in an imaging system to utilize the advantage in other ways. For example, instead of producing an image of higher sharpness the objective is often to produce an image of acceptable sharpness utilizing a low cost lens (e.g., a molded plastic lens) that can be readily manufactured. This objective is important in utilizing roll film in a single use camera. The benefit to the end user is that in balancing imaging quality against cost a better imaging value is realized.

Photographic Example 4

Photographic Sample ML-801 (Comparative element)

A multicolor roll film was constructed in the following manner:

Support: Cellulose triacetate, thickness 127 μm.

Layer 1 Antihalation Layer:

DYE-1 at 0.11 g, DYE-2 at 0.11 g, SOL-1 at 0.006 g, SOL-2 at 0.006 g, C-39 at 0.0646 g with 2.42 g gelatin.

Layer 2 Red Recording Layer:

Red sensitized silver iodobromide emulsion ( ≈4 mol % iodide), mean ECD 1.0 μm, average thickness 0.09 μm, at 0.54 g, red sensitized silver iodobromide emulsion (≈4 mol % iodide), mean ECD 1.3 μm, average grain thickness 0.12 μm, at 0.53 g, cyan dye-forming image coupler C-1 at 0.65 g, DIR compound D-17 at 0.032 g, DIR compound D-15 at 0.022 g, masking coupler C-41 at 0.032 g, masking coupler C-42 at 0.054 g with 1.95 g gelatin.

Layer 3 Interlayer:

S-1 at 0.054 g with 0.70 g gelatin.

Layer 4 Green Recording Layer:

Green sensitized silver iodobromide emulsion (≈4 mol iodide), mean ECD 1.0 μm, average grain thickness 0.09 μm, at 0.54 g, green sensitized silver iodobromide emulsion (≈4 mol % iodide), mean ECD 1.3 μm, average grain thickness 0.12 μm, at 0.53 g, magenta dye-forming image coupler C-15 at 0.22 g, magenta dye forming image coupler C-16 at 0.22 g, DIR compound D-7 at 0.043 g, DIR compound D-16 at 0.022 g, masking coupler C-40 at 0.065 g, with 1.63 g gelatin.

Layer 5 Interlayer:

S-1 at 0.054 g, DYE-7 at 0.11 g with 0.70 g gelatin.

Layer 6 Blue Recording Layer:

Blue sensitized silver iodobromide emulsion (≈4 mol % iodide), mean ECD 0.9 μm, average grain thickness 0.09 μm, at 0.38 g, blue sensitized silver iodobromide emulsion (≈4 mol % iodide), mean ECD 3.4 μm, average grain thickness 0.14 μm, at 0.39 g, yellow dye-forming image coupler C-3 at 1.08 g, DIR compound D-18 at 0.108 g, BAR compound B-1 at 0.005 g, DYE-3 at 0.011 g, with 1.94 g gelatin.

Layer 7 Protective Overcoat

DYE-2 at 0.004 g, DYE-8 at 0.054 g, DYE-9 at 0.108 g, DYE-10 at 0.054 g, SOL-1 at 0.004 g, silver bromide Lippmann emulsion at 0.11 g, poly(methylmethacrylate) anti-matte beads at 0.054 g with gelatin at 1.35 g.

The imaging layers had a total thickness of about 10.7 μm while the entire film had a total thickness of about 13.4 μm.

Photographic Sample ML-802 (Comparative element)

This multicolor roll film was identical to ML-801, except that a poly(ethylene terephthalate) film support, 88.9 μm in thickness was substituted for the cellulose triacetate support. The polyester support was provided with magnetic recording media according to *Research Disclosure*, Vol. 343, Nov. 1992, Item 34390 (also disclosed by WO 92/08165 and WO 92/08227).

Photographic Sample ML-803 (Example element)

This multicolor roll film was identical to ML-802, except that the red, green and blue sensitized silver iodobromide emulsions were omitted and equal quantities of red, green and blue sensitized high chloride {100} tabular grain emulsions having mean ECD's ≈1.5 to 1.2 μm and average grain thicknesses of ≈0.14 to 0.12 μm were coated in their place.

Photographic Sample ML-804 (Example element)

This multicolor roll film was identical to ML-803, except the cellulose triacetate support used in ML-801 was again employed.

Photographic Example 5 Loading of films on film spools of specified dimensions.

Portions of photographic samples ML-801 through ML-804 were slit to 35 mm width and edge perforated. Lengths in the amount of 1,524 cm samples ML-801 a-nd ML-804 (both on 127 μm film base) were loaded onto film spools with a roll diameter less spool diameter (L−SD in formula I) of 8965 μm through 28 turns (TU). In a similar manner, 2,032 cm lenths of ML-802 (88.9 μm film base) were loaded onto film spools with a roll diameter less spool diameter (L−SD in formula I) of 8965 μm through 36 turns (TU). Likewise 1,524 cm lengths ML-803 (88.9 μm film base) were loaded onto film spools with a roll diameter less spool diameter (L−SD in formula I) of 6604 μm through 32 turns (TU). The formula I values in micrometers (μm) are set out in Table VII.

These spooled films were then run through a camera body without exposure and developed as described earlier in the Kodak Flexicolor TM C-41 color negative process. The samples thus spooled, run through a camera mechanism and developed were visually evaluated for spooling marks. Comparative element (prior art) sample ML-801 showed unsightly spooling marks while example element ML-804, which was identical, except for the substitution of high chloride {100} tabular grain emulsion satisfying the requirements of the invention showed no unsightly marks. While neither comparative element sample ML-802 nor example element sample ML-803 showed unsightly marks, the example element ML-803 was subjected to formula I values indicative of much higher levels of bending stress than those applied to comparative element sample ML-802.

The results are summarized in Table VII below. For best utilization of camera and spool volume, while minimizing spooling marks, a formula I value less than about 60 microns is preferred. Substantially larger formula I values are perfectly acceptable for film performance, but are indicative of less tightly wound spools (and hence less compact film rolls) as are commonly encountered in commercial practice.

TABLE VII

| | | Film loading on spools. | | | | |
|---|---|---|---|---|---|---|
| Sample | Emulsion Types | Support Thickness in μm | roll diameter — spool diameter | turns | Formula Value in μm | Spooling Marks |
| ML-801 | AgIBr | 127 | 8965 | 28 | 33 | YES |
| ML-802 | AgIBr | 88.9 | 8965 | 36 | 36 | NO |
| ML-803 | Cl-T | 88.9 | 6604 | 32 | 14 | NO |
| ML-804 | Cl-T | 127 | 8965 | 28 | 33 | NO |

Photographic Example 6

Samples ML-801 through ML-804 were evaluated for bend sensitivity by drawing unexposed looped 35mm film strips between a pair of parallel metal plates rigidly held 2.8 mm apart. The test was performed twice on each sample, once with the film looped emulsion side in and once with the film looped emulsion side out. The stressed samples were processes as described in the previous example and the density formed in stresses regions compared to the density formed in the unstressed regions. A change in density formation in the stressed regions is a measure of the film sample sensitivity to being tightly rolled, bent or otherwise kinked. Lower values are preferred since bend, kink or stress makers on a film intended for either direct viewing or printing will produce unsightly marks and blemishes which detract from the visual appearance of the final image.

As can be readily appreciated on examination of the data provided in Table VIII, the high chloride {100} tabular grain emulsions provided surprisingly good resistance to the formation of pressure induced or kink induced marks.

TABLE VIII

| | | | Film bending sensitivity | | | | | |
|---|---|---|---|---|---|---|---|---|
| | | Support | Change in Density on Bending | | | | | |
| | Emulsion | Thickness | Emulsion In | | | Emulsion Out | | |
| Sample | Types | (μm) | Red | Green | Blue | Red | Green | Blue |
| ML-801 | AgIBr | 127 | +0.07 | +0.13 | −0.02 | +0.08 | +0.17 | +0.01 |
| ML-802 | AgIBr | 88.9 | +0.02 | +0.03 | +0.02 | +0.02 | +0.06 | +0.02 |

TABLE VIII-continued

| Sample | Emulsion Types | Support Thickness (μm) | Film bending sensitivity: Change in Density on Bending, Emulsion In Red | Emulsion In Green | Emulsion In Blue | Emulsion Out Red | Emulsion Out Green | Emulsion Out Blue |
|---|---|---|---|---|---|---|---|---|
| ML-803 | T-Cl | 88.0 | 0 | 0 | 0 | 0 | 0 | 0 |
| ML-804 | T-Cl | 127 | +0.01 | +0.03 | 0 | +0.02 | +0.01 | +0.02 |

From Table VIII it is apparent that the roll films containing high chloride {100} tabular grain emulsion layers satisfying the requirements of the invention showed superior reductions in density change as a function of bending. Further, it is highly surprising that ML-803, which combined a polyester support with emulsion layer requirements of the invention effectively eliminated density changes as a function of bending, both when the emulsion layers occupied an outer and an inner position in the stress test.

Photographic Example 7 Spooling, loading and imaging in Single Use hand-held Cameras.

Portions of example element ML-304, prepared as described previously, were slit to 35mm width, edge punched and loaded onto film spools with a roll diameter minus spool diameter (L−SD) of 8965 μm. These spools were individually loaded into a Kodak Fun-Saver TM single use camera fitted with a Kodak 35mm f/11 fixed focus plastic lens. Indoor and outdoor pictures were exposed under lighting conditions appropriate for an ISO-400 speed color negative film. Samples of ML-304 thus exposed were developed according to using the Kodak Flexicolor TM C-41 color negative process with the bleach modified to contain 1,3-propylenediamine tetraacetic acid. The processed samples were optically printed on Kodak Edge TM color paper. High quality color print images were obtained. The slit, punched, spooled, exposed and processed portions of ML-304 were examined visually. These samples did not exhibit pressure-fog, pressure-desensitization or scratch marks.

Similarly, additional portions of example element ML-304 were spooled and loaded into a Kodak Fun-Saver TM panoramic 35mm single use Camera fitted with a Kodak 25mm f/12 fixed focus lens. Indoor and outdoor pictures were exposed under lighting conditions appropriate for an ISO-400 speed color negative film. Samples ML-304 thus exposed were processed and optically printed as described above to produce panoramic prints (≈8× enlargements). High quality color print images were obtained. The slit, punched, spooled, exposed and processed portions of ML-304 were examined visually. These samples did not exhibit pressure-fog, pressure-desensitization or scratch marks.

Photographic Example 8

Photographic Sample ML-703 (Example Element)

A multicolor roll film was constructed in the following manner:

Support: Cellulose triacetate, thickness 127 μm.

Layer 1 Antihalation Layer:

DYE-1 at 0.011 g; DYE-3 at 0.011 g; C-39 at 0.065 g; DYE-6 at 0.108 g; DYE-9 at 0.075g; gray colloidal silver at 0.215 g; SOL-Cl at 0.005; SOL-Ml at 0.005 g; with 2.41 g gelatin.

Layer 2 Interlayer:

0.108 g of S-1; B-1 at 0.022 g; with 1.08 g of gelatin.

Layer 3 Lowest Sensitivity Red-Recording Layer:

Red sensitized {100} tabular grain silver iodochloride (0.05 mole percent iodide) emulsion, mean ECD 1.2 μm, average grain thickness 0.12 μm, at 0.538 g; C-1 at 0.538 g; D-15 at 0.011g; C-42 at 0.054 g; D-3 at 0.054 g; C-41 at 0.032 g; S-2 at 0.005 g; with gelatin at 1.72 g.

Layer 4 Medium Sensitivity Red-Recording Layer:

Red sensitized {100} tabular grain silver iodochloride (0.05 mole percent iodide) emulsion, mean ECD 1.5 μm, average grain thickness 0.14 μm, at 0.592 g; C-1 at 0.075 g; D-15 at 0.011 g; C-42 at 0.032 g; D-17 at 0.032 g; C-41 at 0.022 g; S-2 at 0.005 g; with gelatin at 1.72 g.

Layer 5 Highest Sensitivity Red-Recording Layer:

Red sensitized {100} tabular grain silver iodochloride (0.05 mole percent iodide) emulsion, mean ECD 2.2 μm, average grain thickness 0.12 μm, at 0.592 g; C-1 at 0.075 g; D-15 at 0.011 g; C-42 at 0.022 g; D-17 at 0.032 g; C-41 at 0.011 g; S-2 at 0.005 g; with gelatin at 1.72 g.

Layer 6 Interlayer:

S-1 at 0.054 g; D-25 at 0.032 g; with 1.08 g of gelatin.

Layer 7 Lowest Sensitivity Green-Recording Layer:

Green sensitized {100} tabular grain silver iodochloride (0.05 mole percent iodide) emulsion, mean ECD 1.2 μm, average grain thickness 0.12 μm, at 0.484 g; C-2 at 0.355 g; D-17 at 0.022 g; C-40 at 0.043 g; D-8 at 0.022 g; S-2 at 0.011 g Layer 8 Medium Sensitivity Green-Recording Layer:

Green sensitized {100} tabular grain silver iodochloride (0.05 mole percent iodide) emulsion, mean ECD 1.5 μm, average grain thickness 0.14 μm, at 0.592 g; C-2 at 0.086 g; D-17 at 0.022 g; C-40 at 0.038 g; S-2at 0.011 g; with gelatin at 1.4 g.

Layer 9 Highest Sensitivity Green-Recording Layer:

Green sensitized {100} tabular grain silver iodochloride (0.05 mole percent iodide) emulsion, mean ECD 2.2 μm, average grain thickness 0.12 μm, at 0.592 g; C-2 at 0.075 g; D-16 at 0.022 g; C-40 at 0.038 g; D-7 at 0.022 g; S-2 at 0.011 g; with gelatin at 1.35 g.

Layer 10 Interlayer:

S-1 at 0.054 g; DYE-7 at 0.108 g; with 0.97 g of gelatin.

Layer 11 Lower Sensitivity Blue-Recording Layer:

Blue sensitized {100} tabular grain silver iodochloride (0.05 mole percent iodide) emulsion, mean ECD 1.2 μm, average grain thickness 0.12 μm, at 0.172 g; C-29 at 1.08 g; D-18 at 0.065 g; D-19 at 0.065 g; B-1 at 0.005 g; S-2 at 0.011 g; with gelatin at 1.34 g.

Layer 12 Higher Sensitivity Blue-Recording Layer:

Blue sensitized {100} tabular grain silver iodochloride (0.05 mole percent iodide) emulsion, mean ECD 2.2 μm, average grain thickness 0.12 μm, at 0.43 g; C-29 at 0.108 g; D-18 at 0.043 g; B-1 at 0.005 g; S-2 at 0.011 g; with gelatin at 1.13 g.

Layer 13 Protective Layer-1:

DYE-8 at 0.054 g; DYE-9 at 0.108 g; DYE-10 at 0.054 g; unsensitized silver bromide Lippmann emulsion at 0.108 g; N,N,N,-trimethyl-N-(2-perfluorooctylsulfonamidoethyl) ammonium iodide; sodium triisopropylnaphthalene sulfonate; SOL-Cl at 0.043 g; and gelatin at 1.08 g.

Layer 14 Protective Layer-2:

Silicone lubricant at 0.026 g; tetraethylammonium perfluorooctane sulfonate; t-octylphenoxyethoxyethylsulfonic acid sodium salt; anti-matte poly(methylmethacrylate) beads at 0.0538 g; and gelatin at 0.91 g.

The total dry thickness of the emulsion layers was about 12.1 μm while the total dry thickness of all the applied layers was about 20.5 μm.

Photographic Evaluation

Sample ML-703 was evaluated for bend sensitivity by drawing unexposed looped 35mm film strips between a pair of parallel metal plates rigidly held 2.8 mm apart. The test was performed twice on each sample, once with the film looped emulsion side in and once with the film looped emulsion side out. The stressed samples were processes as described immediately above and the density formed in stresses regions compared to the density formed in the unstressed regions. A change in density formation in the stressed regions is a measure of the film sample sensitivity to being tightly rolled, bent or otherwise kinked. Lower values are preferred since bend, kink or stress makers on a film intended for either direct viewing or printing will produce unsightly marks and blemishes which detract from the visual appearance of the final image.

As can be readily appreciated on examination of the data provided in Table IX, the high chloride {100} tabular grain emulsions provide surprisingly good resistance to the formation of pressure induced or kink induced marks even in a complex coating structure.

TABLE IX

| | | | Film bending sensitivity | | | | | |
|---|---|---|---|---|---|---|---|---|
| | | Support | Change in Density on Bending | | | | | |
| | Emulsion | Thickness | Emulsion In | | | Emulsion Out | | |
| Sample | Types | (μm) | Red | Green | Blue | Red | Green | Blue |
| ML-703 | T-Cl | 127 | +0.02 | +0.01 | −0.01 | +0.04 | +0.04 | +0.05 |

Photographic Example 9

Spooling, loading and imaging in a high quality single lens reflex 135 format hand-held camera fitted with a high quality lens.

Portions of example element Sample ML-304, prepared as described previously, were slit to 35mm width, edge punched and loaded onto film spools with a roll diameter less spool diameter (L−SD) value of 8965 μm. These spools were individually loaded into a Pentax TM K-1000 single lens reflex camera body fitted with an Ashahi Optical Co. 85mm focus and aperture adjustable lens. Indoor pictures were exposed for 1/60 sec at an aperture of f/5.6 using a flash attachment adjusted to provide sufficient light for an ISO-100 speed color negative film. Outdoor pictures were exposed for 1/60 sec at an aperture of f/8 on a cloudy day without a flash attachment. Portions of ML-304 thus exposed were developed according using the Kodak Flexicolor TM C-41 color negative process. The bleach used in the process was modified so as to comprise 1,3-propylenediamine tetraacetic acid. The processed samples were optically printed on Kodak Edge TM color paper. High quality color print images were obtained. The slit, punched, spooled, exposed and processed portions of ML-304 were examined visually. These samples did not exhibit objectionable pressure-fog, pressure-desensitization or scratch marks.

Portions of example element ML-703, prepared as described above, were slit to 35mm width edge punched and loaded onto film spools with a roll diameter to spool diameter distance of 8965 microns. These spools were loaded into a Minolta TM single lens reflex camera body fitted with a 50mm f/1.7 lens. Indoor and outdoor pictures were exposed generally as described above. Portions of ML-703 thus exposed were processed and optically printed on in the prior paragraph. High quality color print images were obtained. The slit, punched, spooled, exposed and processed portions of ML-703 were examined visually These samples did not exhibit objectionable pressure-fog, pressure-desensitization or scratch marks.

The invention has been described in detail with particular reference to preferred embodiments thereof, but it will be understood that variations and modifications can be effected within the spirit and scope of the invention.

What is claimed is:

1. A photographic camera film comprised of at least one radiation sensitive halide emulsion layer unit and a film base in a roll satisfying the formula $$\frac{L - SD}{TU \times 2} - FBT = 10 \text{ to } 60\ \mu m$$

in which

FBT is the thickness of the film base in micrometers (μm);

L is the diameter in μm of the film roll;

SD is the spool diameter in μm of the film roll, where, when the film is rolled on a spindle, the spool diameter is the diameter of the spindle and, when the film is rolled on itself, the spool diameter is the inside diameter of the film roll; and TU is the number of film turns in the film roll; wherein at least one emulsion layer unit is comprised of a radiation sensitive emulsion containing a silver halide grain population comprised of at least 50 mole percent chloride, based on silver, at least 50 percent of the grain population projected area being accounted for by tabular grains (1) bounded by {100} major faces having adjacent edge ratios of less than 10 and (2) each having an aspect ratio of at least 2.

2. A photographic camera film according to claim 1 wherein the tabular grains have an average aspect ratio of at least 5.

3. A photographic camera film according to claim 2 wherein the tabular grains have an average aspect ratio of greater than 8.

4. A photographic camera film according to claim 1 wherein the tabular grains have adjacent major face edge ratios of less than 5.

5. A photographic camera film according to claim 4 wherein the tabular grains have adjacent major face edge ratios of less than 2.

6. A photographic camera film according to claim 1 wherein the tabular grains have thicknesses of less than 0.3 μm.

7. A photographic camera film according to claim 1 wherein the tabular grains are thin tabular grains having thicknesses of less than 0.2 μm.

8. A photographic camera film according to claim 1 wherein the tabular grains are ultrathin tabular grains each internally containing iodide at their nucleation site and having an average thickness of less than 0.06 μm.

9. A photographic camera film according to claim 1 wherein the tabular grains contain at least 70 mole percent chloride.

10. A photographic camera film according to claim 9 wherein the tabular grains contain at least 90 mole percent chloride.

11. A photographic camera film according to claim 10 wherein the tabular grains are silver iodochloride grains.

12. A photographic camera film according to claim 10 wherein the tabular grains are silver bromochloride or silver chloride grains.

13. A photographic camera film according to claim 1 wherein the formula range is form 20 to 50.

14. A photographic camera film according to claim 1 wherein the film base is a cellulose ester film base having a thickness in the range of from 100 to 200 μm.

15. A photographic camera film according to claim 14 wherein the film base has a thickness in the range of from 125 to 175 mum.

16. A photographic camera film according to claim 15 wherein the film base is comprised of cellulose triacetate.

17. A photographic camera film according to claim 1 wherein the film base is comprised of a polyester of a dibasic aromatic carboxylic acid and a dihydroxy alcohol.

18. A photographic camera film according to claim 17 wherein the film base is less than 100 μm in thickness.

19. A photographic camera film according to claim 18 wherein the film base is comprised of poly(ethylene terephthalate).

* * * * *